US006707259B2

(12) United States Patent
Nagao et al.

(10) Patent No.: US 6,707,259 B2
(45) Date of Patent: Mar. 16, 2004

(54) GAS DISCHARGE PANEL

(75) Inventors: Nobuaki Nagao, Katano (JP); Hidetaka Higashino, Kyoto (JP); Toru Ando, Osaka (JP); Yuusuke Takada, Katano (JP); Masaki Nishimura, Tkatuki (JP); Ryuichi Murai, Toyonaka (JP); Koichi Wani, Toronto (CA); Naoki Kosugi, Kyoto (JP); Hiroyuki Tachibana, Osaka (JP); Yoshio Watanabe, Ibaraki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 10/182,027

(22) PCT Filed: Jan. 25, 2001

(86) PCT No.: PCT/JP01/00484

§ 371 (c)(1),
(2), (4) Date: Oct. 7, 2002

(87) PCT Pub. No.: WO01/56052

PCT Pub. Date: Aug. 2, 2001

(65) Prior Publication Data

US 2003/0146713 A1 Aug. 7, 2003

(30) Foreign Application Priority Data

| | | |
|---|---|---|
| Jan. 25, 2000 | (JP) | 2000-015302 |
| Aug. 24, 2000 | (JP) | 2000-253723 |
| Aug. 29, 2000 | (JP) | 2000-258661 |
| Aug. 30, 2000 | (JP) | 2000-260391 |

(51) Int. Cl.[7] ..... G09G 3/10
(52) U.S. Cl. ..... 315/169.4; 315/169.1
(58) Field of Search ..... 315/169.4, 584, 315/169.3, 169.1, 518, 587, 582; 313/491, 551, 549, 581, 583; 345/60, 57, 77

(56) References Cited

U.S. PATENT DOCUMENTS

| | | | | |
|---|---|---|---|---|
| 4,638,218 A | * | 1/1987 | Shinoda et al. | 315/169.4 |
| 6,184,848 B1 | * | 2/2001 | Weber | 345/60 |
| 6,548,962 B1 | * | 4/2003 | Shiokawa et al. | 315/169.4 |

FOREIGN PATENT DOCUMENTS

| | | |
|---|---|---|
| EP | 0 782 167 | 7/1997 |
| EP | 0 932 181 | 7/1999 |
| EP | 1 024 516 | 8/2000 |
| JP | 03-187125 | 8/1991 |
| JP | 08-315735 | 11/1996 |
| JP | 10092326 | 4/1998 |
| JP | 11297214 | 10/1999 |
| JP | 11-126561 | 11/1999 |
| JP | 2000021313 | 1/2000 |
| JP | 2000357463 | 12/2000 |

* cited by examiner

*Primary Examiner*—James Clinger
*Assistant Examiner*—Chuc Tran

(57) ABSTRACT

A gas discharge panel having (i) a plurality of cells arranged in a matrix between a pair of opposing substrates, the cells being filled with a discharge gas, and (ii) plural pairs of display electrodes arranged on a surface of one of the substrates so as to extend through the plurality of cells, each pair of display electrodes being composed of a sustain electrode and a scan electrode that define a main discharge gap therebetween. In such a gas discharge panel, each sustain electrode and scan electrode includes a plurality of line parts that extend in a row direction of the matrix. Furthermore, the main discharge gap and a line part gap between adjacent line parts are provided such that a discharge current waveform of the display electrodes has a single peak when the gas discharge panel is driven.

27 Claims, 46 Drawing Sheets

GAS DISCHARGE PANEL

TECHNICAL FIELD

The present invention relates to gas discharge panels such as plasma display panels and the like.

BACKGROUND ART

Plasma display panels (PDPs) are one of the various types of plasma display apparatuses. Given their relative suitability for thin, large-screen applications, PDPs are currently attracting attention as the possible displays of the future, and 60-inch class models are already available on the market.

FIG. 42 is a partial perspective view showing a main structure of a known surface-discharge AC-type PDP. In FIG. 42, a thickness of the PDP is in the z direction and the panel surface of the PDP lies parallel to the xy plane. The PDP includes a front panel 20 and a back panel 26 arranged so that the main surfaces of each panel face each other.

A front panel glass 21 forms a substrate of front panel 20. Plural pairs of display electrodes 22 and 23 (i.e. scan electrode 22 and sustain electrode 23) extending in the x direction are arranged on a main surface of front panel glass 21 so as to enable a surface discharge to be conducted between the electrodes 22 and 23 in each pair. The electrodes 22 and 23 can be formed, for example, from a mixture of Ag and glass.

Each scan electrode 22 is electrically independent with respect to its power supply. In contrast, each sustain electrode 23 is connected to the same power supply. A dielectric layer 24 and a protective layer 25, both of which are formed from an insulating material, are coated in the stated order over the surface of front panel glass 21 on which the pairs of display electrodes are arranged.

A back panel glass 27 forms a substrate of back panel 26. A plurality of address electrodes 28 extending in the y direction is arranged in a stripe-pattern on a main surface of back panel glass 27, and a predetermined space is provided between adjacent address electrodes. The address electrodes may be formed from a mixture of Ag and glass.

A dielectric layer 29 formed from an insulating material is coated over the surface of back panel glass 27 on which address electrodes 28 are arranged. Barrier ribs 30 are provided between adjacent address electrodes 28 on dielectric layer 29. Phosphor layers 31, 32, and 33 corresponding to the colors red (R), green (G) and blue (B) are formed between adjacent barrier ribs 30, the phosphor layers being formed on the barrier rib walls and over the dielectric layer 29 between adjacent barrier ribs.

Front panel 20 and back panel 26 as described above are arranged to face each other such that address electrodes 28 extend in an orthogonal direction to display electrodes 22 and 23.

Front panel 20 and back panel 26 are sealed together around their respective peripheries using a sealing material such as frit glass, and a vacuum is created within the space enclosed therebetween.

In should be noted that only one of each of electrodes 22, 23 and 28 has been shown in FIG. 42 for ease of description. The known PDP as described here actually includes a plurality of each of these electrodes.

A discharge gas (enclosed gas) that includes Xe is enclosed at a predetermined pressure (approx. 40 kPa to 66.5 kPa in conventional PDPS) within the sealed space between the front and back panels.

A discharge space 38 is thus formed in the space defined between dielectric layer 24 of front panel 20, phosphor layers 31–33 of back panel 26, and adjacent barrier ribs 30 interposed therebetween Furthermore, a plurality of cells (not depicted in FIG. 42) used in image display is provided in discharge space 38, each cell being formed in the region where a single address electrode 28 extends across a single pair of display electrodes 22 and 23. FIG. 43 shows the matrix of the PDP formed by the plural pairs of display electrodes 22, 23 (N line) and the plurality of address electrodes 28 (M columns).

When the PDP is driven, a discharge is initiated between address electrode 28 and either display electrode 22 or 23 in each of the cells. Ultraviolet light (Xe resonance line; wave length approx. 147 nm) having short wavelengths is generated as a result of a discharge that. then occurs between display electrodes 22 and 23 in each pair, the generated ultraviolet light striking phosphor layers 31 to 33 and exciting them to emit visible light. Image display is achieved as a result.

The following is a detailed description of a prior art method for driving the known PDP with reference to FIGS. 44 and 45.

FIG. 44 is a conceptual block diagram showing an image display apparatus (PDP display apparatus) using the known PDP. FIG. 45 shows exemplary drive waveforms applied to each of the electrodes in the PDP.

As shown in FIG. 44, in order to drive the PDP, the PDP display apparatus includes the following elements: a frame memory 10, an output processing circuit 11, an address electrode drive apparatus 12, a sustain electrode drive apparatus 13, and a scan electrode drive apparatus 14. Each of electrodes 22, 23 and 28 are connected to scan electrode drive apparatus 14, sustain electrode drive apparatus 13, and address electrode drive apparatus 12, respectively. Elements 12, 13 and 14 are connected to output processing circuit 11.

When the PDP is driven, image information inputted into the PDP display apparatus from an external source is initially stored in frame memory 10, and then based on timing information, the image information is transferred from frame memory 10 to output processing circuit 11. Then, based on the image information and the timing information, output processing circuit 11 becomes operational. Output processing circuit 11 outputs instructions to the elements 12, 13 and 14, and applies pulse voltages to each of electrodes 22, 23 and 28, thereby conducting the image display.

As shown in FIG. 45, when the PDP is driven, a setup pulse is applied to scan electrodes 22, initializing a wall charge within each of the cells. Next, a scan pulse and a write pulse are applied respectively to scan electrode 22 and sustain electrode 23 positioned at the top of the screen (i.e. in the y direction), thus initiating a write discharge. As a result of the write discharge, wall charge is stored on the surface of dielectric layer 24 in each of the cells corresponding to the electrodes 22 and 23 that have been applied with the pulses.

Continuing on, a scan pulse and a write pulse are then applied respectively to scan electrode 22 and sustain electrode 23 in the line second from the top of the screen, and wall charge is stored on dielectric layer 24 in each of the cells corresponding to the electrodes 22 and 23 in the stated line. One screen of latent image is thus written by repeating this process for all display electrodes 22 and 23 forming the display surface.

Next, a sustain discharge is conducted by grounding address electrodes 28 and applying sustain pulses alternately to scan electrodes 22 and sustain electrodes 23. A discharge is generated in the cells storing wall charge on dielectric layer 24 when the potential of the surface of layer 24 increases above the discharge initiating voltage in the respective cells. The sustain discharge is maintained in the cells applied with the write pulse for the duration that the sustain pulses are applied (i.e. sustain period). Erase pulses, each of short duration, are then applied so as to weaken the discharge and eliminate the wall charge, thereby serving to erase the latent image.

In television image display according to the NTSC standard, one image is composed of 60 fields per second. Primarily, a PDP is only capable of expressing the two states of "on" and "off." Thus, in order to display the intermediate color gradations, a method is adopted according to which the "on" periods of each of the colors red (R), green (G) and blue (B) are timeshared and one field is divided into a plurality of subfields. The intermediate color gradations can thus be expressed depending on the combination of "on" and "off" subfields.

The subfield division method used by the known AC PDP and shown in FIG. 46 expresses 256 color gradations. The ratio of sustain pulses applied during the sustain periods in each subfield is layered in a binary scale, an example of which is 1, 2, 4, 8, 16, 32, 64, 128. 256 color gradations can be expressed by varying the combination of these eight bits.

As described above in relation to the method for driving the prior art PDP, display is achieved by a consecutive sequence of setup, write, sustain, and erase periods.

However, in a day and age when any viable reduction in the energy consumption of electrical appliances is greatly valued, much emphasis has naturally been placed on reducing the power requirements of PDPs. In the last few years, an increasing emphasis has been placed on technology that realizes such power reductions, given that the general push toward larger screens and higher definition image display has resulted in recently developed PDPs exhibiting a tendency for increased power consumption. For these reasons, technology that reduces the power consumption of PDPs is most desirable.

However, simply reducing the power consumption of PDPs is not in itself enough, since this will only weaken the discharge occurring between the display electrodes, and cause an insufficient illumination. Therefore, any reductions in power consumption must be accompanied with the ability to achieve a satisfactory display capacity (i.e. a satisfactory luminous efficiency). Since insufficient illumination causes a drop in PDP display capacity, simply reducing the power usage of PDPS is not likely to realize any improvements in luminous efficiency.

Research aimed at improving luminous efficiency is currently being conducted, an example of which includes trying to improve the efficiency at which the phosphors convert ultraviolet light into visible light. However, significant improvements are yet to be realized and further research into this area is still required.

Thus, at this point in time, optimizing the luminous efficiency in gas discharge panels such as PDPs is considered to involved a great many difficulties.

DISCLOSURE OF INVENTION

In view of the issues discussed above, an objective of the present invention is to provide a gas discharge panel having a high luminous efficiency and an excellent display capacity.

In order to resolve the above issues, the gas discharge panel of the present invention includes (i) a plurality of cells arranged in a matrix between a pair of opposing substrates, the cells being filled with a discharge gas, and (ii) plural pairs of display electrodes arranged on a surface of one of the substrates so as to extend through the plurality of cells, each pair of display electrodes being composed of a sustain electrode and a scan electrode that define a main discharge gap therebetween. Furthermore, each sustain electrode and scan electrode includes a plurality of line parts that extend in a row direction of the matrix. By adjusting the main discharge gap and a line part gap between adjacent line parts, it is possible to generate a discharge current waveform of the display electrodes that has a single peak when the gas discharge panel is driven.

Specifically, it is preferable for at least one of the scan electrode and the sustain electrode within each cell to be composed of three or more line parts. It is furthermore preferable for a pitch of the line part gaps in each cell to decrease as the distance separating the respective line part gap from the main discharge gap increases.

Discharge current wavelengths having single peaks can be achieved according to this structure, thereby enabling the discharge illumination generated by a single drive pulse to be completed within 1 $\mu$s. Also, the fact that the period from when the drive pulse is applied when the discharge current reaches a maximum value (i.e. the discharge delay period) is only short at approximately 0.2 $\mu$s, allows the gas discharge panel to be driven at the high speed of a few $\mu$s.

Furthermore, the fact that display electrodes 22 and 23 are arranged in lines allows for a reduction in the amount of static electricity arising from the discharge in comparison to when the display electrodes are arranged in bands as per the prior art. Generally, when pairs of display electrodes are arranged in lines, the tendency is for the discharge to disperse, the discharge current waveform to develop multiply peaks, and the discharge initiating voltage to increase, thereby invariably resulting in increased power consumption. However, because the discharge current waveform of the present invention as described above forms a single peak, it is possible to drive the gas discharge panel at a relatively low voltage, thereby suppressing power consumption below existing levels and achieving a favorable luminous efficiency (drive efficiency).

Consequently, the gas discharge panel of the present invention is able to achieve excellent luminous efficiency and high-speed driving by securing a discharge voltage waveform having a single peak while at the same time reducing power consumption through the provision of display electrodes 22 and 23 having a reduced surface area (i.e. line parts 22*a*–22*c*, 23*a*–23*c* in FIG. 1) in comparison to known display electrodes.

Furthermore, in the present invention, a discharge voltage waveform having an excellent single peak may be achieved by reducing the, pitch of the line part gaps either geometrically or arithmetically.

Also, in regard to the actual construction of the present invention, it is preferable to establish the cell length in the column direction of the matrix to be in a range of 480 $\mu$m to 1400 $\mu$m, and to satisfy the expression $G-60\ \mu m \leqq S \leqq G+20\ \mu m$ with respect to each cell, where S is the width of an average line part gap in a respective cell, and G is the width of the main discharge gap.

Furthermore, the line parts positioned furthest from the main discharge gap in each cell may be wider than (i) the other line parts in the cell or (ii) an average width of all the line parts in the cell.

In addition, the line parts within each cell may increase in width as the distance separating the respective line part from the main discharge gap increases.

Here, it is preferable to establish the width of the lineparts to satisfy the expression $L_{ave} \leqq L_n \leqq \{0.35P-(L_1+L_2+\ldots L_{n-1})\}$ with respect to one of the sustain electrode and scan electrode in each cell, where P is the cell length in the column direction of the matrix, $L_n$ is the width of the line parts positioned furthest from the main discharge gap, $L_{ava}$ is the average width of all of the line parts in the cell, and the sustain electrode or scan electrode includes n line parts.

Also, it is preferable for the resistance value R of the line parts positioned furthest from the main discharge gap within each the cell to be in a range of $0.1\ \Omega \leqq R \leqq 80\ \Omega$.

BEST MODE FOR CARRYING OUT THE INVENTION

Since the characteristics of the PDP of the present invention relate mainly to the structure of the display electrodes, the following description will focus on the display electrodes The general structure of the PDP of the present invention is otherwise substantially the same as that of the prior art PDP.

Embodiment 1

1-1 Structure of the Display Electrodes

Figure 1:
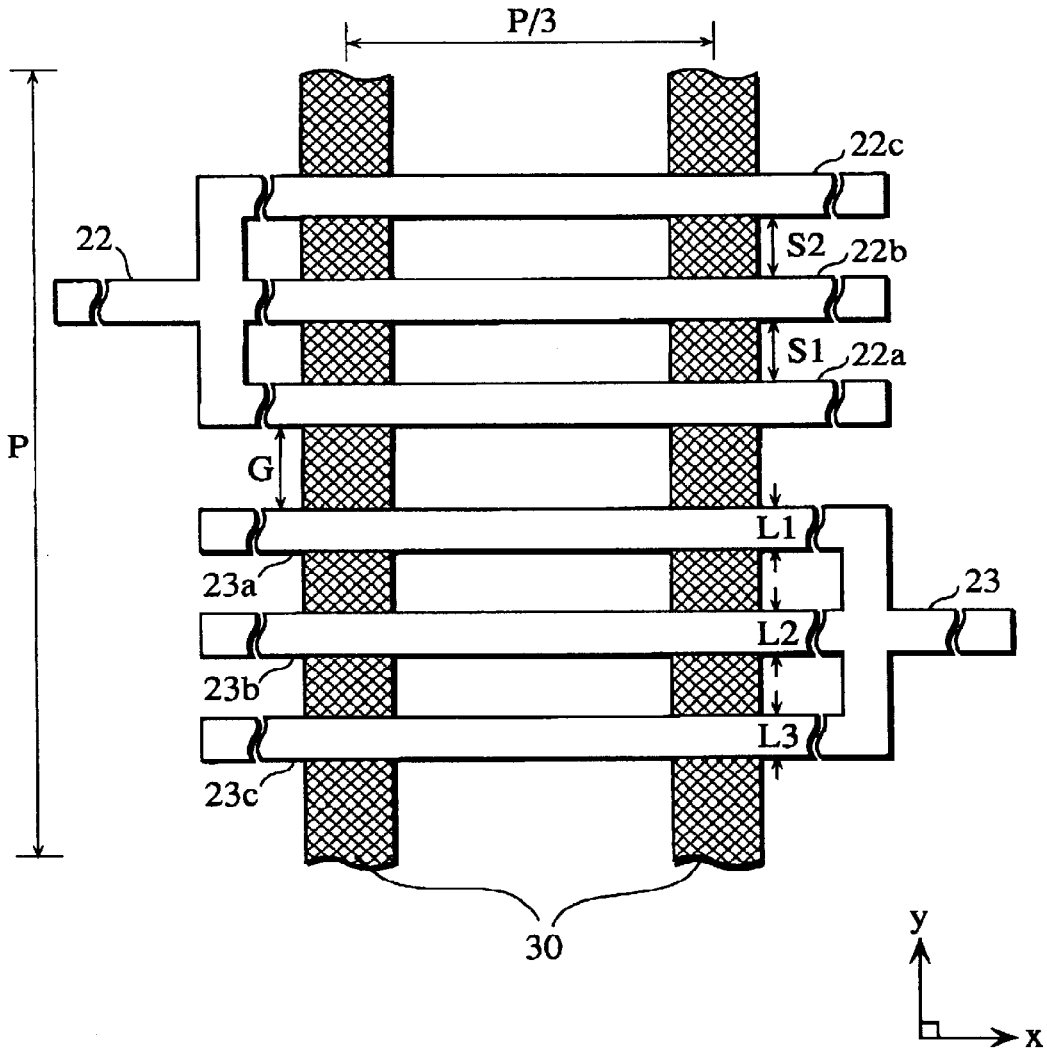
FIG. 1 is a view from above of display electrodes in a PDP of the present invention according to an embodiment 1.

FIG. 1 is a schematic view from above the structure of the display electrodes according to embodiment 1.

As shown in FIG. 1, embodiment 1 is characterized in that display electrodes 22 and 23 (scan electrode 22, sustain electrode 23) forming a pair in a cell defined between adjacent barrier ribs 30 are each divided into three line parts 22*a* to 22*c* and 23*a* to 23*c*, respectively. In the given example, a cell pitch (i.e. a cell length in the y direction) P is 1.08 mm, a main discharge gap G is 80 μm, a line part width $L_1$ to $L_3$ is 40 μm, a first line part gap $S_1$ is 80 μm, and a second line part gap $S_2$ is 80 μm. Display electrodes 22 and 23 are composed of a metallic substance such as Ag or Cr/Cu/Cr.

One pixel is composed of three cells corresponding to the colors red (R), green (G) and blue (B), and a cell width in the x direction with respect to the cell pitch P is P/3.

In the given example the electrodes have been arranged so that the discharge current waveform forms a single peak when the PDP is driven, thus allowing for excellent luminous efficiency to be achieved.

1-2 Effects of Embodiment 1

Generally, when the display electrodes are configured as a plurality of lines, the discharge current waveform tends to have multiply peaks during the discharge period. A discharge arising from a discharge current waveform having multiple peaks is readily affected by discharges generated from prior discharge current waveforms (i.e. a priming effect caused by residual ions and metastable particles, etc). Specifically, the time taken to generate a discharge may vary as a result of prior discharges, and the illumination brightness and luminous efficiency may vary as a result of voltage drops, and the like. Consequently, gradation controls easily become unstable when the discharge current waveforms have multiply peaks. When the objective is to achieve quality full-color moving image display in television receivers, and the like, this is a serious problem.

In contrast, by achieving a discharge current waveform having a single peak, embodiment 1 allows for a stable sustain discharge to be conducted, and thus stable gradation controls can be implemented by means of pulse modulation.

Figure 2:
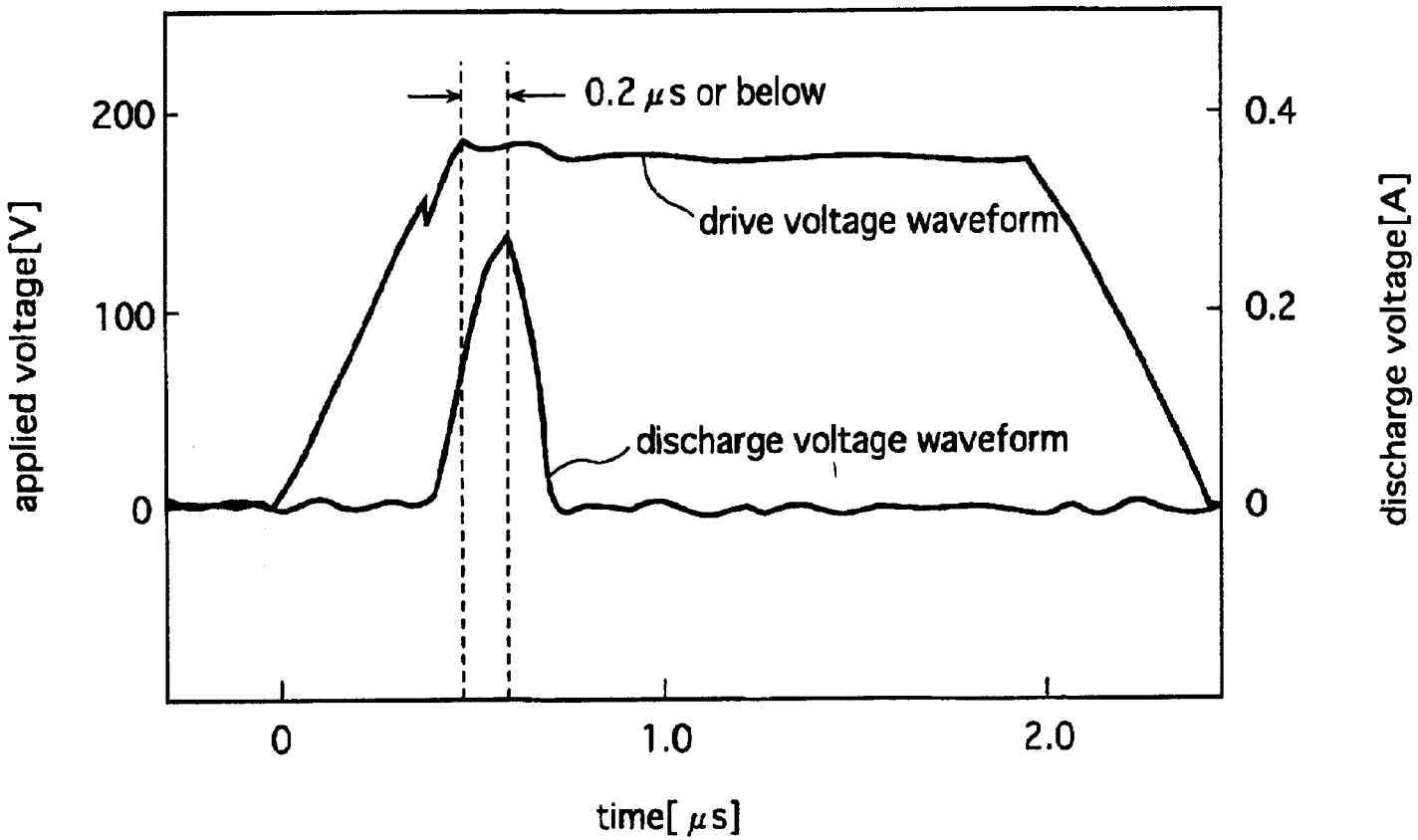
FIG. 2 is a waveform diagram showing a change over time of a drive voltage waveform and a discharge current waveform according to embodiment 1.

FIG. 2 shows the variation over time of the discharge current waveform and the drive voltage waveform of the PDP according to embodiment 1. As shown in FIG. 2, because the discharge current waveform has a single peak, a discharge illumination generated by a single drive pulse can be completed within 1 μs. In addition, because the time taken for the drive pulse to reach a maximum value after being applied (i.e. the discharge delay period) is short at approximately 0.2 μs, high-speed driving in the range of a few microseconds is possible. According to embodiment 1, achieving a single-peaked discharge current waveform makes it possible to also achieve a singe peak with respect to the discharge illumination waveform. As shown in FIG. 2, it is particularly desirable for a half-width Thw of the single-peaked discharge illumination waveform to be in a range $50\text{ns} \leqq \text{Thw} \leqq 700\ \mu\text{s}$.

Figure 3:
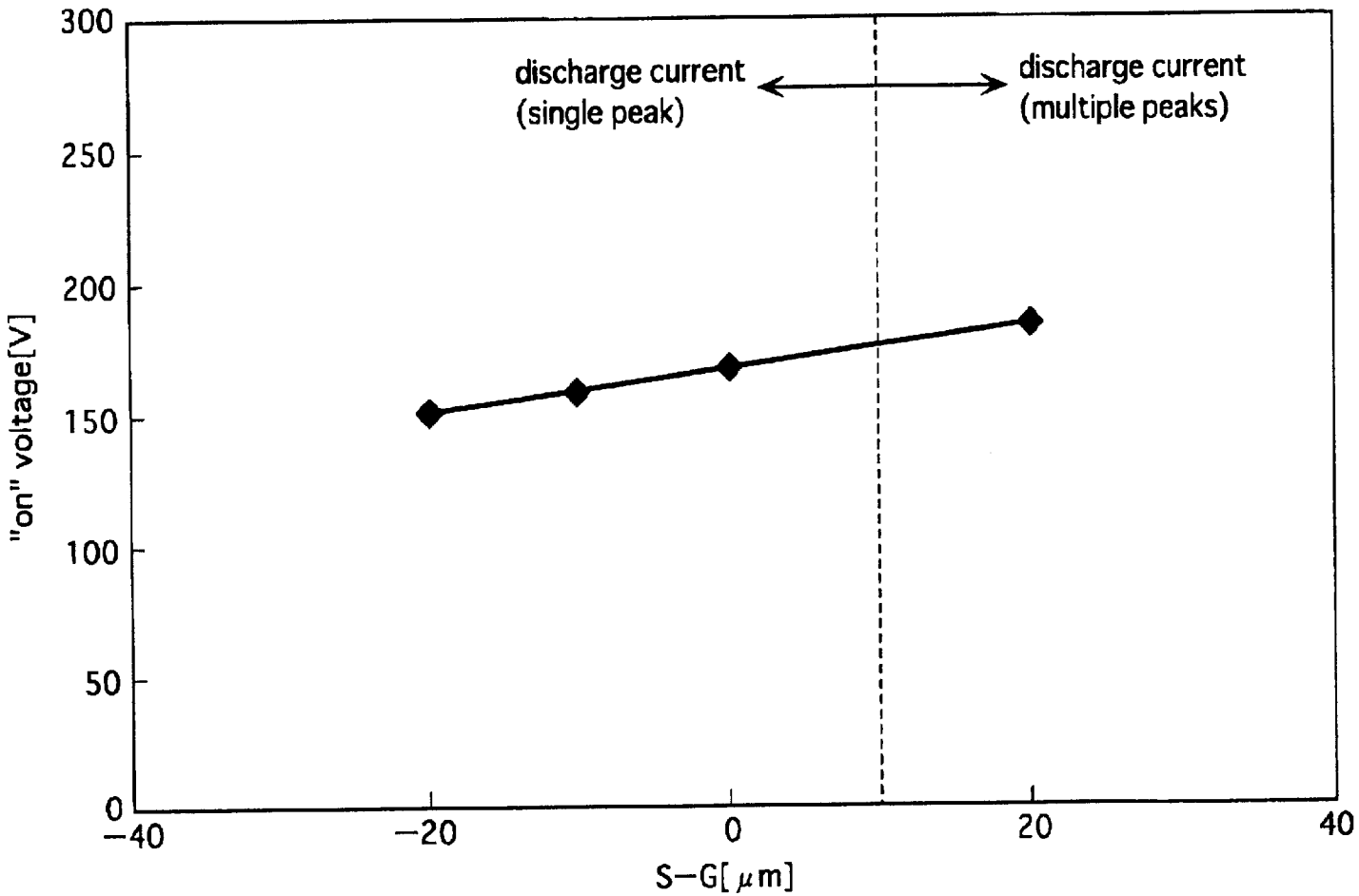
FIG. 3 is a graph showing a relationship between an "on" voltage (drive voltage), a differential S–G, and a discharge current peak number, where G is a main discharge gap, and S (=a first line part gap $S_1$=a second line part gap $S_2$) is a line part gap.

FIG. 3 shows the relationship between a discharge current peak number, an "on" voltage, and a differential S–G when the PDP is driven using prior art drive waveforms (see FIG. 47), where s is the line part gap ($S_1$=$S_2$) and G is the main discharge gap. As shown in FIG. 3, if the line part gaps $S_1$ and $S_2$ ("S" in FIG. 3) are smaller than main discharge gap G (i.e. when S–G is negative), a discharge current waveform having a single peak can be achieved, and high-speed driving of the PDP can be achieved as a result.

Furthermore, because display electrodes 22 and 23 are configured as lines in embodiment 1, it is possible to reduce the amount of static electricity arising from the discharge in comparison to known structures in which the discharge electrodes are arranged as bands. Consequently, it is possible to reduce power consumption and achieve excellent luminous efficiency (drive efficiency).

Thus, by achieving discharge current waveforms having a single peak while at the same time reducing power consumption by providing display electrodes 22 and 23 (line parts 22*a* to 22*c*, 23*a* to 23*c*) having a smaller surface area than known display electrodes, embodiment 1 realizes a PDP having excellent luminous efficiency and capable of high-speed driving.

Here, a discharge current waveform having a "single peak" is defined to include a waveform having more than one peak but where the other peaks are at 10% smaller than the highest peak.

According to embodiment 1, effects identical to those described above can also be achieved by establishing cell pitch P to be $0.5\text{mm} \leqq P \leqq 1.4$ mm, main discharge gap G to be $60\ \mu\text{m} \leqq G \leqq 140\ \mu\text{m}$, line part widths $L_1$ to $L_3$ to be $10\ \mu\text{m} \leqq L_1, L_2, L_3 \leqq 60\ \mu\text{m}$, and first and second line part gaps $S_1$ and $S_2$ to be $50\ \mu\text{m} \leqq S_1, S_2 \leqq 140\ \mu\text{m}$.

It is preferable for the cell length (cell pitch P) to be in a range of 480 μm to 1400 μm.

It is furthermore preferable to satisfy the expression $G-60\ \mu\text{m} \leqq S \leqq G+20\ \mu\text{m}$ with respect to each cell, where S is an average line part gap of all the line parts in the cell, and G is the main discharge gap.

Here, it is possible for the pitch between adjacent barrier ribs to be other than P/3. For example, the brightness balance of each of the colors RGB can be improved by establishing a different barrier rib pitch for each cell, such that the barrier rib pitch ratio with respect to the red (R), green (G), and blue (B) cells is P/3:P/3.75:P/2.5, respectively.

1-3 Manufacture of the PDP

An exemplary manufacturing method for the PDP of embodiment 1 will now be described. The manufacturing method described here is substantially the same as the manufacturing methods employed in other embodiments of the present invention.

1-3-1 Manufacture of the Front Panel

The front panel glass forming the substrate of the front panel is composed of soda lime glass approximately 2.6 mm thick, and display electrodes are provided on a surface thereof. In the given example, thick film processes are used to form the display electrodes, which are metallic electrodes composed of Ag.

To form the display electrodes, a metallic (Ag) power and a photosensitive resin (i.e. a photodegradable resin) are mixed together in an organic vehicle to make a photosensitive paste. A layer of paste is applied to one surface of the front panel glass and the paste layer is covered with a mask that marks out the pattern of the display electrodes. The paste layer covered by the mask is then exposed, developed, and baked (baking temp of approx. 590% to 600° C.). In comparison to known screen printing methods which only allow for a minimum 100 μm line width, this method of forming the display electrodes makes it possible to form thin lines of approximately 30 μm. Apart from Ag, the metallic electrodes may be formed from materials such as Pt, Au, Al, Ni, Cr, tin oxide, and indium oxide.

It is furthermore possible to use methods other than the one described above to form the electrodes. For example, the electrodes may be formed by etching a film of electrode material applied using evaporation, sputtering, or similar techniques.

Next, a protective layer having a thickness of 0.3 μm to 0.6 μm is formed over the dielectric layer using methods such as evaporation and chemical evaporation (CVD) Magnesium oxide (Mgo) is a suitable material from which to form the protective layer.

Thus completes the manufacture of the front panel.

1-3-2 Manufacture of the Back Panel

The back panel glass forming the substrate of the back panel is composed of soda lime glass approximately 2.6 mm thick. Address electrodes having a thickness of approximately 5 μm are formed by screen-printing a dielectric material composed primarily of Ag in a regularly spaced stripe-pattern on a surface of the back panel glass. In a 40-inch class NTSC or VGA format PDP, for example, the space between adjacent address electrodes is set to be no more than approximately 0.4 mm.

A dielectric film having a thickness of approximately 20 μm to 30 μm is formed by coating a lead-based glass paste over the surface of the back panel glass of which the address electrodes have been formed, and baking the applied paste.

Barrier ribs having a height of approximately 60 μm to 100 μm are formed by applying a lead-based glass material (i.e. same as used in the paste for the dielectric film) in the space between adjacent address electrodes. The barrier ribs may be formed, for example, by repeatedly screen-printing a paste that includes the glass material, and then baking the screen-printed paste.

After the barrier ribs have been formed, phosphor layers are formed by applying a phosphor ink that includes the colors red (R), green (G), and blue (B) to the barrier rib walls and to the uncovered surface of the dielectric layer lying between adjacent barrier ribs. Here, one color is applied within each space. The applied phosphor ink is then dried and baked.

The following is an example of the phosphor materials commonly used in PDPs.

Red Phosphors: $(Y_xG\ d_{1-x})\ BO:Eu^{3+}$

Green Phosphors: $Zn_2SiO_4$: $Mn^{3+}$

Blue Phosphors: $BaMgAl_{10}O_{17}:Eu^{3+}$ (or $BaMgAl_{14}O_{23}:Eu^{3+}$)

The phosphor material may be, for example, a power having an average particle diameter of approximately 3 μm. Although there are various methods for applying the phosphor ink formed from the phosphor material, a conventional meniscus method is used in the given example. This method involves the phosphor ink being sprayed from a fine nozzle so as to form a meniscus (i.e. a bridge caused by surface tension). This method allows the phosphor ink to be applied evenly to the target area. Other methods that may be used to apply the phosphor layers include the screen-printing method.

Thus completes the manufacture of the back panel.

Although the front panel glass and back panel glass were described above as being composed of soda lime glass, this was merely by way of example, and other materials may be used.

1-3-3 Completion of the PDP

The front and back panels are affixed together using a glass sealant. The discharge space sealed between the front and back panels is then evacuated to form a high vacuum (approx. $1.1\times10^{-10}$ Pa), and a discharge gas is enclosed within the discharge space at a predetermined pressure ($2.7\times10^5$ Pa in the given example). The discharge gas may, for example, be a gas mixture composed primarily of Ne and Xe, or He, Ne, and Xe, or He, Ne, Xe, and Ar.

Embodiment 2

Figure 4:
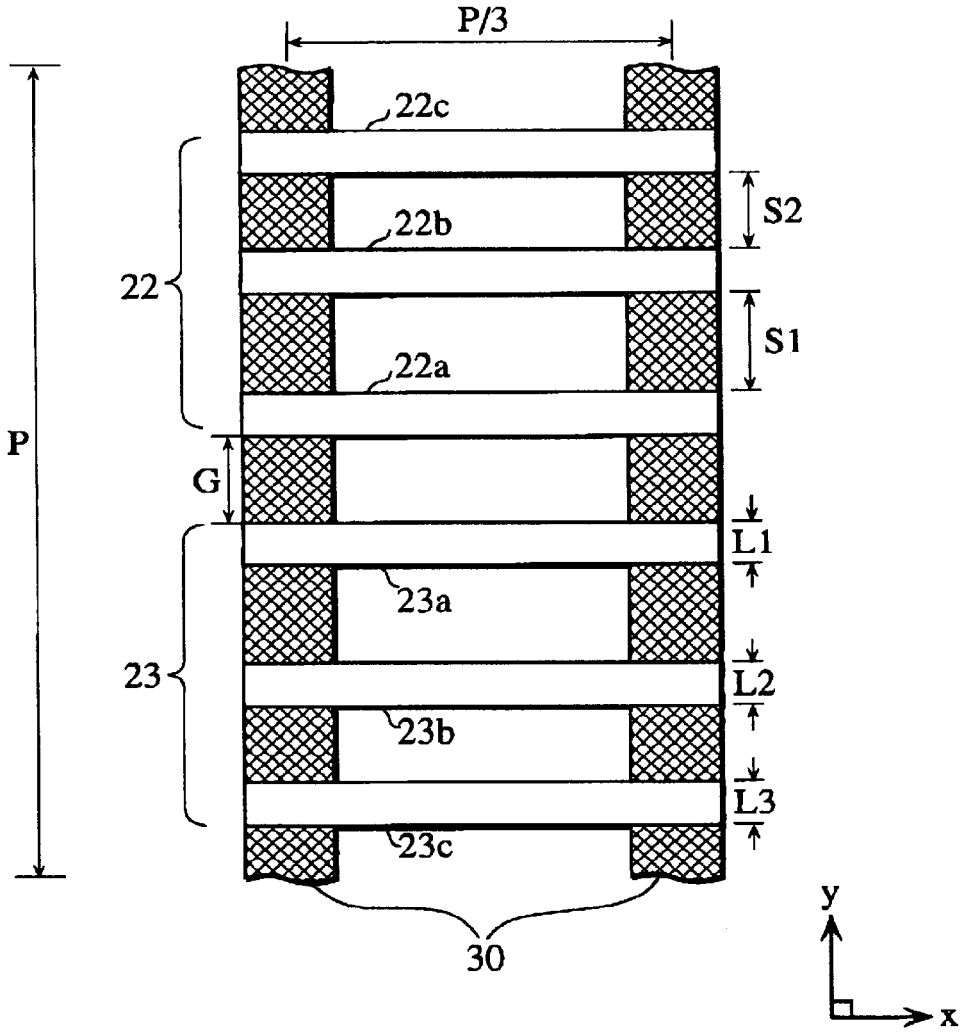
FIG. 4 shows a view from above of the display electrodes according to an embodiment 2.

FIG. 4 is a view from above of the display electrodes according to embodiment. 2. In this embodiment, display electrodes 22 and 23 include line parts 22*a* to 22*c* and 23*a* to 23*c*, respectively. Embodiment 2 is characterized in that the first and second line part gaps $S_1$ and $S_2$ in each cell decrease in width as the distance from main discharge gap G increases. In the given example, cell pitch P is 1.08 mm, main discharge gap G is 80 μm, line part widths $L_1$ to $L_3$ are 40 μm, first line part gap $S_1$ is 90 μm, and second line part gap $S_2$ is 70 μm.

In addition to substantially the same effects as embodiment 1, the structure according to embodiment 2 achieves the following.

Figure 5:
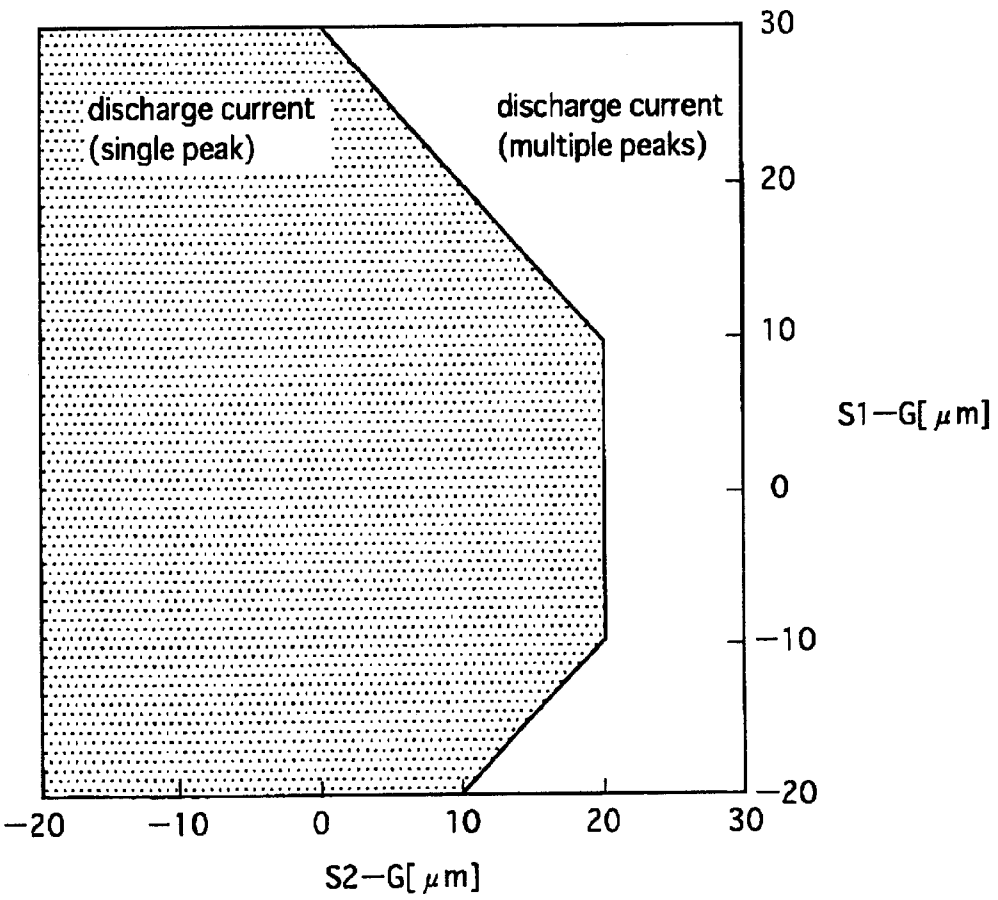
FIG. 5 is a graph showing a relationship between main discharge gap G, the first line part gap $S_1$, the second line part gap $S_2$, and the discharge current peak number in the PDP according to embodiment 2.

FIG. 5 is a graph showing the relationship between main discharge gap G, first line part gap $S_1$, second line part gap $S_2$, and the discharge current peak number according to embodiment 2. As shown in FIG. 5, when line part gaps $S_1$ and $S_2$ are approximately 10 μm wider than main discharge gap G, and when gap $S_2$ is smaller than gap $S_1$, a single discharge peak can be achieved. Controlling the gradation by means of pulse modulation can therefore be conducted in a stable environment, and high-speed driving can be achieved. Expansion of the discharge to first line part gap $S_1$ occurs relatively smoothly due to gap $S_1$ being positioned near to main discharge gap G, which is where the discharge was initially generated.

Although the various measurement within each of the discharge cells according to embodiment 2 are as given above, the present invention is not limited to these measurements. For example, the same effects can be achieved when $0.5\ mm \leqq P \leqq 1.4\ mm$, $60\ \mu m \leqq G \leqq 140\ \mu m$, $10\ \mu m \leqq L_1, L_2, L_3 \leqq 60\ \mu m$, $50\ \mu m \leqq S_1 \leqq 150\ \mu m$, and $40\ \mu m \leqq S_2 \leqq 140\ \mu m$.

Embodiment 3

Figure 6:
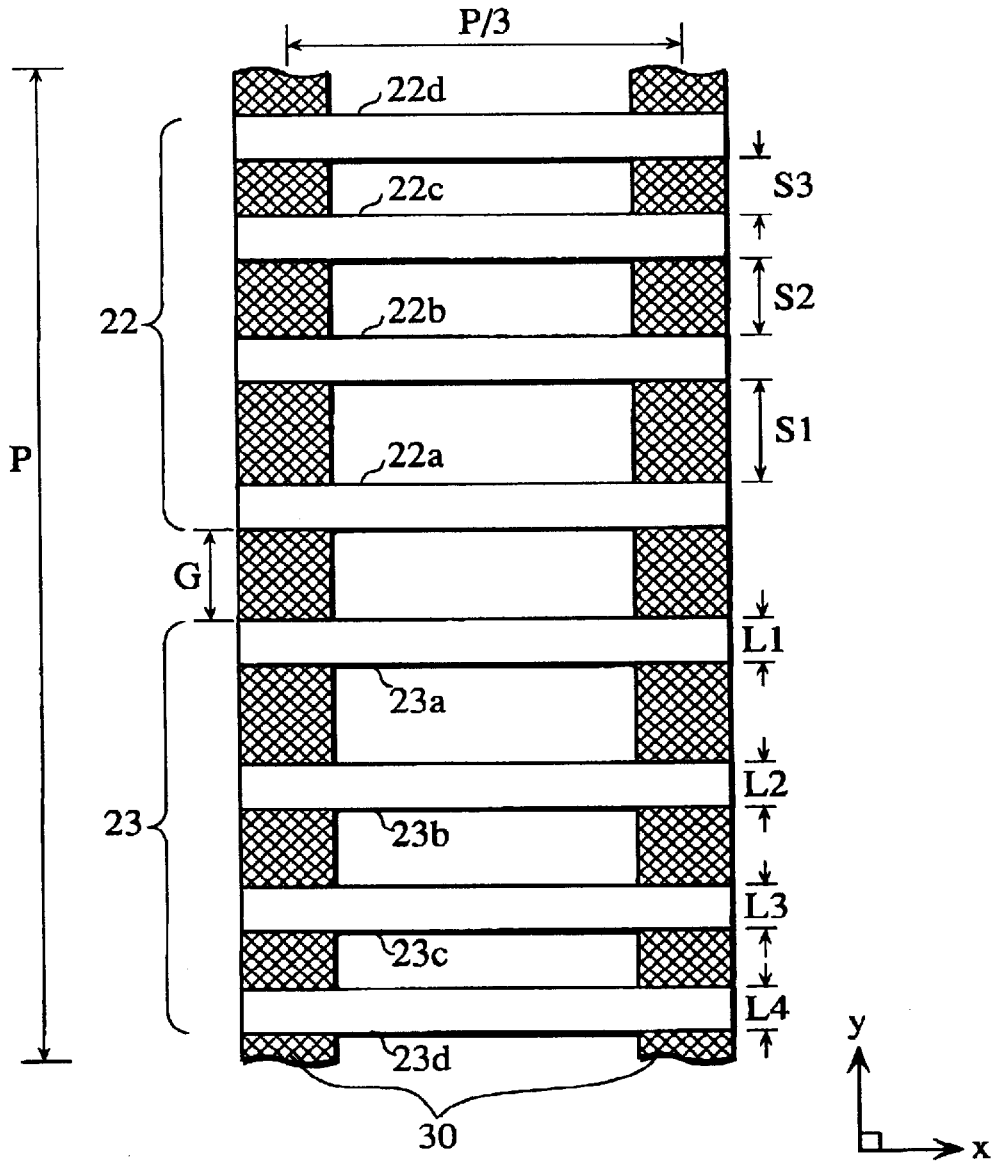
FIG. 6 shows a view from above of the display electrodes according to an embodiment 3.

FIG. 6 is a view from above of the display electrodes according to embodiment 3. In contrast to embodiment 2, in which the width of the line part gaps $S_1$ and $S_2$ is geometrically reduced, embodiment 3 is characterized in that display electrodes 22 and 23 each include four line parts 22*a* to 22*d* and 23*a* to 23*d*, respectively, and the line part gaps $S_1$ to $S_3$ decrease arithmetically as the distance from main discharge gap G increases. In the given example, cell pitch P is 1.08 mm, main discharge gap G is 80 μm, line part widths $L_1$ to $L_3$ are 40 μm, first line part gap $S_1$ is 90 μm, second line part gap $S_2$ is 70 μm, and third line part gap $S_3$ is 50 μm.

In addition to substantially the same effects as embodiment 1, the structure according to embodiment 3 achieves the following.

Figure 7:
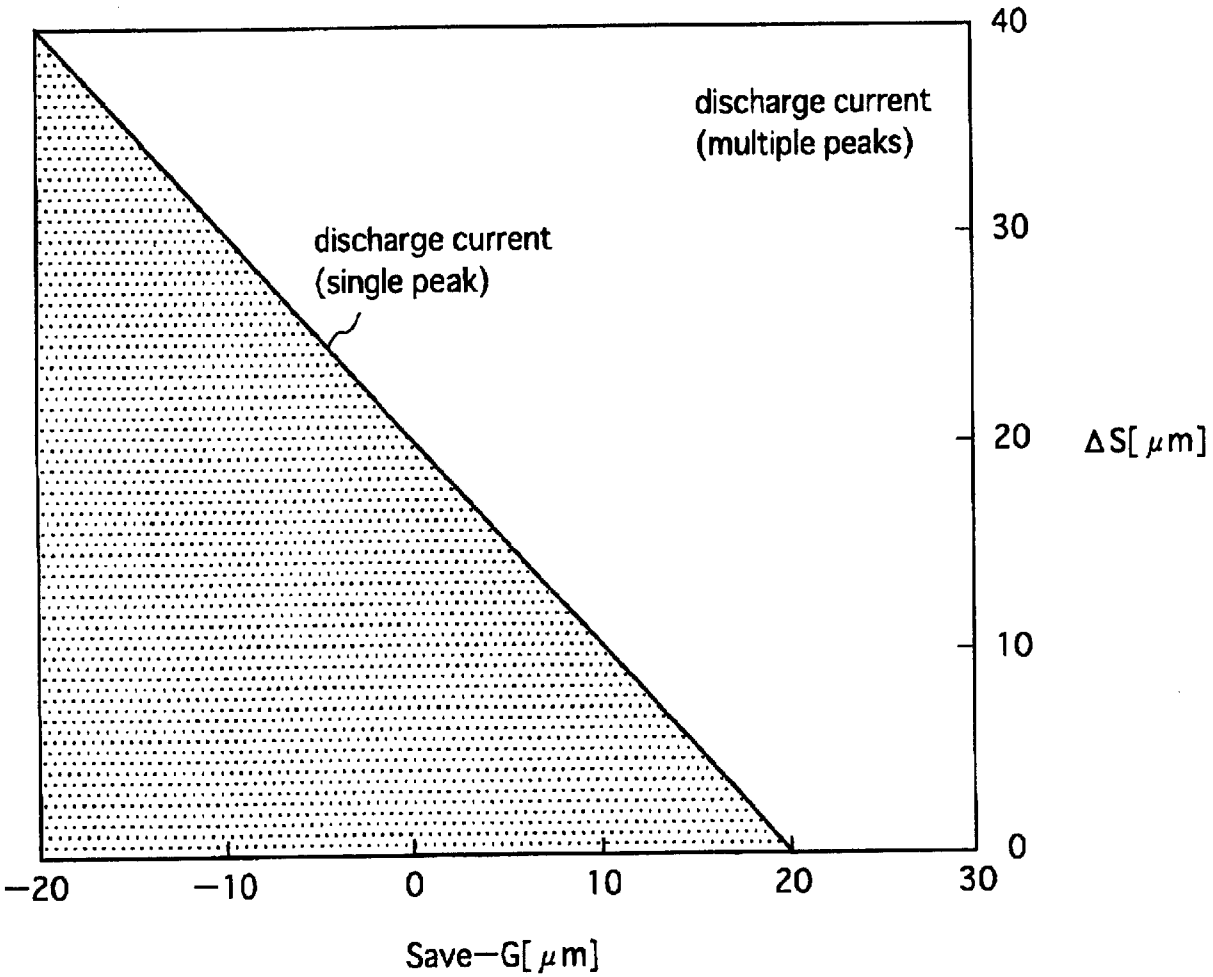
FIG. 7 is a graph showing a relationship between main discharge gap G, an average line part gap $S_{ave}$, a line part gap differential $\Delta S$, and the number of peaks of the discharge current waveforms in the PDP according to embodiment 3.

FIG. 7 is a graph showing the relationship between main discharge gap G, an average line part gap $S_{ave}$, a line part gap differential Δs, and the discharge current peak number according to embodiment 3. As shown in FIG. 7, it is possible to achieve a discharge current waveform having a single peak when the average line part gap $S_{ave}$ is smaller than main discharge gap G and the differential between each of the line part gaps is at least 10 μm despite of first line part gap $S_1$ being approximately 10 μm wider than main discharge gap G.

Figure 8A:
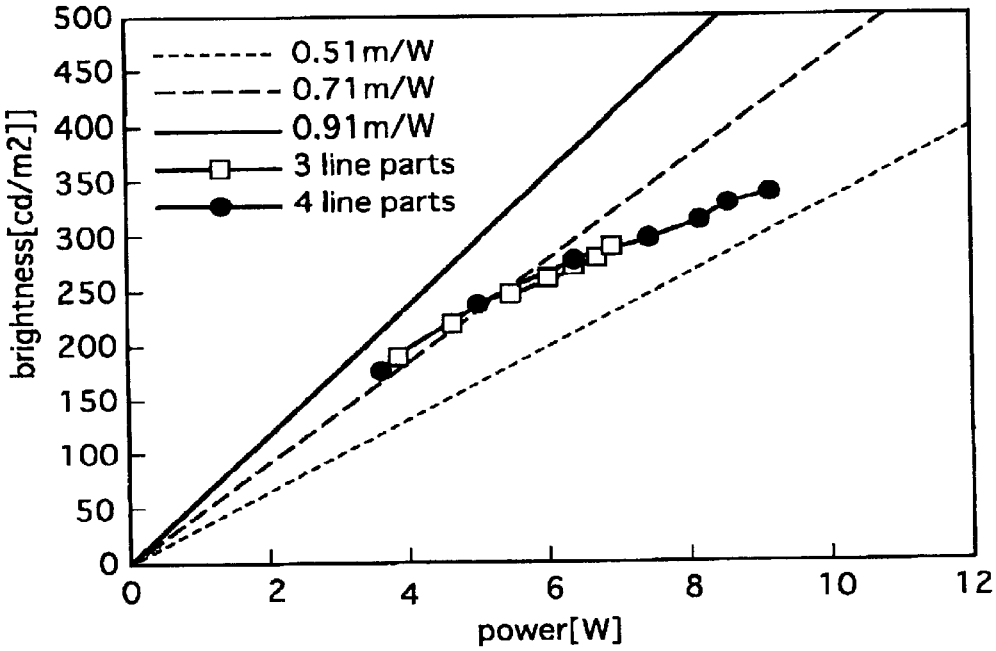
FIG. 8 compares a capacity of the PDP of embodiments 2 and 3.
Figure 8B:
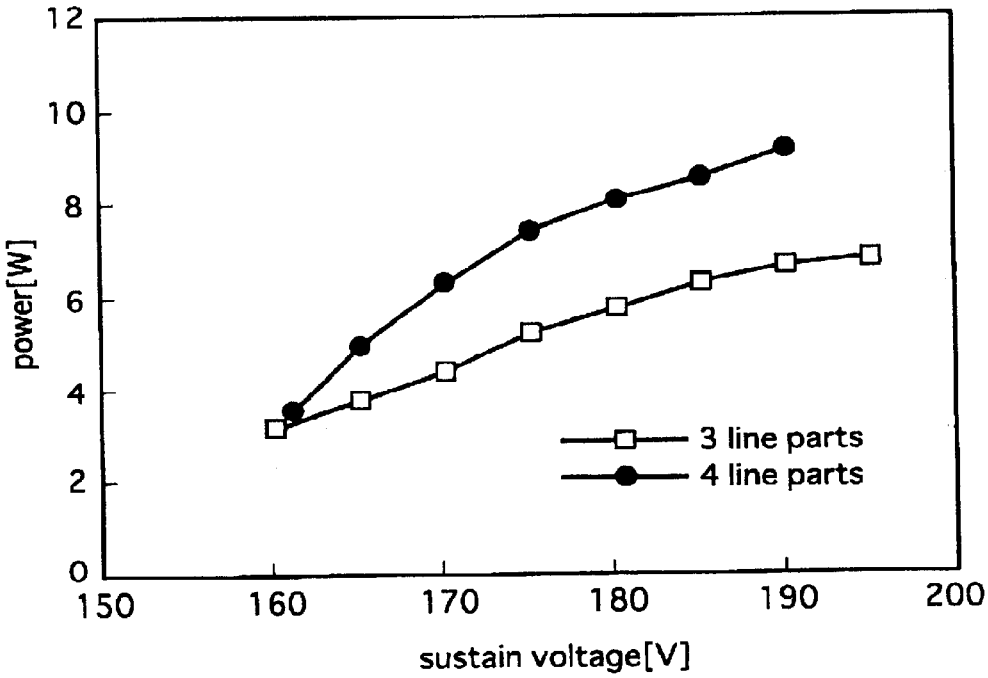

In order to compare embodiment 2 (3 line parts) and embodiment 3 (4 line parts), FIG. 8*a* charts power consumption and brightness, and FIG. 8*b* charts sustain voltage and power consumption. The display "on" region in each of the graphs includes an area of approximately 4000 pixels, and the slanted lines in the FIG. 8*a* graph represent the respective efficiencies. As shown in FIG. 8*a*, the power-brightness curve of embodiment 3 (4 line parts) overlaps substantially with the power-brightness curve of embodiment 2 (3 line parts). However, the capacity of the PDP according to embodiment 3 is greater than that of embodiment 2, as shown by the fact that the embodiment 3 curve extends beyond the embodiment 2 curve.

Furthermore, as shown in FIG. 8*b*, under conditions of uniform applied voltage, the four-line structure exhibits a more robust power consumption than the three-line structure.

Thus substantially the same brightness levels can be achieved in the PDPs according to both the second and third embodiment under identical power supply conditions. In addition, in embodiment 3, a comparatively lower drive voltage can be achieved, and power loss as well as wear and tear on the circuitry can be reduced with respect to the gas display panel and related panel drive apparatus.

Although the various measurements with respect to each of the discharge cells according to embodiment 3 are as given above, the present invention is not limited to these measurements. For example, the same effects can be achieved when 0.5 mm$\leqq$P$\leqq$1.4 mm, 70 $\mu$m$\leqq$G$\leqq$120 $\mu$m, 10 $\mu$m$\leqq L_1$, $L_2$, $L_3$, $L_4 \leqq$60 $\mu$m, 80 $\mu$m$\leqq S_1 \leqq$130 $\mu$m, 70 $\mu$m$\leqq S_2 \leqq$120 $\mu$m, and 60 $\mu$m$\leqq S_3 \leqq$110 $\mu$m.

Embodiment 4

Figure 9:
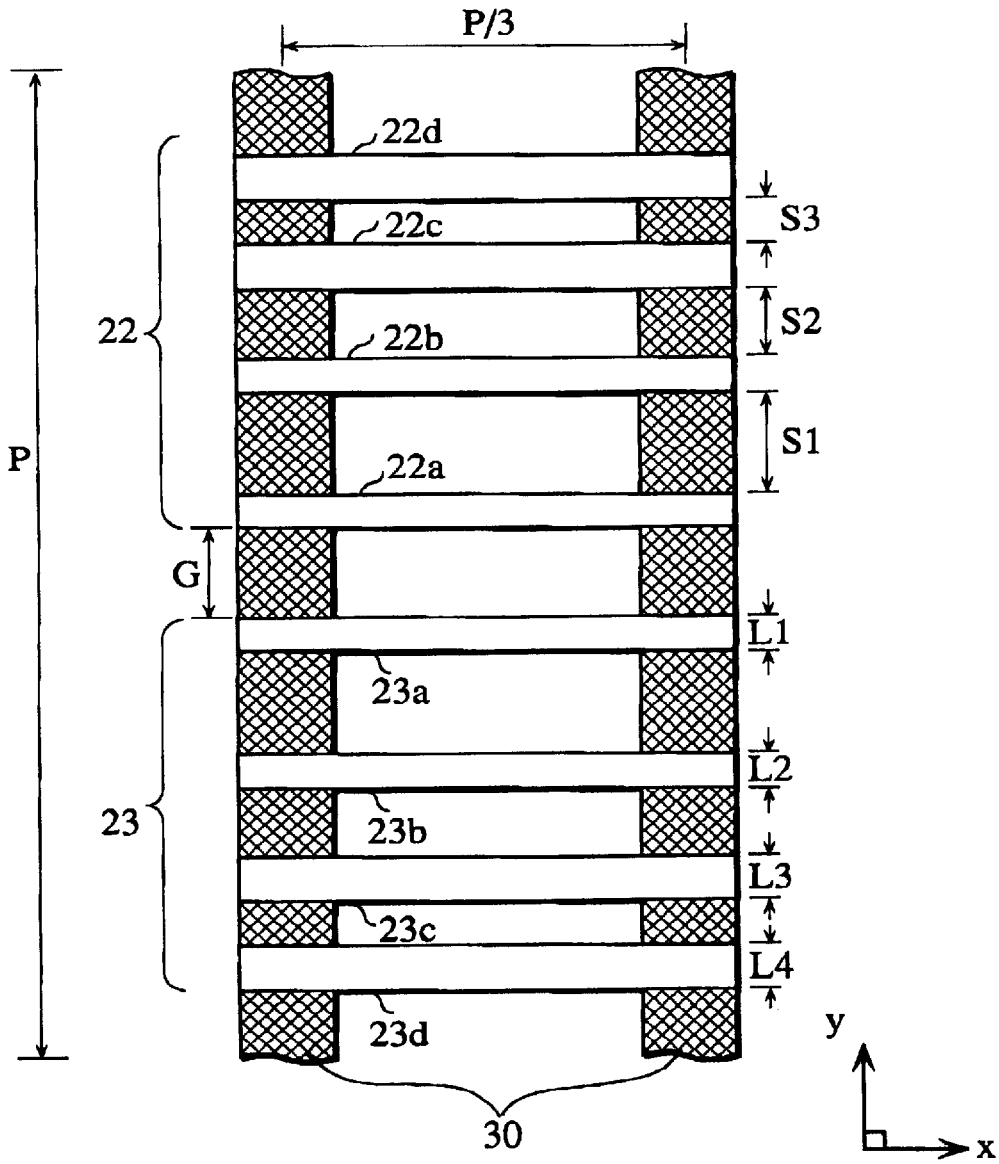
FIG. 9 shows a view from above of the display electrodes according to an embodiment 4.

FIG. 9 is a view from above of the display electrodes according to embodiment 4. In this embodiment, display electrodes 22 and 23 each include four line parts 22*a* to 22*d* and 23*a* to 23*d*, respectively. Also, line parts 22*c*, 22*b*, 23*c*, and 23*b* are wider than line parts 22*a*, 22*b*, 23*a*, and 23*b*, and line part gaps $S_1$ to $S_3$ decrease geometrically as the distance from main discharge gap G increases. In the given example, cell pitch P is 1.08 mm, main discharge gap C is 80 $\mu$m, line part widths $L_1$ and $L_2$ are 30 $\mu$m, line part widths $L_3$ and $L_4$ are 40 $\mu$m, first line part gap $S_1$ is 90 $\mu$m, second line part gap $S_2$ is 60 $\mu$m, and third line part gap $S_3$ is 40 $\mu$m.

In addition to substantially the same effects as embodiment 1, the structure according to embodiment 4 achieves the following.

Figure 10:
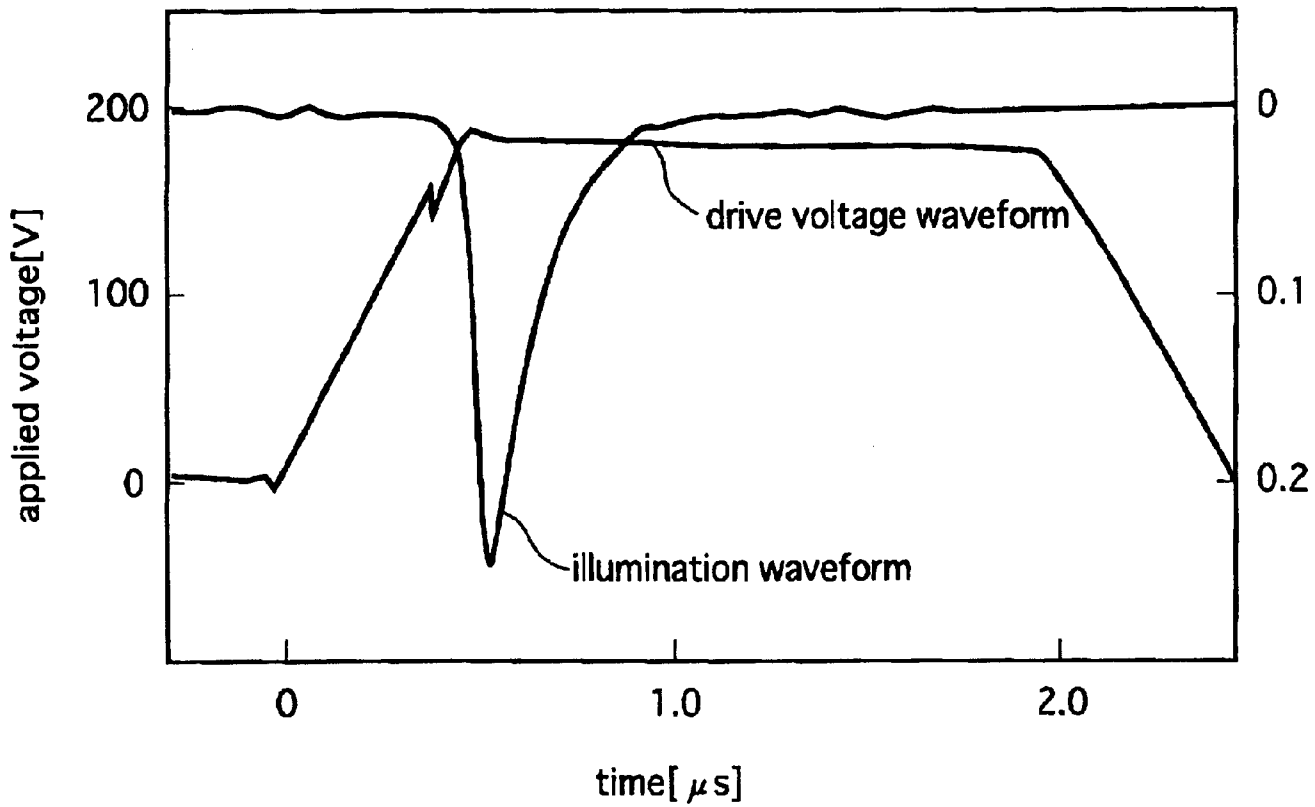
FIG. 10 is a graph showing an exemplary discharge illumination waveform in the PDP according to embodiment 4.

FIG. 10 is a graph showing an exemplary discharge illumination waveform according to embodiment 4. The data in FIG. 10 was gathered by illuminating a single cell of the PDP, attaching an optical fiber avalanche photodiode in order to funnel the light generating from the illuminated cell, and using a digital oscilloscope to measure the illumination waveform at the same time that the drive voltage waveform was measured. The illumination waveform in FIG. 10 shows an average of a thousand test results accumulated using the digital oscilloscope.

As shown in FIG. 10, the discharge illumination generated by the drive pulse is completed within a short period (approx. 400 ns) and a steeply sloping peak having a half-width of approximately 200 ns is achieved as a result of the discharge illumination waveform in the PDP of embodiment 4 having a single peak. It is also possible to achieve high-speed driving of approximately 1.25 $\mu$s as a result of the discharge delay period (i.e the time taken by the illumination waveform to reach a maximum value after the drive pulse has been applied) being short at 100 ns to 200 ns. These effects can be attributed to (i) a strengthening of the electric field in the vicinity of line parts 22*d* and 23*d* due to the geometrical reduction of line part gaps $S_1$ to $S_3$, thereby facilitating a rapid completion of the discharge, and (ii) the reductions in both the discharge illumination peak half-width and discharge delay dispersion resulting from reductions in formation delays and statistical delays relating to the discharge.

Reductions in the discharge probability rate of the address discharge in selected discharge cells during the write period are generally known to cause flicker, graininess, and other deteriorations in image quality in known PDPs. Graininess is increased and flicker occurs when the address discharge probability rate falls below 99.9% and 99%, respectively. It is therefore necessary to keep the failure rate of the address discharge at 0.1% or below. An average discharge delay period of approximately one-third the duration of the write pulse is required in order to achieve this.

The NTSC and VGA standards require a definition of approximately 500 scan lines, making it possible to drive the PDP with a write pulse of approximately 2 $\mu$s to 3 $\mu$s. However, to be compatible with the 1080 scan lines required by standards such as SXGA and full specification high-vision, write pulses of approximately 1 $\mu$s to 1.3 $\mu$s are necessary in order to drive the PDP. Electrode structures that generate a plurality of discharge illuminations require a substantial amount of time to complete the discharge, thus making it is difficult to meet this level of high definition.

In comparison, the single discharge in the PDP using the electrode structure according to embodiment 4 means that the discharge can be completed quickly and with minimum delay, thereby allowing for high driving speeds and high definition to be readily achieved.

Although the sustain electrodes according to embodiment 4 include four line parts, the same effect can be achieved by using display electrodes having more than four line parts (e.g. five line parts).

Also, while the various measurements with respect to each of the discharge cells according to embodiment 4 are as given above, the present invention is not limited to these measurements. For example, the same effects can be achieved when 0.5 mm$\leqq$P$\leqq$0.4 mm, 70 $\mu$m$\leqq$G$\leqq$120 $\mu$m, 10 $\mu$m$\leqq L_1$, $L_2 \leqq$50 $\mu$m, 20 $\mu$m$\leqq L_3$, $L_4 \leqq$60 $\mu$m, 80 $\mu$m$\leqq S_1 \leqq$130 $\mu$m, 70 $\mu$m$\leqq S_2 \leqq$120 $\mu$m, and 30 $\mu$m$\leqq S_3 \leqq$110 $\mu$m.

When the width of the line parts $L_1$ to $L_4$ are adjusted (this being especially true of the line part $L_n$ positioned furthest from main discharge gap G), it is preferable for the expression $L_{ave} \leqq L_n \leqq \{0.35P-(L_1+L_1+ \ldots L_{n-1})\}$ to be satisfied, where $L_{ave}$ is an average width of all the line parts in a respective cell.

Furthermore, experiment results have shown that, with respect to $L_1$ and $L_2$, it is preferable to satisfy the equations $0.5L_{ave} \leqq L_1$ and $L_2 \leqq L_{ave}$.

It should be noted that the effects of embodiment 4 can still be achieved when the width of the line parts $L_1$ to $L_4$ are uniform.

Also, while display electrodes 22 and 23 as described above are composed of four line parts 22*a* to 22*d* and 23*a* to 23*d*, respectively, it is possible for the display electrodes to include five or more line parts.

Embodiment 5

Figure 11:
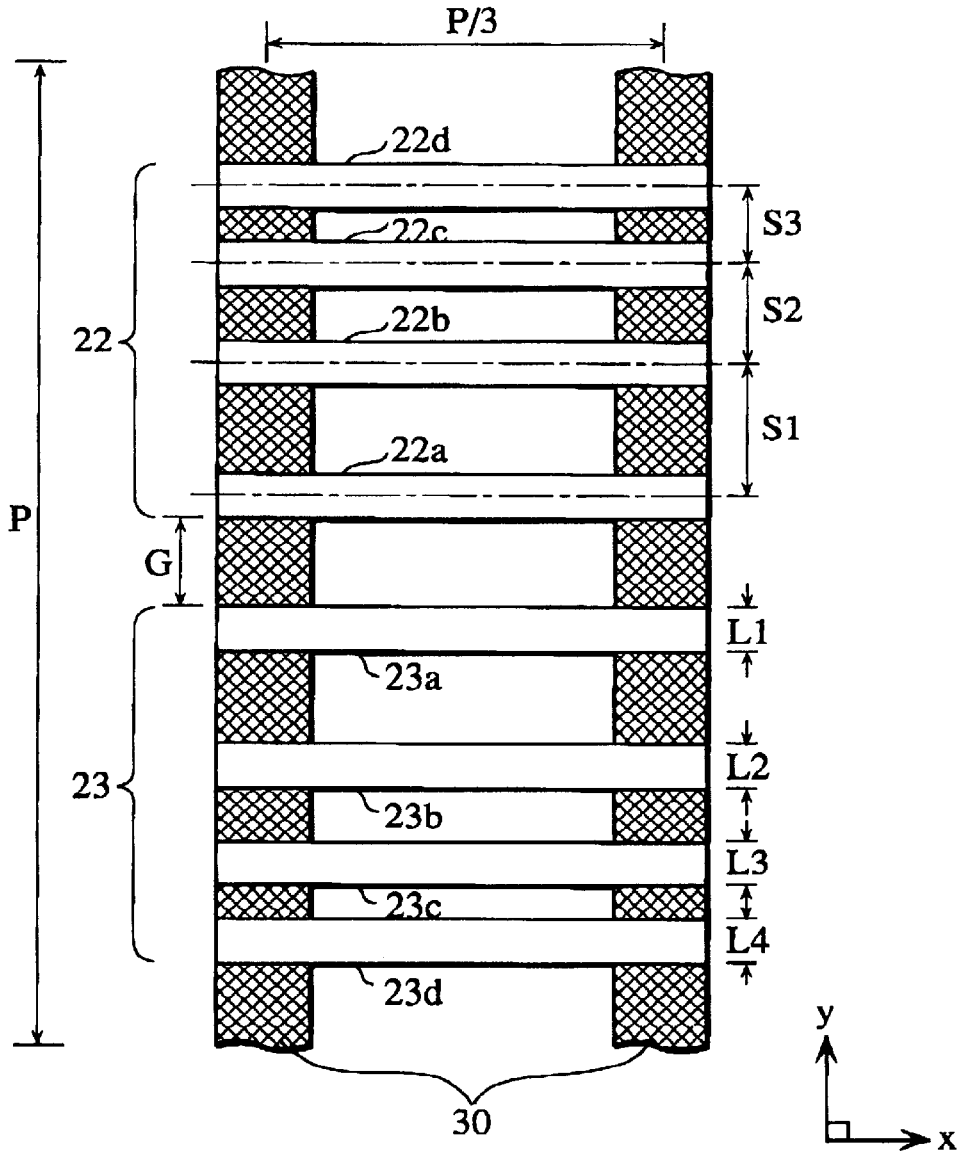
FIG. 11 shows a view from above of the display electrodes according to an embodiment 5.

FIG. 11 is a view from above of the display electrodes according to embodiment 5. In this embodiment, display electrodes 22 and 23 each include four line parts 22*a* to 22*d* and 23*a* to 23*d*, respectively, each of the line parts being of uniform width, and line part gaps $S_1$ to $S_3$ become geometrically smaller as the distance from main discharge gap G increases. In the given example, cell pitch P is 1.08 mm, main discharge gap G is 80 $\mu$m, line part widths $L_1$ to $L_4$ are 40 $\mu$m, first line part gap $S_1$ is 120 $\mu$m, second line part gap $S_2$ is 90 $\mu$m, and third line part gap $S_3$ is 67.5 $\mu$m.

In addition to substantially the same effects as embodiment 1, the structure according to embodiment 5 achieves the following.

Figure 12:
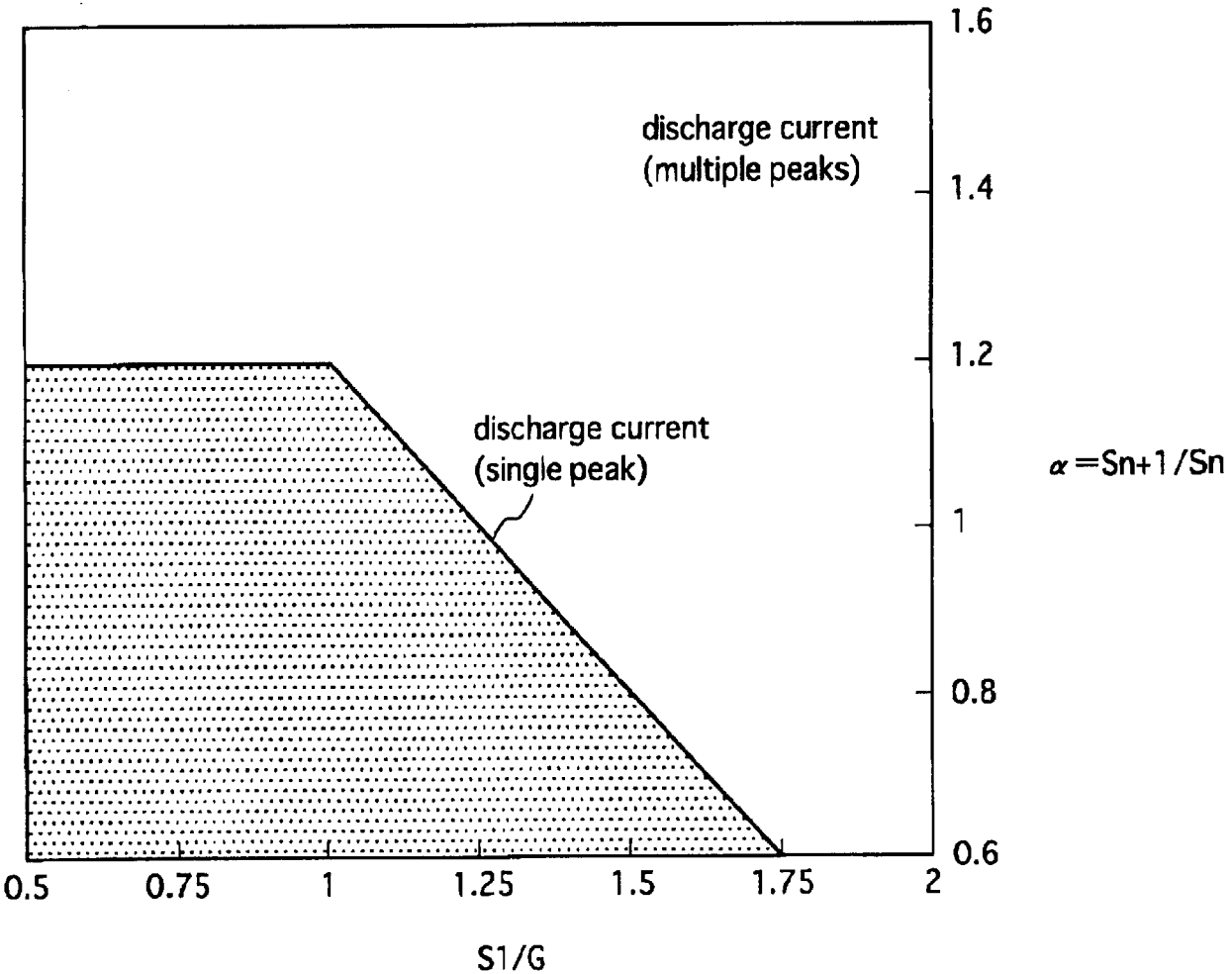
FIG. 12 is a graph showing a relationship between (i) a ratio $S_1/G$ with respect to main discharge gap G and the first line part gap $S_1$, and (ii) a discharge current peak number with respect to a line part gap ratio $\alpha=S_{n+1}/S_n$ in the PDP according to embodiment 5.

FIG. 12 is a graph showing the relationship according to embodiment 5 between (i) a ratio $S_1/G$ with respect to main discharge gap G and first line part gap $S_1$, and (ii) discharge current peak number with respect to a line part gap ratio $\alpha=S_{n+1}/S_n$. As shown in the FIG. 12 graph, as long as the line part gap ratio $\alpha=S_{n+1}/S_n$ is 0.8 or below it is possible to achieve a single discharge peak and consequently high driving speeds, even when first line part gap $S_1$ is 1.5 times main discharge gap G (i.e. $S_1/G$ equals 1.5).

Because the discharge structure according to embodiment 5 allows for a stable sustain discharge having a non-dispersed discharge current peak, it is possible to readily control the gradations by adjusting the pulses.

While the various measurements with respect to each of the discharge cells according to embodiment 5 are as given above, the present invention is not limited to these measurements. For example, the same effects can be achieved when 0.5 mm$\leqq$P$\leqq$1.4 mm, 60 $\mu$m$\leqq$G$\leqq$140 $\mu$m, 10 $\mu$m$\leqq L_1$, $L_2$, $L_3$, $L_4\leqq$60 $\mu$m, 50 $\mu$m$\leqq S_1\leqq$150 $\mu$m, 40 $\mu$m$\leqq S_2\leqq$140 $\mu$m, and 30 $\mu$m$\leqq S_3\leqq$130 $\mu$m.

Embodiment 6

Figure 13:
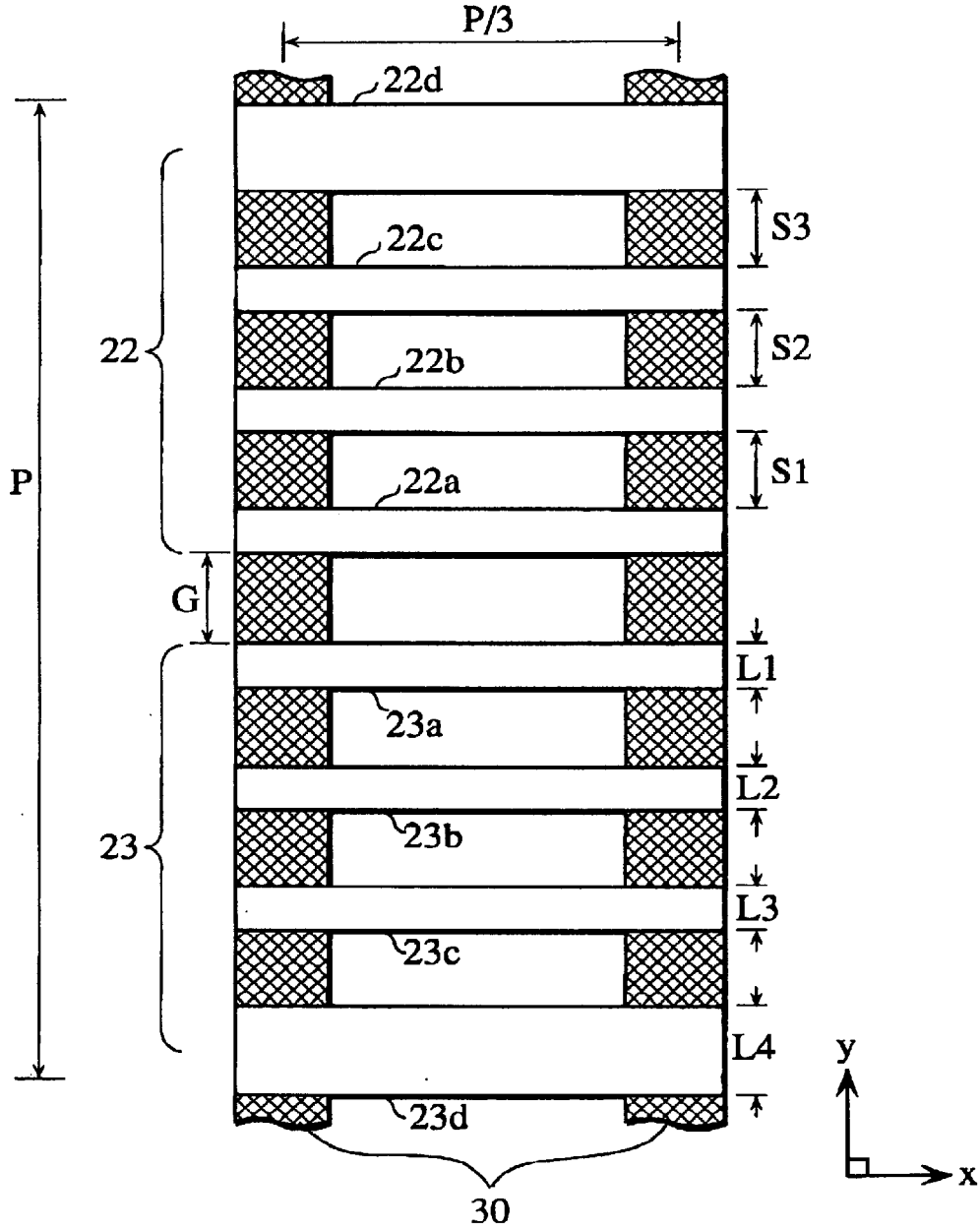
FIG. 13 shows a view from above of the display electrodes according to an embodiment 6.

FIG. 13 is a view from above of the display electrodes according to embodiment 6. In this embodiment, display electrodes 22 and 23 each include four line parts 22*a* to 22*d* and 23*a* to 23*d*, respectively. Also, line parts 22*d* and 23*d* are wider than the other line parts, and line part gaps $S_1$ to $S_3$ are of uniform width. In the given example, cell pitch P is 1.08 mm, main discharge gap G is 80 $\mu$m, line part widths $L_1$ to $L_3$ are 40 $\mu$m, line part width $L_3$ is 80 $\mu$m, and line part gaps $S_1$ to $S_3$ are 70 $\mu$m.

In addition to substantially the same effects as embodiment 1, the structure according to embodiment 6 achieves the following.

Figure 14:
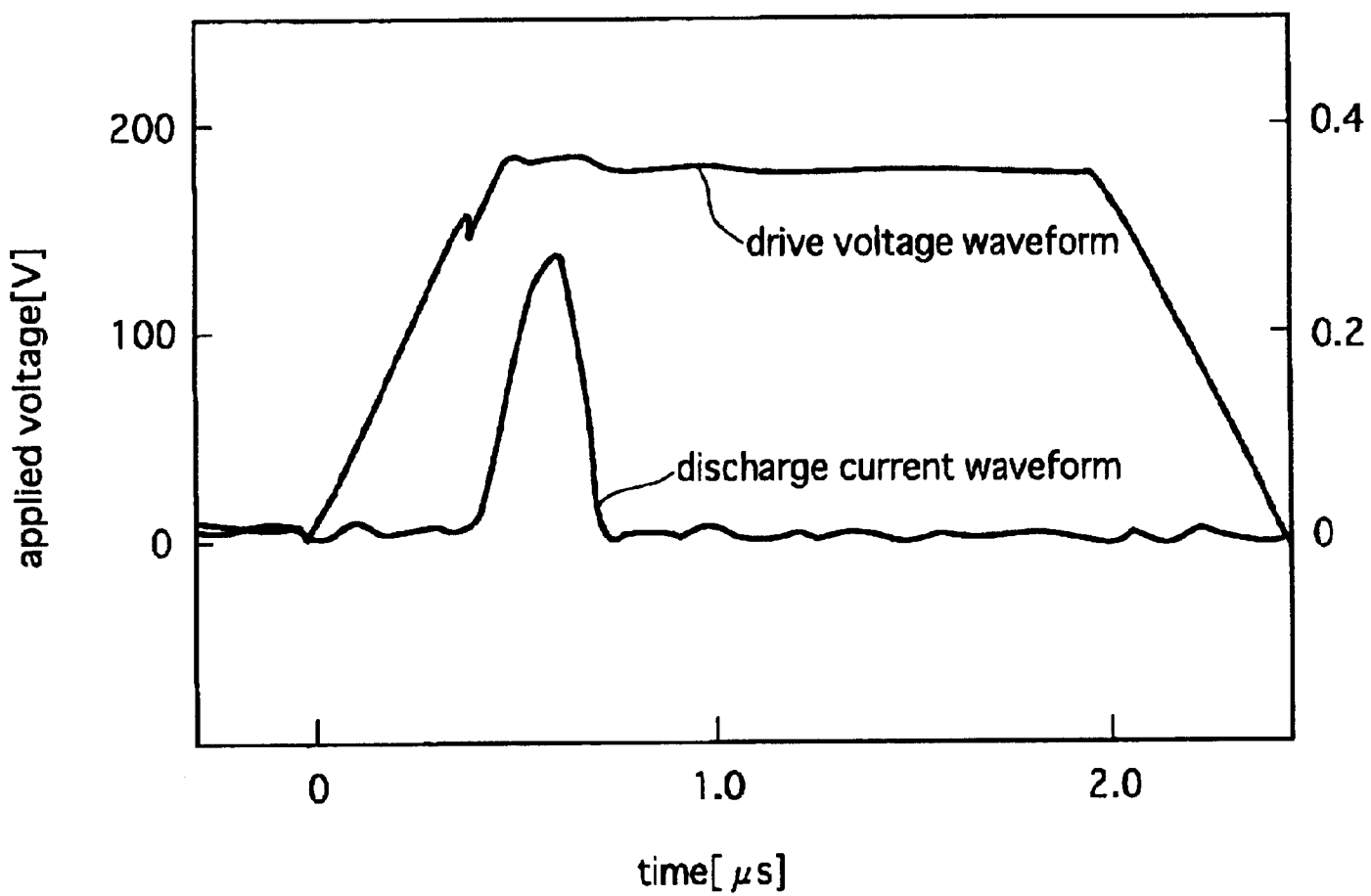
FIG. 14 is a waveform diagram showing a change over time of the drive voltage waveform and the discharge current waveform in the PDP according to embodiment 6.

FIG. 14 is a waveform diagram showing the change over time of the drive voltage waveform and the discharge current waveform in the PDP according to embodiment 6. As shown in FIG. 14, the discharge current waveform having a single peak makes it possible for the illumination discharge generated by a single drive pulse to be completed within 1 $\mu$s and for the discharge delay period to be kept short at approximately 0.2 $\mu$s. It is thus possible to achieve high driving speeds of 2 $\mu$s to 3 $\mu$s.

Table 1 below, shows the change in the line part resistance value, minimum address voltage $V_{dmin}$, and the number of peaks of the discharge current waveform when width $L_4$ of line parts 22*d* and 23*d* are varied in the PDP as per embodiment 6.

TABLE 1

| | $L_4$ [$\mu$m] | | | | |
|---|---|---|---|---|---|
| | 40 | 50 | 70 | 90 | 110 |
| line part 22d, 23d resistance value [Ω] | 56 | 53 | 47 | 43 | 39 |
| minimum applied voltage [V] | 58 | 55 | 49 | 44 | 40 |
| discharge current waveform peak no. | 1 | 1 | 1 | 1 | 1 |

As shown in table 1, by widening $L_4$ and thereby reducing the line part resistance value, while at the same time maintaining a single-peaked discharge current, it is possible to reduce the applied voltage required to conduct the addressing in the write period.

While the various measurements with respect to each of the discharge cells according to embodiment 6 are as given above, the present invention is not limited to these measurements. For example, the same effects can be achieved when 0.5 mm$\leqq$P$\leqq$1.4 mm, 60 $\mu$m$\leqq$G$\leqq$140 $\mu$m, 10 $\mu$m$\leqq L_1$, $L_2$, $L_3$, $L_4\leqq$60 $\mu$m, $L_1\leqq L4\leqq 3\times L_1$, and 50 $\mu$m$\leqq$S$\leqq$140 $\mu$m.

Embodiment 7

Figure 15:
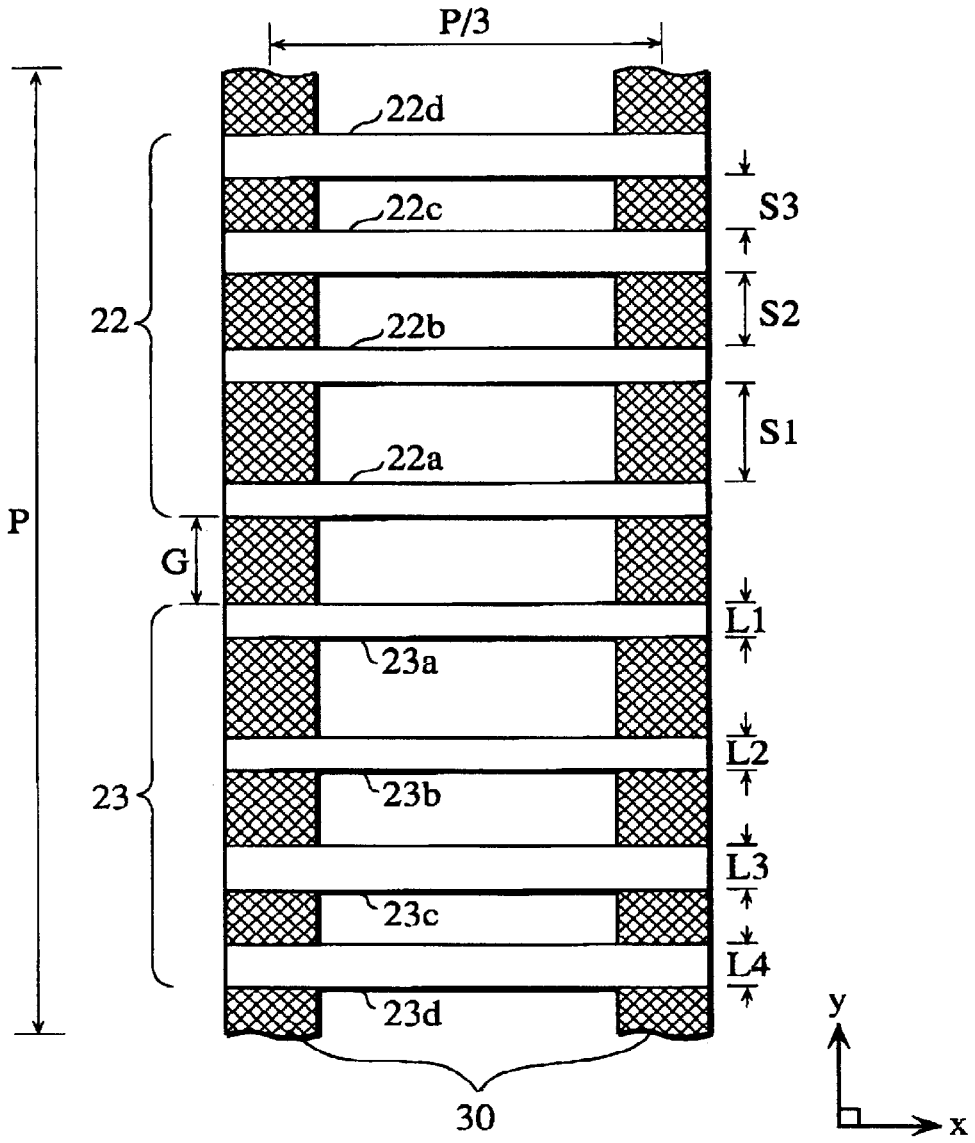
FIG. 15 shows a view from above of the display electrodes according to an embodiment 7.

FIG. 15 is a view from above of the display electrodes according to embodiment 7. In this embodiment, display electrodes 22 and 23 each include four line parts 22*a* to 22*d* and 23*a* to 23*d*, respectively. Also, line part 22*c*, 22*d*, 23*c*, and 23*d* are wider than the other line parts, and line part gaps $S_1$ to $S_3$ decrease in width as the distance from main discharge gap G increases. In the given example, cell pitch P is 1.08 mm, main discharge gap G is 80 $\mu$m, line part widths $L_1$ and $L_2$ are 30 $\mu$m, line part widths $L_3$ and $L_4$ are 40 $\mu$m, first line part gap $S_1$ is 90 $\mu$m, second line part gap $S_2$ is 70 $\mu$m, and third line part gap $S_3$ is 50 $\mu$m.

In addition to substantially the same effects as embodiment 1, the structure according to embodiment 7 achieves the following.

Figure 16:
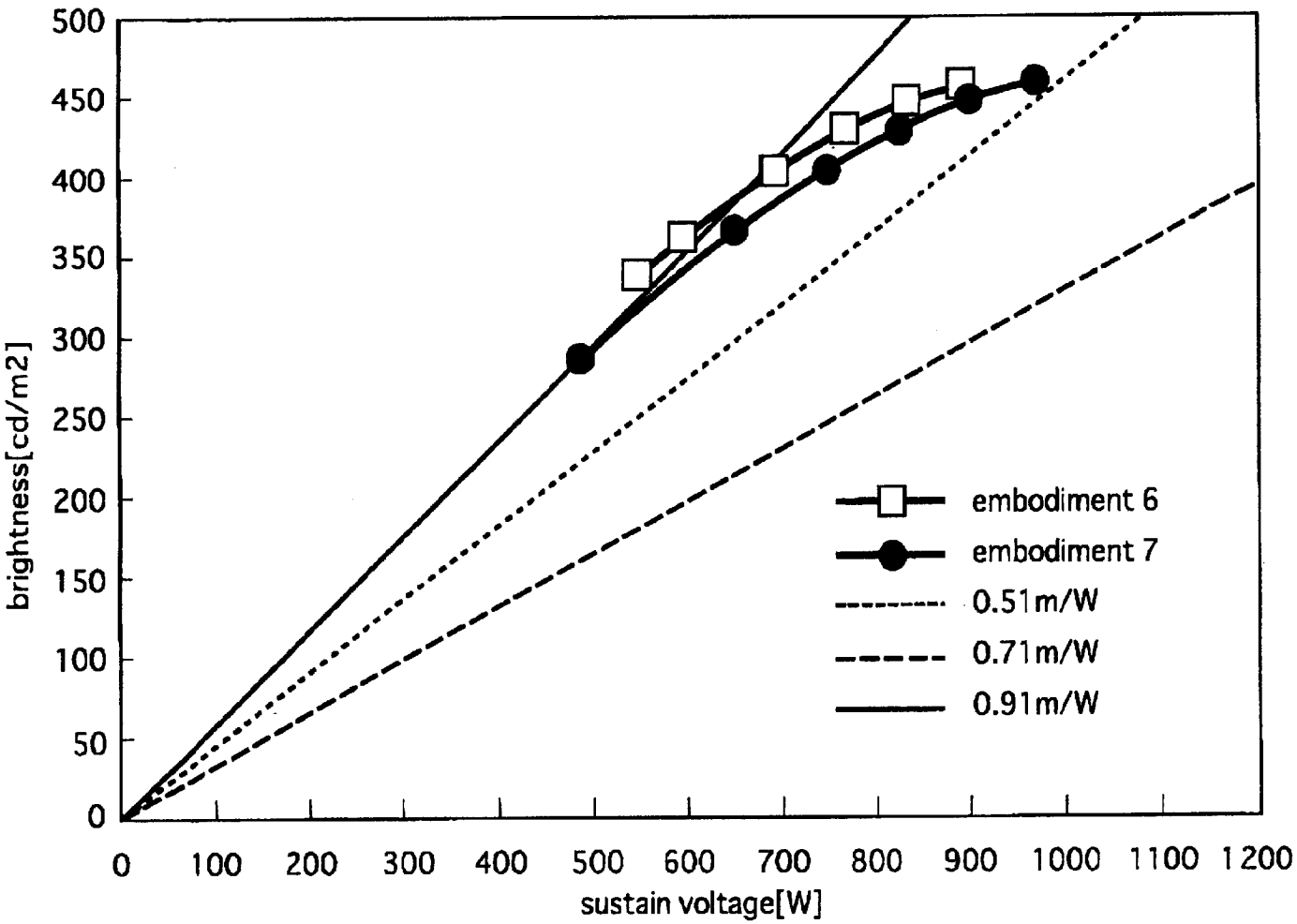
FIG. 16 is a graph showing the relationship between power and brightness in the PDP according to embodiments 6 and 7.

FIG. 16 is a graph showing the relationship between power consumption and brightness in the PDP according to embodiments 6 and 7. Generally in a PDP, panel brightness is proportionate to the amount of power supplied, although in FIG. 16 the power-brightness curves are tending towards saturation. Increasing the supply of power will consequently lead to a drop in luminous efficiency.

As shown in FIG. 16, embodiment 7 is able to achieve higher brightness levels and superior luminous efficiency under identical power supply conditions in comparison to embodiment 6.

While the various measurements with respect to each of the discharge cells according to embodiment 7 are as given above, the present invention is not limited to these measurements. For example, the same effects can be achieved when 0.5 mm$\leqq$P$\leqq$1.4 mm, 60 $\mu$m$\leqq$G$\leqq$140 $\mu$m, 10 $\mu$m$\leqq L_1$, $L_2\leqq$60 $\mu$m, 20 $\mu$m$\leqq L_3$, $L_4\leqq$70 $\mu$m, 50 $\mu$m$\leqq S_1\leqq$150 $\mu$m, 40 $\mu$m$\leqq S_2\leqq$140 $\mu$m, and 30 $\mu$m$\leqq S_3\leqq$130 $\mu$m.

Embodiment 8

Figure 17:
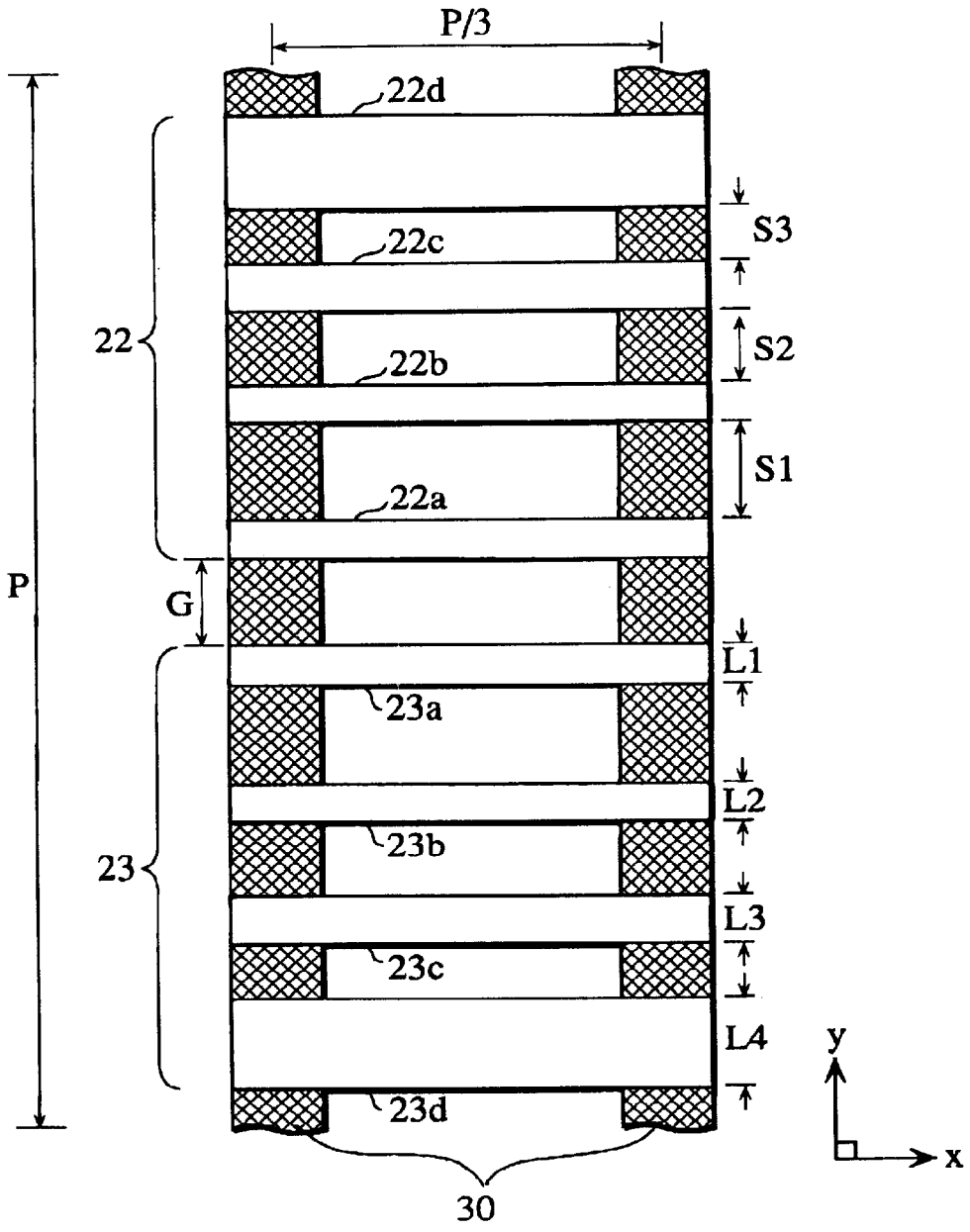
FIG. 17 shows a view from above of the display electrodes according to an embodiment 8.

FIG. 17 is a view from above of the display electrodes according to embodiment 8. In this embodiment, display electrodes 22 and 23 each include four line parts 22*a* to 22*d* and 23*a* to 23*d*, respectively. Also, line part 22*c*, 22*d*, 23*c*, and 23*d* are wider than the other line parts, and line part gaps $S_1$ to $S_3$ decrease in width as the distance from main discharge gap G increases. Furthermore, in order to improve the quality of the display screen, a black layer (not shown in the diagram) composed of a black material such as ruthenium oxide is provided in between the display electrodes and front panel glass 21 so as to correspond with the positioning of the display electrodes.

In the given example, cell pitch P is 1.08 mm, main discharge gap G is 80 $\mu$m, line part widths $L_1$ and $L_2$ are 35 $\mu$m, line part width $L_3$ is 45 $\mu$m, line part width $L_4$ is 85 $\mu$m, first line part gap $S_1$ is 90 $\mu$m, second line part gap $S_2$ is 70 $\mu$m, and third line part gap $S_3$ is 50 $\mu$m.

In addition to substantially the same effects as embodiment 1, the structure according to embodiment 8 achieves the following.

Figure 18:
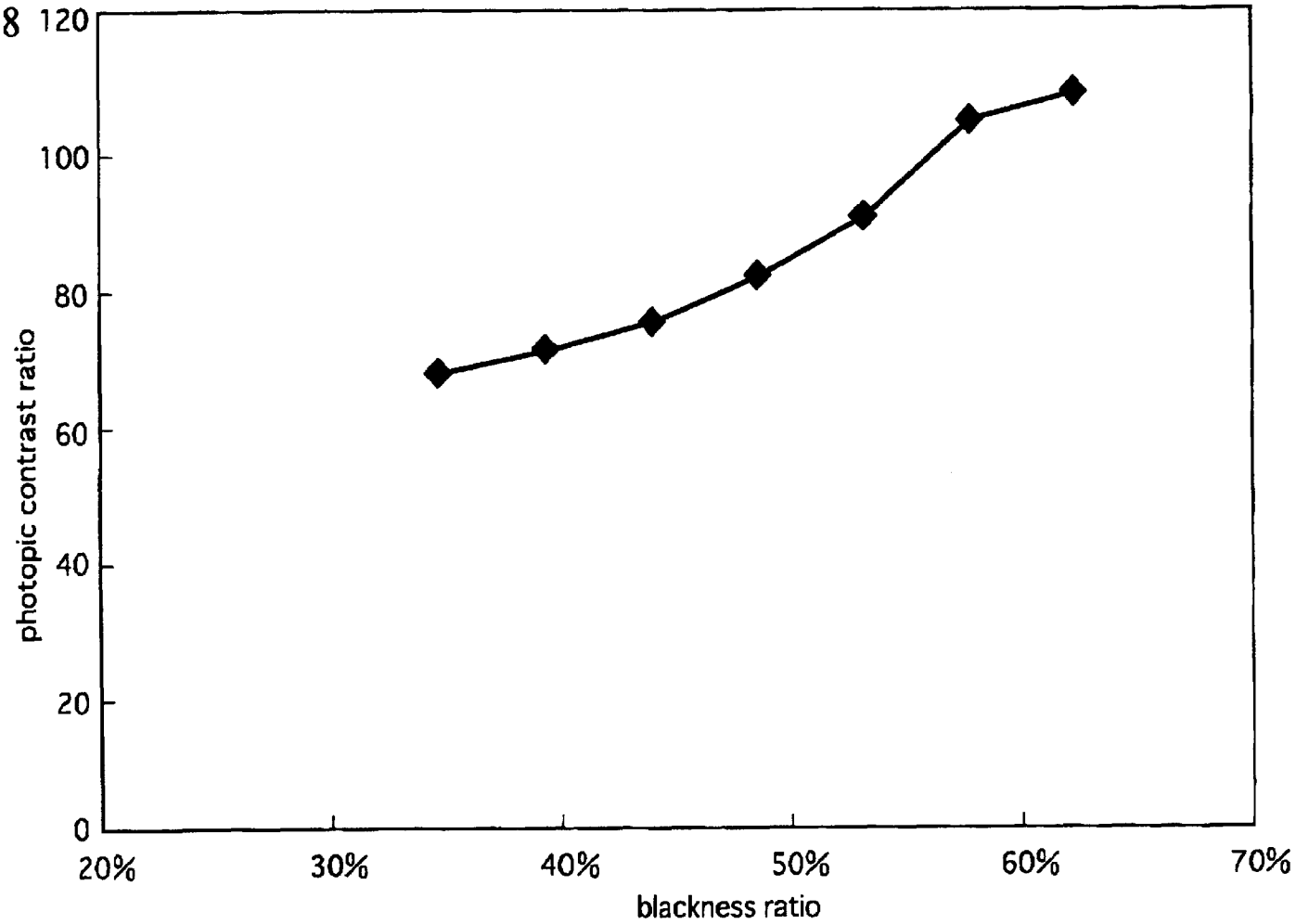
FIG. 18 is a graph showing a relationship between blackness and photopic contrast when $L_4$ is varied in the PDP according to embodiment 8.

FIG. 18 is a graph showing the relationship between blackness and photopic contrast when $L_4$ is varied in the PDP according to embodiment 8. The photopic contrast axis in FIG. 18 is a measure of a black display/white display brightness ratio with respect to the display surface of the PDP, given a vertical illuminance of 70Lx and a horizontal illuminance of 150Lx.

Generally in a PDP, the contrast ratio under photopic conditions is in a range of approximately 20:1 to 50:1 given the high reflectivity of the panel display surface due to the phosphor layers and barrier rib walls being white. According to embodiment 8, however, it is possible to achieve an extremely high photopic contrast ratio of approximately 70:1 due to the combined effects of the black layer and the securing of the discharge gained as a result of increasing the width $L_4$.

Although further increases in photopic contrast can be achieved by increasing the blackness ratio and the value of width $L_4$, the cell aperture ratio decreases and brightness levels fall when the blackness ratio is over increased (brightness decreases by approximately 10% at a blackness ratio of 50%). Thus it is preferable to maintain the blackness ratio within 60%.

While the various measurements with respect to each of the discharge cells according to embodiment 8 are as given above, the present invention is not limited to these measurements. For example, the same effects can be achieved when 0.5 mm$\leqq$P$\leqq$1.4 mm, 60 $\mu$m$\leqq$G$\leqq$140 $\mu$m, 10 $\mu$m$\leqq L_1$, $L_2 \leqq 60$ $\mu$m, 20 $\mu$m$\leqq L_3 \leqq 70$ $\mu$m, 20 $\mu$m$\leqq L_4 \leqq 0.3P-(L_1+L_2+L_3)$$\mu$m, 50 $\mu$m$\leqq S_1 \leqq 150$ $\mu$m, 40 $\mu$m$\leqq S_2 \leqq 140$ $\mu$m, and 30 $\mu$m$\leqq S_3 \leqq 130$ $\mu$m.

Also, it is possible for the black material used for the black layer to include a metal oxide such as nickel, chromium, or iron.

Embodiment 9

9-1 Structure of the Display Electrodes

Figure 19:
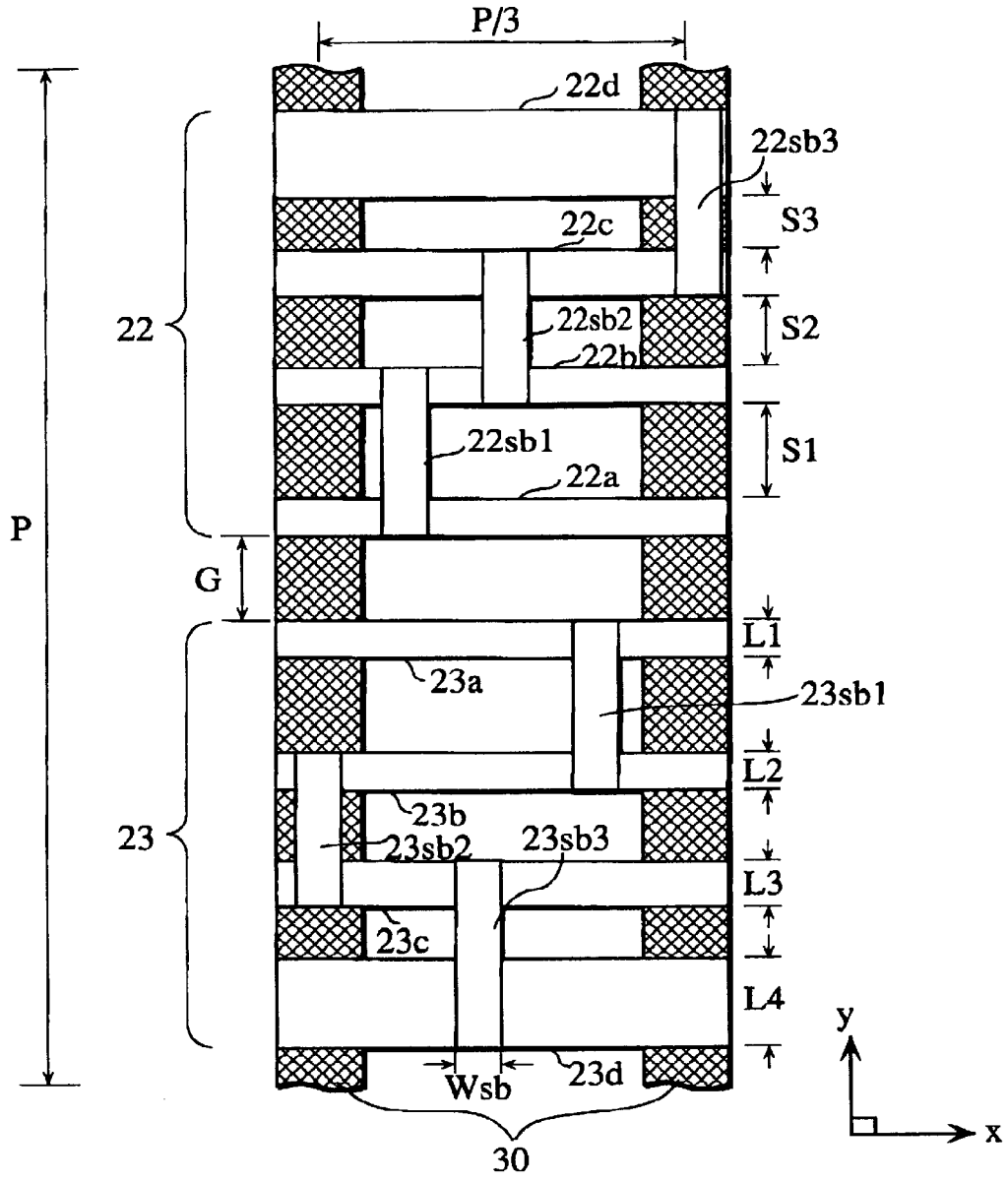
FIG. 19 shows a view from above of the display electrodes according to an embodiment 9.

FIG. 19 is a view from above of the display electrodes according to embodiment 9. In this embodiment, display electrodes 22 and 23 each include four line parts 22*a* to 22*d* and 23*a* to 23*d*, respectively, line parts 22*d* and 23*d* being wider than the other line parts, and line part gaps $S_1$ to $S_3$ decreasing in width in the stated order. Embodiment 9 is characterized in that short-bars 22Sb1 to 22Sb3 and 23Sb1 to 23Sb3 are randomly provided so as to electrically connect adjacent line parts. In the given example the short-bars are band-shaped bars extending in the y direction, although other formations of the short-bars are possible.

In the given example, cell pitch P is 1. 08 mm, main discharge gap G is 80 $\mu$m, line part widths $L_1$ and $L_2$ are 35 $\mu$m, line part width $L_3$ is 45 $\mu$m, line part width $L_4$ is 85 $\mu$m, first line part gap $S_1$ is 90 $\mu$m, second line part gap $S_2$ is 50 $\mu$m, third line part gap $S_3$ is 50 $\mu$m, and short-bar width $W_{sb}$ is 40 $\mu$m.

9-2 Effects of Embodiment 9

In addition to substantially the same effects as embodiment 1, the structure according to embodiment 9 achieves the following.

Table 2 shows data relating to a capacity of the PDP according to embodiment 9. In the given example, the capacity was measured at $L_4$ values of 50 $\mu$m and 85 $\mu$m. "Open circuit repairability" in table 2 shows the possibility of repairing line parts 22*d* and 23*d* when an open circuit occurs ("○" "Δ" "X" show the possibility of repair in order of increasing difficulty).

TABLE 2

| | $L_4$ [$\mu$m] | | | | |
|---|---|---|---|---|---|
| | 50 | 50 | 50 | 85 | 85 |
| Short-bar | no | yes | yes | yes | yes |
| short-bar gap [cm] | — | 8 | random | random | random |
| open circuit prob. [freq./line] | 0.15 | 0.004 | 0.002 | 0 | 0 |

TABLE 2-continued

| | $L_4$ [$\mu$m] | | | | |
|---|---|---|---|---|---|
| | 50 | 50 | 50 | 85 | 85 |
| line part resistance value [Ω] | 67 | 53 | 47 | 44 | 44 |
| open circuit repairability | X | Δ | Δ | ○ | ○ |

As shown in table 2, providing short-bars proves extremely effective, as the line part resistance value is lowered and the probability of an open circuit occurring is reduced from 15% to 0.4% in comparison to when short-bars are not provided. Thus by providing short-bars randomly between the line parts, embodiment 9 makes it possible to achieve an excellent display capacity in which the occurrence of moiré can be suppressed.

While the various measurements with respect to each of the discharge cells according to embodiment 5 are as given above, the present invention is not limited to these measurements. For example, the same effects can be achieved when 0.5 mm$\leqq$P$\leqq$1.4 mm, 60 $\mu$m$\leqq$G$\leqq$140 $\mu$m, 10 $\mu$m$\leqq L_1$, $L_2 \leqq 60$ $\mu$m, 20 $\mu$m$\leqq L_3 \leqq 70$ $\mu$m, 40 $\mu$m$\leqq L_4 \leqq 0.3P-(L_1+L_2+L_3)$ $\mu$m, 50 $\mu$m$\leqq S_1 \leqq 150$ $\mu$m, 40 $\mu$m$\leqq S_2 \leqq 140$ $\mu$m, 30 $\mu$m$\leqq S_3 \leqq 130$ $\mu$m, and 10 $\mu$m$\leqq W_{sb} \leqq 80$ $\mu$m.

Embodiment 10

Figure 20:
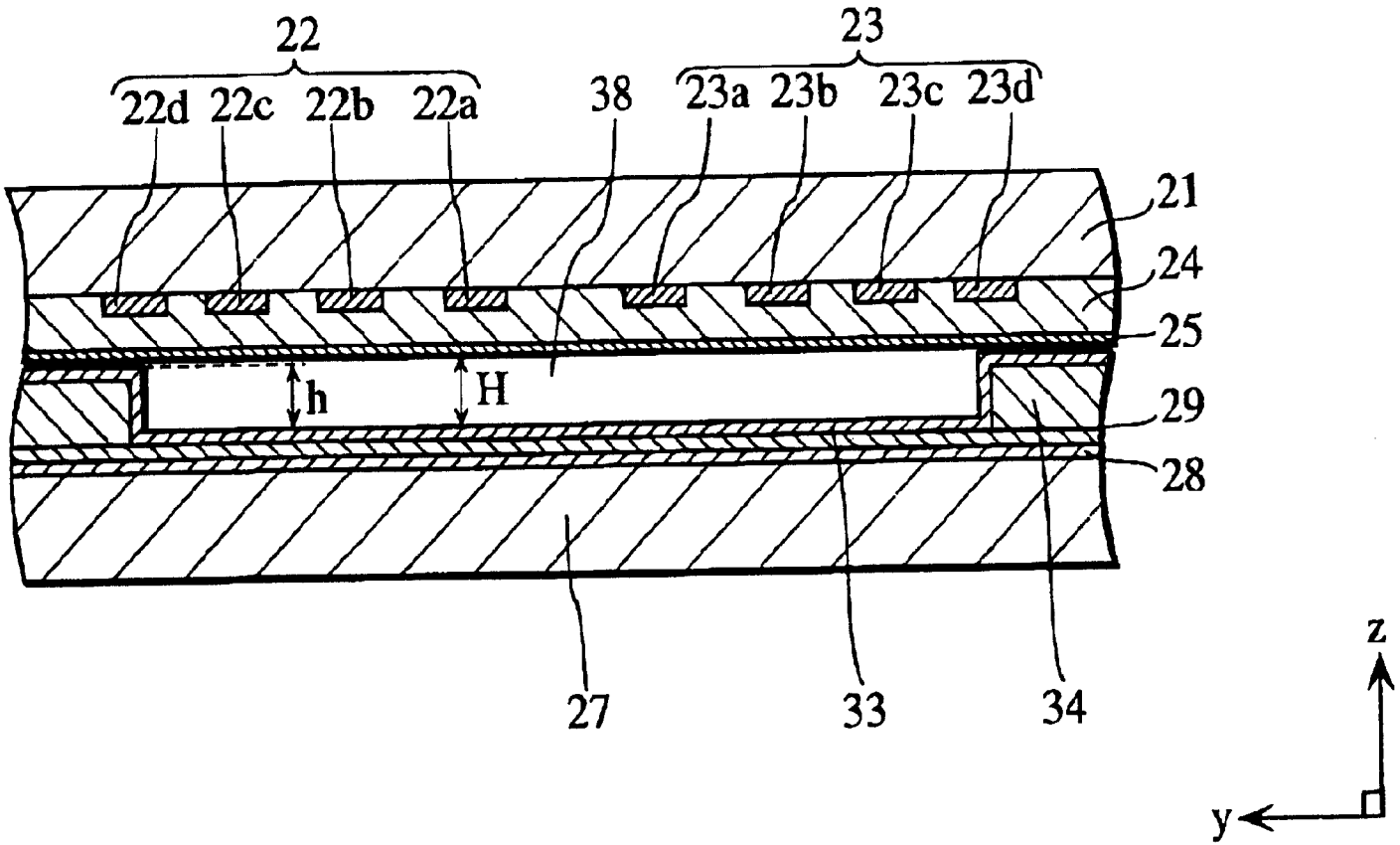
FIG. 20 is a cross-sectional view along a Y—Y axis of a section of the PDP according to an embodiment 10.

FIG. 20 is a cross-sectional view along a Y—Y axis of a section of the PDP according to embodiment 10 (in FIG. 20, barrier rib 30 forms the inner wall of discharge space 38). Although the arrangement of the display electrodes is the same as in embodiment 9, embodiment 10 is characterized by the provision of auxiliary barrier ribs 34 (second barrier ribs) that are positioned on the outer side of line parts 22*d* and 23*d*, respectively (i.e. the opposite side to the side facing main discharge gap G), so as to extend in a lengthwise direction of the line parts. In other words, auxiliary barrier ribs 34 are positioned orthogonally to and form a matrix with barrier ribs 30 (first barrier ribs) and partition off each pair of discharge electrodes 22 and 23.

In the given example, cell pitch P is 1.08 mm, main discharge gap G is 80 $\mu$m, line part widths $L_1$ and $L_2$ are 35 $\mu$m, line part width $L_3$ is 45 $\mu$m, line part width $L_4$ is 85 $\mu$m,s first line part gap $S_1$ is 90 $\mu$m, second line part gap $S_2$ is 50 $\mu$m, third line part gap $S_3$ is 50 $\mu$m, short-bar width $W_{sb}$ is 40 $\mu$m, barrier rib height H is 110 $\mu$m, auxiliary barrier rib high h is 60 $\mu$m, auxiliary barrier rib width (top) Wait is 60 $\mu$m, and auxiliary barrier rib width (bottom) $W_{alb}$ is 100 $\mu$m.

Additional to the effects of embodiment 9, the structure according to embodiment 10 achieves the following.

Table 3 shows data relating to the occurrence of crosstalk-generated erroneous discharge in the PDP according to embodiment 10, given Ipg values (i.e. the distance between line part 22*d* in one cell and line part 23*d* in a cell adjacent in they direction) ranging from 60 $\mu$m to 360 $\mu$m, and depending on the provision or non-provision of the auxiliary barrier ribs.

TABLE 3

| | $I_{pg}$ [$\mu$m] | | | | | | | |
|---|---|---|---|---|---|---|---|---|
| | 60 | 120 | 260 | 260 | 300 | 300 | 360 | 360 |
| auxiliary barrier ribs | yes | yes | no | yes | no | yes | no | yes |
| crosstalk/ erroneous discharge | X | ○ | X | ○ | X | ○ | ○ | ○ |

As shown in table 3, crosstalk-generated erroneous discharge is likely to occur at Ipg values of approximately 300

μm and below when auxiliary barrier ribs 34 are not provided. Graininess and flicker will result from this erroneous discharge when the PDP is driven. In contrast, according to embodiment 10, crosstalk-related erroneous discharge does not occur and an excellent display capacity can be achieved when auxiliary barrier ribs 34 are provided, even at Ipg values of approximately 120 μm. In other words, the provision of auxiliary barrier ribs 34 helps to suppress the diffusion from the perimeter of discharge cells into adjacent cells of (i) priming particles (i.e. charge particles, etc) generated by discharge plasma and (ii) resonance lines within the vacuum ultraviolet region.

Although the suppression of crosstalk can be further enhanced by increasing the height h (see FIG. 20) of auxiliary barrier ribs 34, it becomes difficult to adequately deaerate the discharge space 38 and fill it with discharge gas during manufacture when the height h approximates too closely the height H of barrier ribs 30. It is therefore preferable for the height h of the auxiliary barrier ribs 30 to be shorter than the height H of barrier ribs 30 by at least 10 μm. Specifically, it is preferable for the height h to be in a range of 50 μm to 120 μm inclusive.

Furthermore, it is preferable for a top width Wait and a bottom width $W_{alb}$ of auxiliary barrier ribs 34 to be in a range of 30 μm to 300 μm inclusive due to reductions in the magnitude of the discharge when the top width $W_{alt}$ and bottom width $W_{alb}$ are too wide.

Also, while the various measurements with respect to each of the discharge cells according to embodiment 10 are as given above, the present invention is not limited to these measurements. For example, the same effects can be achieved when 0.5 mm$\leqq$P$\leqq$1.4 mm, 60 μm$\leqq$G$\leqq$140 μm, 10 μm$\leqq L_1$, $L_2 \leqq$60 μm, 20 μm$\leqq L_3 \leqq$70 μm, 20 μm$\leqq L_4 \leqq$0.3P−($L_1$+$L_2$+$L_3$) μm, 50 μm$\leqq S_1 \leqq$150 μm, 40 μm$\leqq S_2 \leqq$140 μm, 30 μm$\leqq S_3 \leqq$130 μm, 10 μm$\leqq W_{sb} \leqq$80 μm, 50 μm$\leqq W_{alt} \leqq$450 μm, and 60 μm$\leqq$h$\leqq$H−10 μm.

It is also possible for auxiliary barrier ribs 34 to be adapted for inclusion in the other embodiments of the present invention.

Embodiment 11

11-1 Structure of the Display Electrodes

Figure 21:
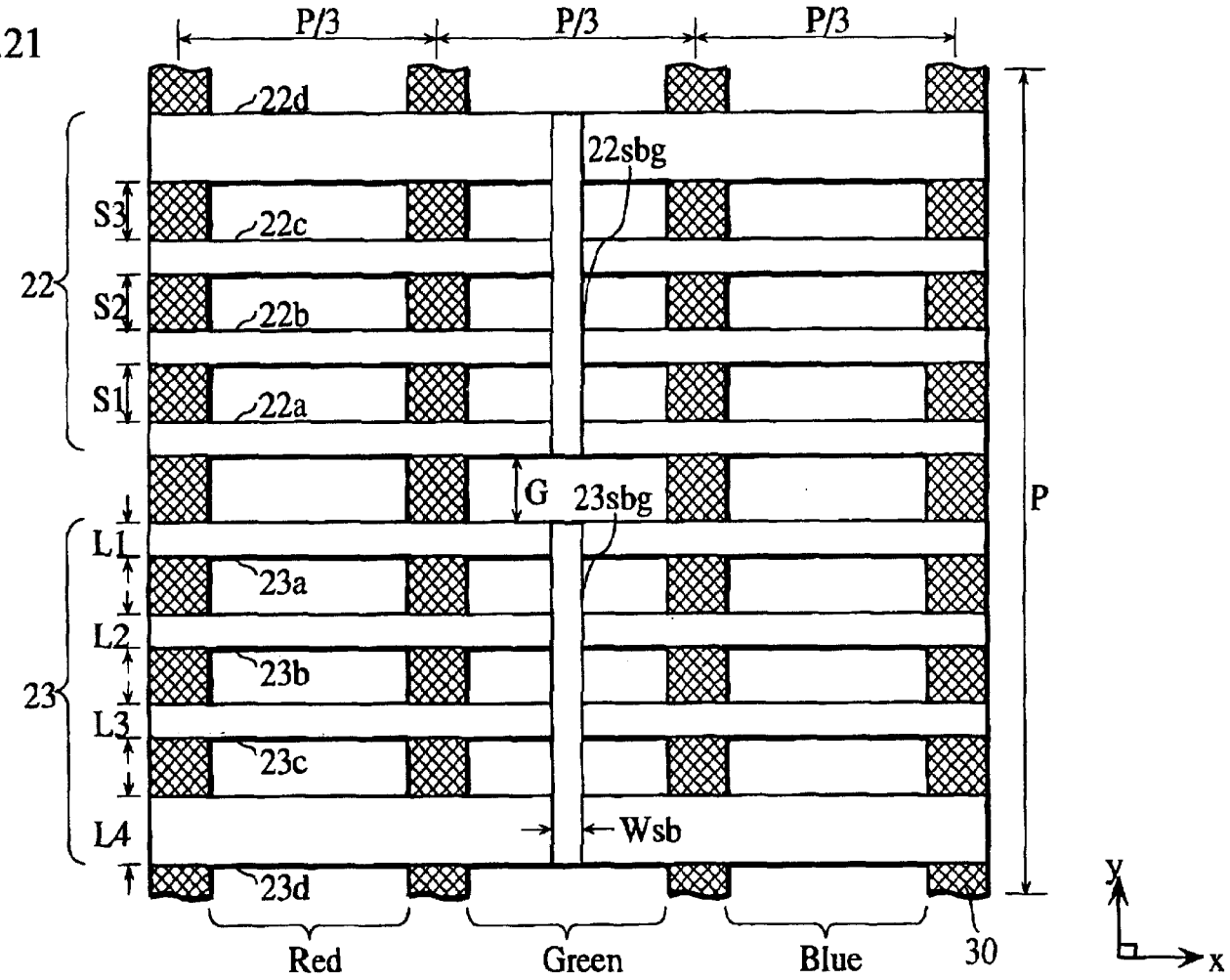
FIG. 21 shows a view from above of the display electrodes according to an embodiment 11.

FIG. 21 is a view from above of the display electrodes according to embodiment 11. In this embodiment, display electrodes 22 and 23 each include four line parts 22*a* to 22*d* and 23*a* to 23*d*, respectively, line parts 22*d* and 23*d* being wider than the other line parts, and line part gaps $S_1$ to $S_3$ being of uniform width. Embodiment 11 is characterized by the provision of short-bars 22Sbg and 23Sbg in the green discharge cell (G cell) so as to electrically connect each of the line parts 22*a* to 22*d* and 23*a* to 23*d*, respectively.

In the given example, cell pitch P is 1.08 mm, main discharge gap G is 80 μm, line part widths $L_1$ to $L_3$ are 35 μm, line part width $L_4$ is 80 μm, line part gap S ($S_1$ to $S_3$) is 70 μm, and short-bar width $W_{sb}$ is 40 μm.

11-2 Effects of Embodiment 11

In addition to substantially the same effects as embodiment 1, the structure according to embodiment 11 achieves the following.

Figure 22:
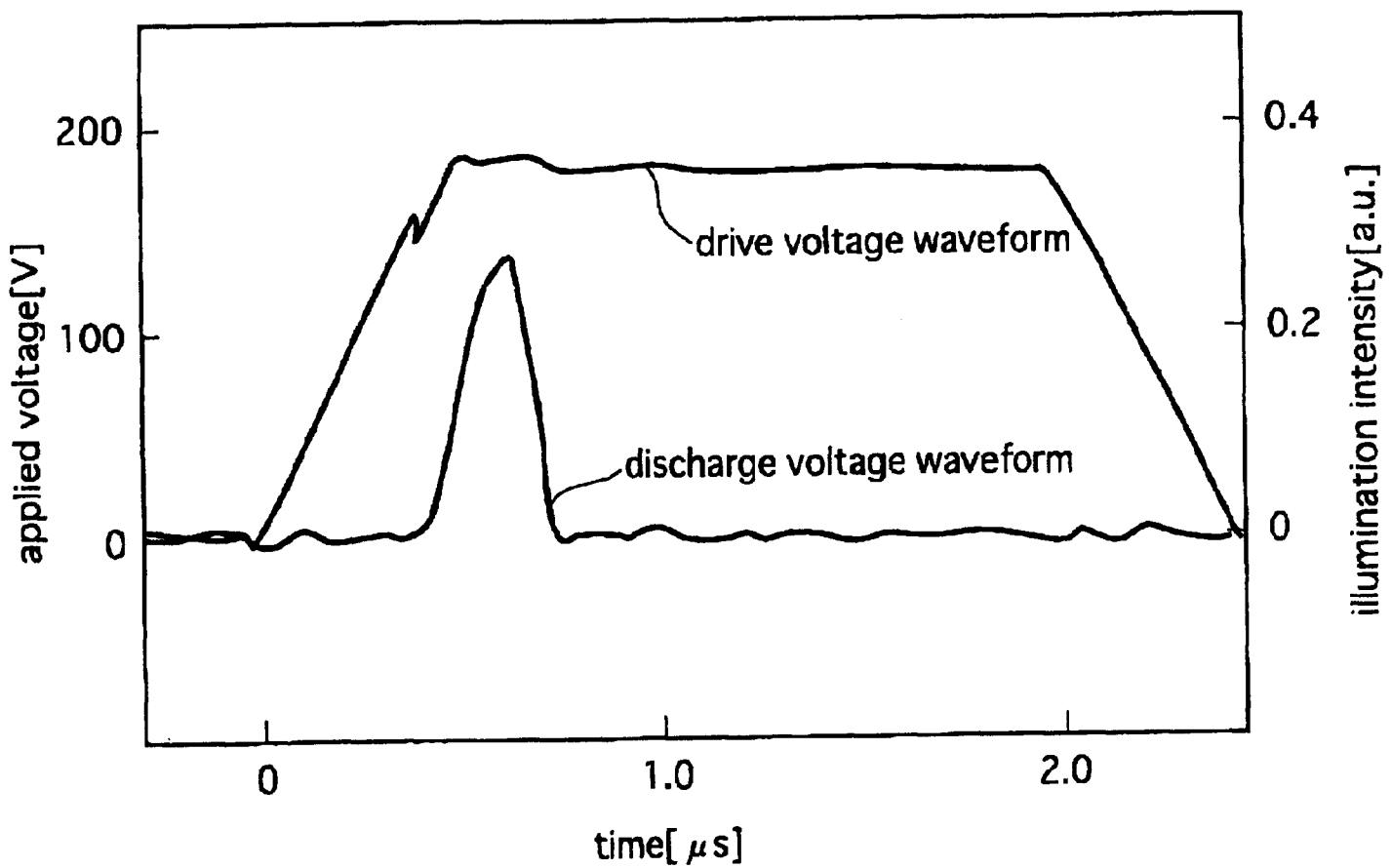
FIG. 22 is a graph showing a change over time of the drive voltage waveform and the discharge current waveform in the PDP according to embodiment 11.

FIG. 22 is a waveform diagram showing the change over time of the drive voltage waveform and the discharge current waveform in the PDP according to embodiment 11. As shown in FIG. 22, because of the discharge current waveform having a single peak according to embodiment 11, it is possible to complete the discharge illumination generating from a single drive pulse within 1 μs and to achieve a short discharge delay period of approximately 0.2 μs. High driving speeds of 2 μs to 3 μs can be achieved as a result.

The data in table 4 shows the way in which the minimum sustain voltage $V_{susmin}$ in each of the cells R, G, B varies depending on the provision or non-provision of short-bars in the PDP according to embodiment 11.

TABLE 4

| | discharge cell | | | |
|---|---|---|---|---|
| | R | G | B | G |
| short-bar | no | no | no | yes |
| Vsusmin [V] | 167 | 175 | 165 | 165 |
| discharge current waveform peak no. | 1 | 1 | 1 | 1 |

As shown in table 4, the minimum sustain voltage $V_{susmin}$ in each of the cells R, G, B is dispersed when short-bars are not provided in the cells. Because the minimum applied voltage (i.e. set value) of the entire panel is set to be equal to or greater than the $V_{susmin}$ of the G cell (i.e. the cell having the highest $V_{susmin}$ value in table 4), the lower limit of the drive margin is raised when $V_{susmin}$ is different for each of the cells. The set margin of the drive voltage is narrowed as a result.

In contrast, according to embodiment 11, it is possible to reduce $V_{susmin}$ by approximately 10V when short-bars 22Sbg and 23Sbg are provided in the G cell. The $V_{susmin}$ value differential between each of the cells R, G, B is thus reduced, and the drive voltage margin is expanded due to a reduction in the set value of the applied voltage. This effect can be attributed to the increased surface area of display electrodes 22 and 23 in the G cell resulting from the provision of the short-bars, thus allowing for an increase in the amount of stored wall charge and a consequent reduction in the discharge initiating voltage in the G cell While the various measurements with respect to each of the discharge cells according to embodiment 5 are as given above, the present invention is not limited to these measurements. For example, the same effects can be achieved when 0.5 mm$\leqq$P$\leqq$1.4 mm, 60 μm$\leqq$G$\leqq$140 μm, 10 μm$\leqq L_1$, $L_2$, $L_3 \leqq$60 μm, $L_1 \leqq L_4 \leqq 3L_1$, 50 μm$\leqq$S$\leqq$140 μm, and 10 μm$\leqq W_{sb} \leqq$100 μm.

Embodiment 12

Figure 23:
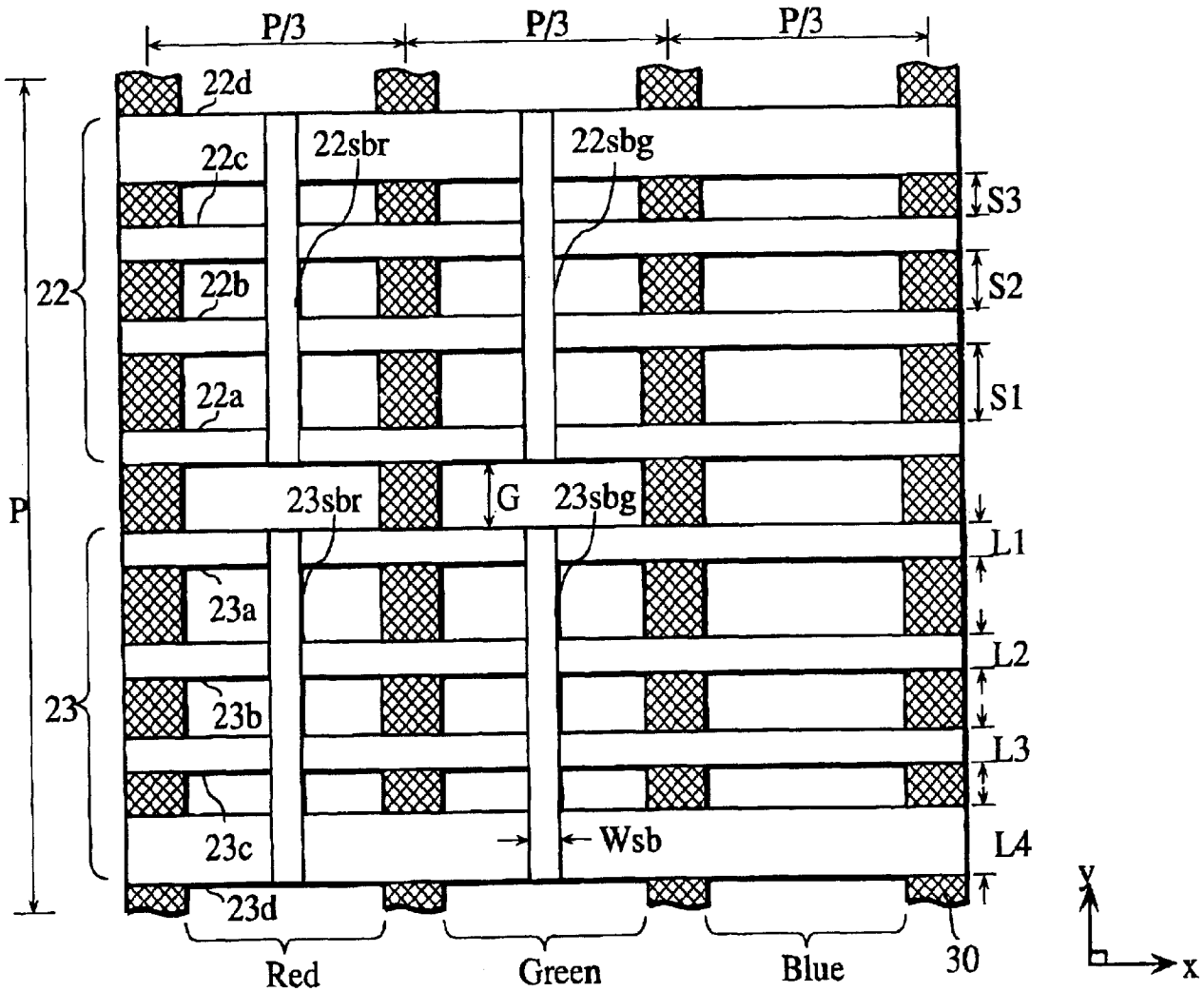
FIG. 23 shows a view from above of the display electrodes according to an embodiment 12.

FIG. 23 is a view from above of the display electrodes according to embodiment 12. In this embodiment, display electrodes 22 and 23 each include four line parts 22*a* to 22*d* and 23*a* to 23*d*, respectively, line parts 22*d* and 23*d* being wider than the other line parts, and line part gaps $S_1$ to $S_3$ decreasing in width as the distance from the main discharge gap increases. Embodiment 12 is characterized by the provision of short-bars 22Sbr and 23Sbr in the red discharge cell (R cell) and short-bars 22Sbg and 23Sbg in the green discharge cell (G cell), the short-bars electrically connecting the line parts 22*a* to 22*d* and 23*a* to 23*d*, respectively.

In the given example, cell pitch P is 1.08 mm, main discharge gap G is 80 μm, line part widths $L_1$ to $L_3$ are 40 μm, line part width $L_4$ is 80 μm, first line part gap $S_1$ is 90 μm, second line part gap $S_2$ is 70 μm, third line part gap $S_3$ is 50 μm, and short-bar width $W_{sb}$ is 40 μm.

In addition to improvements in luminous efficiency, the structure according to embodiment 12 achieves the following.

Generally, in a PDP the discharge delay periods of the address discharges occurring in the write period is not uniform for each of the cells R, G, B because of differences in the statistical delay periods Ts in the respective cells. In particular, the high Ts value of the R cell and G cell implies that writing failure is more likely to occur given the comparatively low address discharge probability rates in these cells. This result will be flicker and other reductions in image quality when the PDP is driven.

One particular method of improving the discharge probability rate during the write period is to increase the voltage of the write pulse. However, this adversely increases the power consumption of the data driver circuit, and consequently increases in the overall power usage of the PDP.

In contrast, embodiment 12 is able to overcome the problem of a low discharge probability rate in addition to improving luminous efficiency. Specifically, reductions in the Ts value are made possible by increasing the surface area of the display electrode in the R cell and G cell through the provision of the short-bars, thereby increasing the capacitance in these cells. The discharge probability rate of the address discharge is improved by approximately 1.0% as a result, and flicker and other reductions in image quality caused by failed addressing are reduced in comparison to existing technology. Also, the excellent display capacity in the PDP according to embodiment 12 makes it possible to expand the drive voltage margin, even at address discharge voltages $V_{data}$ lower than existing values.

Table 5 shows the way in which the statistical delay periods Ts in each of the cells R, G, B vary depending on the provision or non-provision of short-bars in the PDP according to embodiment 12.

TABLE 5

| | discharge cell | | | | |
|---|---|---|---|---|---|
| | R | G | B | R | G |
| short-bar | no | no | no | yes | yes |
| statistical delay period [μs] | 0.15 | 0.20 | 0.10 | 0.10 | 0.13 |
| address discharge probability [%] | 99.0 | 98.0 | 99.9 | 99.8 | 99.5 |

As shown in table 5, dispersion in the statistical delay periods Ts between each of the cells R, G, B in a PDP that does not include short-bars means that the discharge delay periods of the address discharges during the write period will be different for each of the cells.

In comparison, in a PDP having an electrode structure as per embodiment 12, it is possible to reduce the differences in the discharge probability rate and achieve an excellent display capacity by reducing the statistical delay period in the R cell and G cell through the provision of the short-bars in these cells.

While the various measurements with respect to each of the discharge cells according to embodiment 5 are as given above, the present invention is not limited to these measurements. For example, the same effects can be achieved when 0.5 mm≦P≦1.4 mm, 60 μm≦G≦140 μm, 10 μm≦$L_1$, $L_2$, $L_3$≦60 m, $L_1$≦$L_4$≦3$L_1$, 50 μm≦$S_1$≦150 μm, 40 μm≦$S_2$≦140 μm, 30 μm≦$S_{3≦130}$ μm, and 10 μm≦$W_{sb}$≦100 μm.

Embodiment 13

Figure 24:
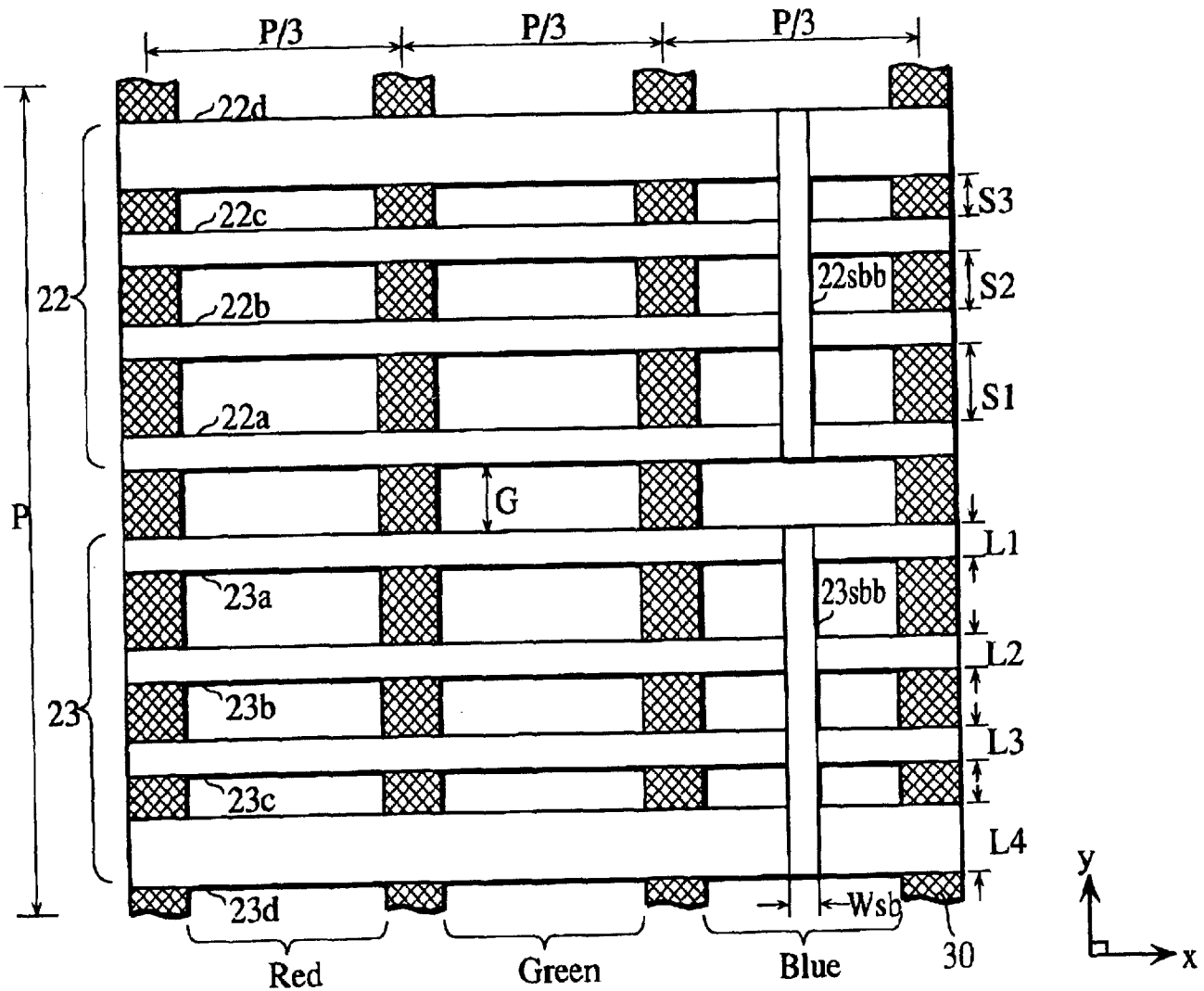
FIG. 24 shows a view from above of the display electrodes according to an embodiment 13.

FIG. 24 is a view from above of the display electrodes according to embodiment 13. In comparison to embodiment 12, short-bars 22*sbb* and 23*sbb* are provided only in the blue discharge cell (B cell) in the PDP according to embodiment 13. In the given example, cell pitch P is 1.08 mm, main discharge gap G is 80 μm, line part widths L, to $L_3$ are 40 μm, line part width $L_4$ is 80 μm, first line part gap $S_1$ is 90 μm, second line part gap $S_2$ is 70 μm, third line part gap $S_3$ is 50 μm, and short-bar width $W_{sb}$ is 40 μm.

In addition to improvements in luminous efficiency, the structure according to embodiment 13 achieves the following.

In prior art PDPs it is generally difficult to balance the brightness of each of the cells R, G, B, thus makes it possible to only achieve panel color temperatures of approximately 5000K to 7000K. One method of improving the color temperature to around 11000K is to correct the whiteness balance by reducing the brightness of the R cell and G cell when the PDP is driven, thereby approximating the brightness and chromaticity of the B cell. However, this method adversely reduces the overall brightness of the display.

In contrast, embodiment 13 is able to overcome the problem of low brightness in the B cell in addition to improving luminous efficiency. Specifically, it is possible to improve the relative brightness of the B cell with respect to the R cell and G cell by increasing the surface area of the display electrodes in the B cell through the provision of short-bars 22*sbb* and 23*sbb*. The result is an increase in panel color temperature without any necessary reduction in the overall brightness of the display as is the case in prior art PDPs.

Table 6 shows the way in which color temperature varies during the whiteness display period depending on the provision or non-provision of short-bars in a PDP according to embodiment 13.

TABLE 6

| | B cell short-bar | |
|---|---|---|
| | No | yes |
| white brightness [cd/m$^2$] | 360 | 380 |
| color temp. [K] | 5000–7000 | 9500–13000 |

As shown in table 6, it is possible to achieve an extremely high color temperature of 9500K to 13000K in the PDP according to embodiment 13 when short-bars 22*sbb* and 23*sbb* are provided in the B cell.

While the various measurements with respect to each of the discharge cells according to embodiment 5 are as given above, the present invention is not limited to these measurements. For example, the same effects can be achieved when 0.5 mm≦P≦1.4 mm, 60 μm≦G≦140 μm, 10 μm≦$L_1$, $L_2$, $L_3$≦60 μm, $L_1$≦$L_4$≦3$L_1$, 50 μm≦$S_1$≦150 μm, 40 μm'$S_2$≦140 μm, 30 μm≦$S_3$ ≦130 μm, and 10 μm≦$W_{sb}$≦100 μm.

Embodiment 14

Figure 25:
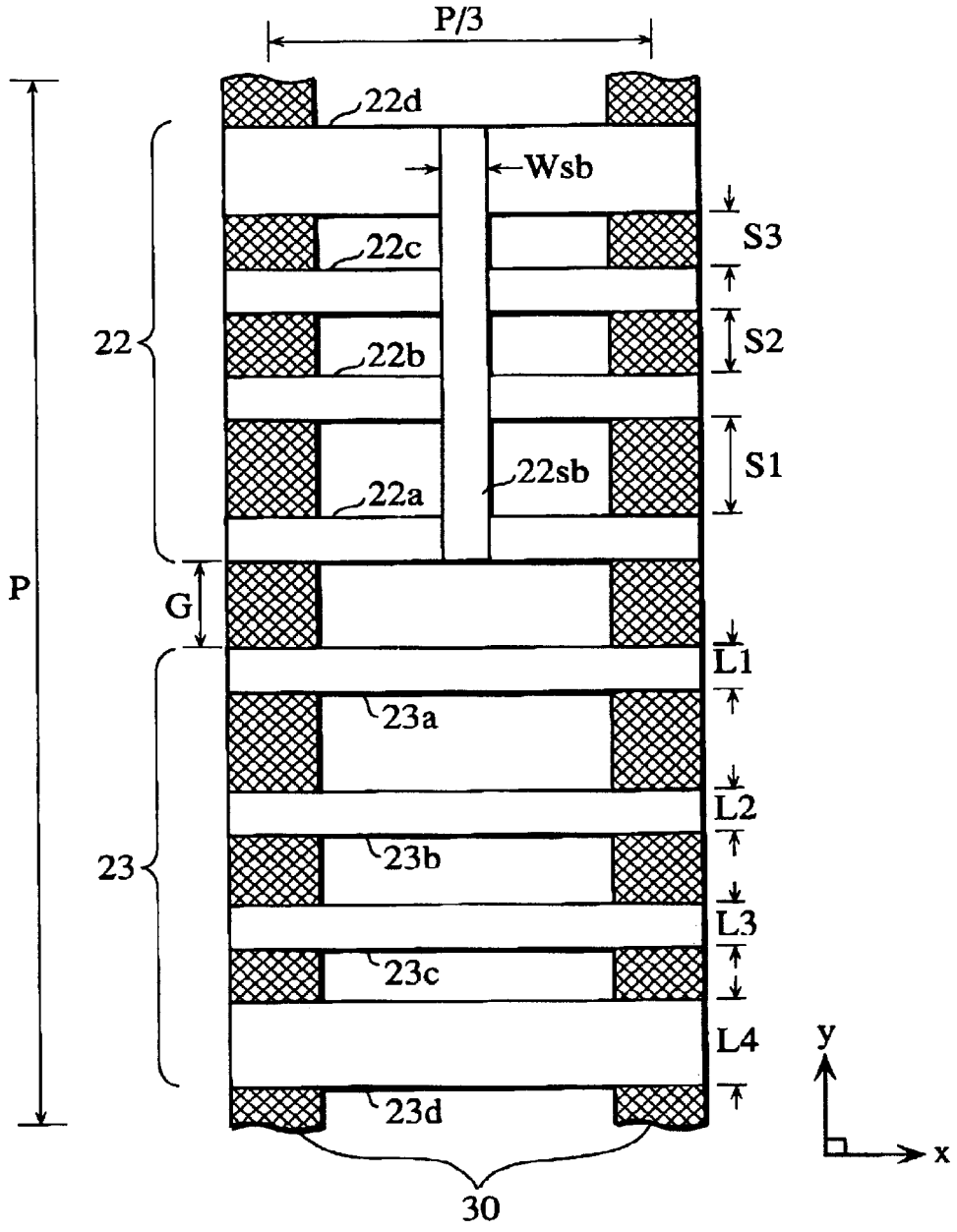
FIG. 25 shows a view from above of the display electrodes according to an embodiment 14.

FIG. 25 is a view from above of the display electrodes according to embodiment 14. In comparison to embodiment 12, short-bars 22*sb* are provided only on scan electrode 22 in the PDP according to embodiment 13. In the given example, cell pitch P is 1.08 mm, main discharge gap G is 80 μm, line part widths $L_1$ to $L_3$ are 40 μm, line part width $L_4$ is 80 μm, first line part gap $S_1$ is 90 μm, second line part gap $S_2$ is 70 μm, third line part gap $S_3$ is 50 μm, and short-bar width $W_{ob}$ is 40 μm.

It is possible for short-bars 22*sb* to be provided on scan electrode 22 in any of the cells R, G, B. According to embodiment 14, short-bars 22*sb* are provided in all of the cells.

In addition to improvements in luminous efficiency, the structure according to embodiment 14 achieves the following.

Generally, in order to uniformize the wall charge in all of the discharge cells in the panel of a PDP, it is necessary to conduct one or more set-up discharges in at least one field prior to the write period in which specific pixels will be selected for illumination. Since all the cells in the panel are illuminated simultaneously during the set-up period (i.e. set-up illumination), it is not possible to reproduce precisely any particular color even black (i.e. because of some cells remaining illuminated) when the PDP is driven, thereby leading to an unsatisfactory contrast ratio. As a result, contrast ratios of only approximately 500:1 have been achieved in prior art PDPs.

In contrast, by providing short-bars 22*sb* on scan electrode 22 according to embodiment 14 it is possible to increase the surface area of scan electrode 22 and thus increase the storage of wall charge on scan electrode 22. Reductions in the discharge initiating voltage result from the increase in wall voltage, thereby making it possible to reduce the power supply to the panel during the set-up discharge period and achieve an excellent display capacity due to the resultant improvements in contrast.

Table 7 shows the way in which the set-up voltage $V_{set}$ and contrast vary depending on the provision or non-provision of short-bars in the PDP according to embodiment 14.

TABLE 7

| | scan elect. short-bar | |
|---|---|---|
| | No | yes |
| Vset [V] | 390 | 370 |
| contrast ratio | 500:1 | 1000:1 |

As shown in table 7, $V_{set}$ is reduced when short-bars are provided on the scan electrode in comparison to when they are not (i.e. embodiment 14). Further, contrast is improved two-fold by providing the short-bars in this manner.

While the various measurements with respect to each of the discharge cells according to embodiment 5 are as given above, the present invention is not limited to these measurements. For example, the same effects can be achieved when 0.5 mm$\leqq$P$\leqq$1.4 mm, 60 $\mu$m$\leqq$G$\leqq$140 $\mu$m, 10 $\mu$m$\leqq L_1$, $L_2$, $L_3 \leqq 60$ $\mu$m, $L_1 \leqq L_4 \leqq 3L_1$, 50 $\mu$m$\leqq S_1 150$ $\mu$m, 40 $\mu$m$\leqq S_2 \leqq 140$ $\mu$m, 30 $\mu$m$\leqq S_3$ $\leqq 130$ $\mu$m, and 10 $\mu$m$\leqq W_{sb} \leqq 100$ $\mu$m.

Embodiment 15

Figure 26:
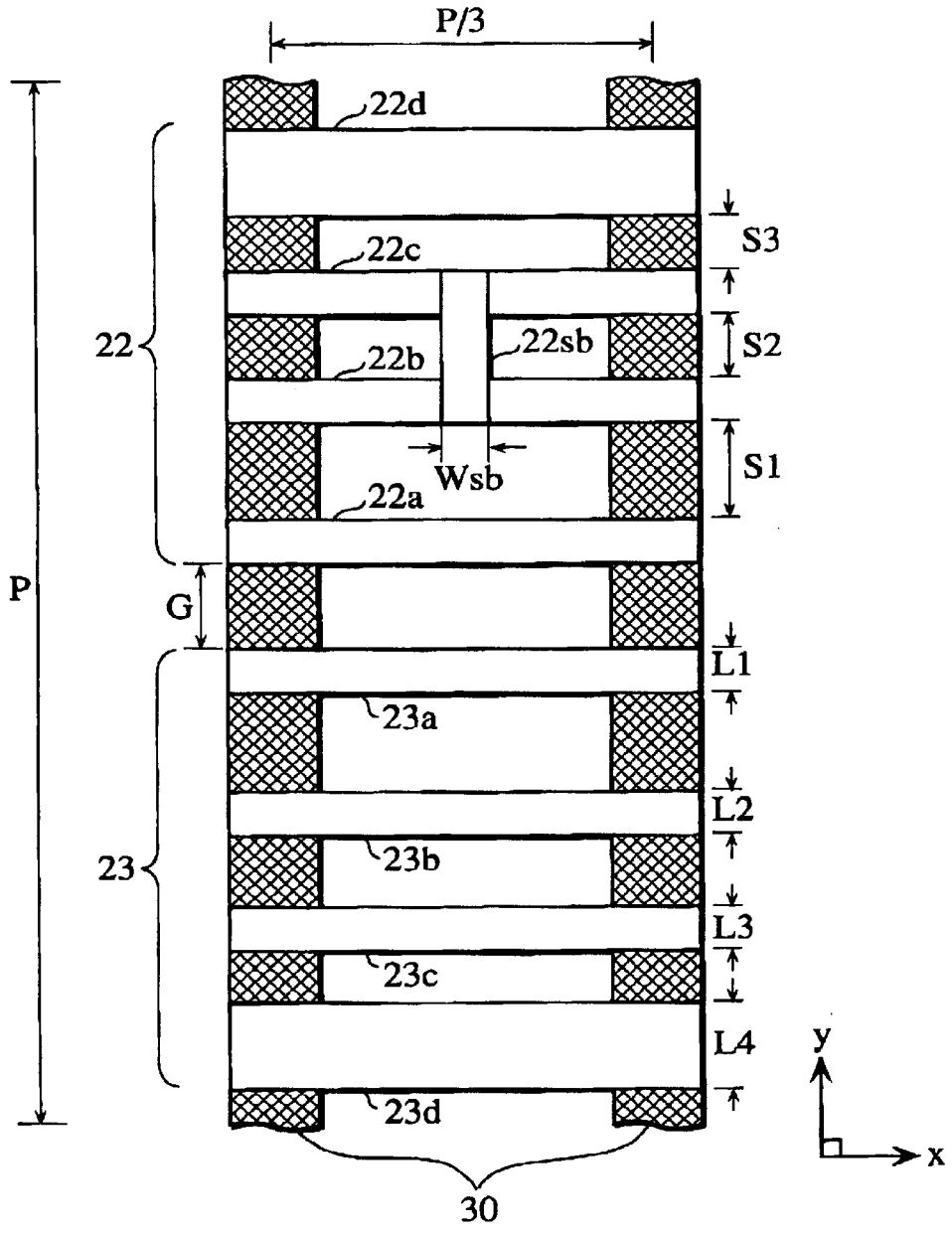
FIG. 26 shows a view from above of the display electrodes according to an embodiment 15.

FIG. 26 is a view from above of the display electrodes according to embodiment 15. In comparison to embodiment 14, short-bars 22*sb* are provided only on a central part of scan electrode 22 (i.e. so as to connect line parts 22*b* and 22*c*) in the PDP according to embodiment 15. In the given example, cell pitch P is 1.08 mm, main discharge gap G is 80 $\mu$m, line part widths $L_1$ to $L_3$ are 40 $\mu$m, line part width $L_4$ is 80 $\mu$m, first line part gap $S_1$ is 90 $\mu$m, second line part gap $S_2$ is 70 $\mu$m, third line part gap $S_3$ is 50 $\mu$m, and short-bar width $W_{sb}$ is 40 $\mu$m.

In addition to substantially the same effects as embodiment 14, the structure according to embodiment 15 achieves the following.

Specifically, by providing short-bars 22*sb* in the central part of scan electrode 22, it is possible to achieve a relatively wide electrode surface area while at the same time maintaining the cell aperture ratio in the vicinity of main discharge gap G, which is the area where the illumination brightness distribution in the cell is highest. As a result, it is possible to achieve excellent panel brightness from a simple display electrode structure consisting of a plurality of lines.

Table 8 shows the way in which the data voltage $V_{data}$ varies depending on the provision or non-provision of short-bars in the PDP according to embodiment 15.

TABLE 8

| | discharge cell | | | | | |
|---|---|---|---|---|---|---|
| | R | G | B | R | G | B |
| short-bar | no | no | no | yes | yes | yes |
| Vdatamin [V] | 54 | 56 | 50 | 42 | 44 | 40 |

As shown in table 8, it is possible to reduce the set-up voltage $V_{set}$ in cells in which short-bars 22*sb* have been provided.

Generally, a start-up velocity of approximately 200V/$\mu$s to 400V/$\mu$s is required in order to apply the address discharge voltage when a PDP is driven. A reactive power $W_{Ld}$ generating from the address discharge is expressed as:

$$W_{Ld}=Cp\ V_{data}^2\ f$$

($V_{data}$: address discharge voltage; Cp: panel capacitance; f: write frequency)

Reactive power $W_{Ld}$ thus equals data voltage $V_{data}$ squared. According to embodiment 15, it is therefore possible to reduce the address discharge voltage by 20% in comparison to existing levels, and ultimately, to reduce reactive power $W_{Ld}$ by approximately 36% in comparison to existing levels.

While the various measurements with respect to each of the discharge cells according to embodiment 5 are as given above, the present invention is not limited to these measurements. For example, the same effects can be achieved when 0.5 mm$\leqq$P$\leqq$1.4 mm, 60 $\mu$m$\leqq$G$\leqq$140 $\mu$m, 10 $\mu$m$\leqq L_1$, $L_2$, $L_3 \leqq 60$ $\mu$m, $L_1 \leqq L_4 \leqq 3L_1$, 50 $\mu$m$\leqq S_1 \leqq 150$ $\mu$m, 40 $\mu$m$\leqq S_2 \leqq 140$ $\mu$m, 30 $\mu$m$\leqq S_3 \leqq 130$ $\mu$m, and 10 $\mu$m$\leqq W_{sb} \leqq 100$ $\mu$m.

Although short-bars 22*sb* according to embodiment 15 are provided in a central part of scan electrode 22 (i.e. between line parts 22*b* and 22*c*), it is possible to provide the short-bars in other structures, such as between line parts 22*c* and 22*d*, for instance.

Embodiment 16

Figure 27:
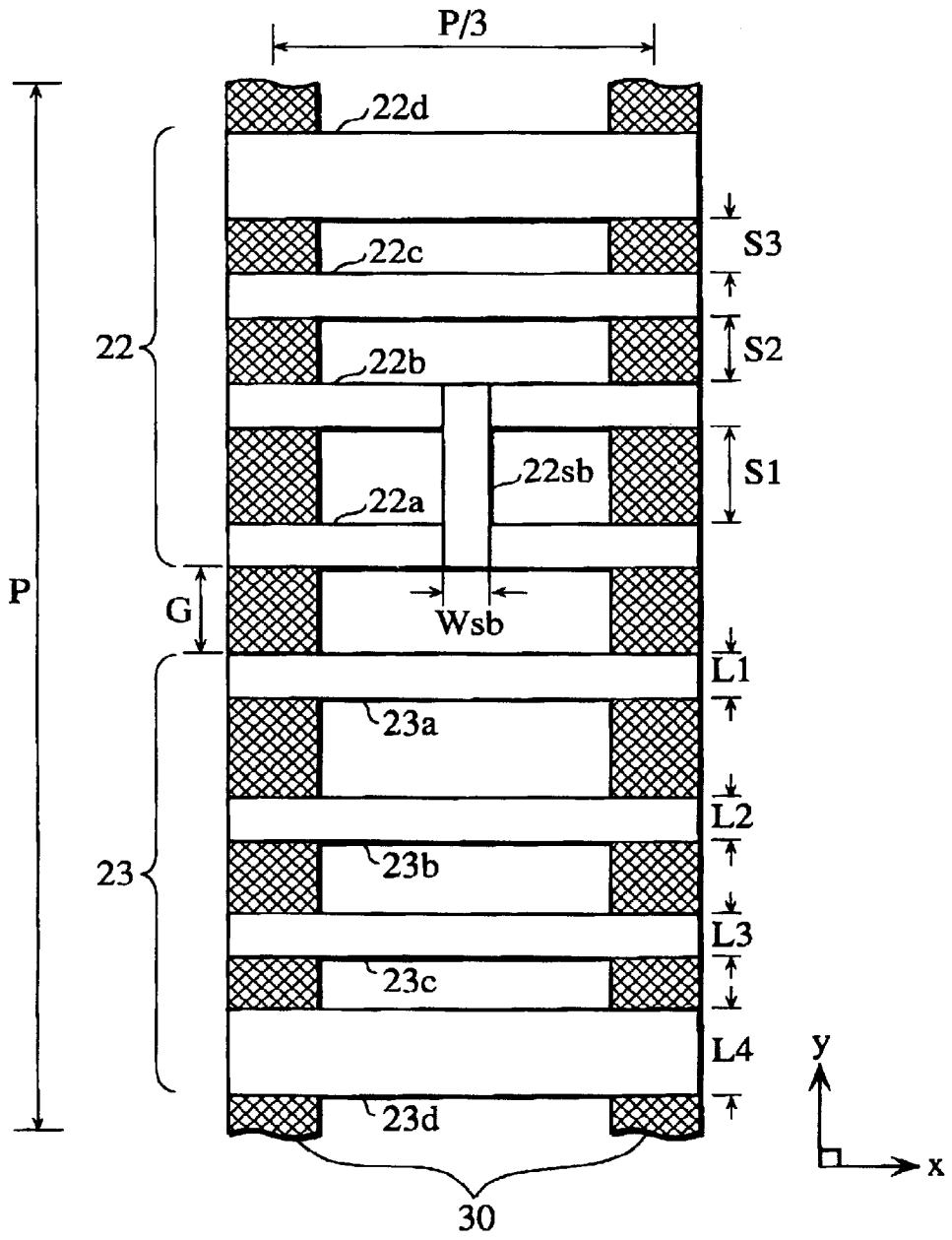
FIG. 27 shows a view from above of the display electrodes according to an embodiment 16.

FIG. 27 is a view from above of the display electrodes according to embodiment 16. In comparison to embodiment 15, short-bars 22*sb* are provided only between the line parts 22*a* and 22*b* of scan electrodes 22. In the given example, cell pitch P is 1.08 mm, main discharge gap G is 80 $\mu$m, line part widths $L_1$ to $L_3$ are 40 $\mu$m, line part width $L_4$ is 80 $\mu$m, first line part gap $S_1$ is 90 $\mu$m, second line part gap $S_2$ is 70 $\mu$m, third line part gap $S_3$ is 50 $\mu$m, and short-bar width $W_{sb}$ is 40 $\mu$m.

In addition to substantially the same effects as embodiment 14, the structure according to embodiment 16 achieves the following.

Specifically, by providing short-bars 22*sb* so as to connect line parts 22*a* and 22*b*, it is possible to increase the amount of wall charge and the wall voltage in the vicinity of main discharge gap G, thereby making it easier to generate the set-up discharge and the address discharge due to the resultant reductions in $V_{set}$ and $V_{data}$. Furthermore, because of the amelioration of set-up discharge failure and address discharge failure as a result of the reductions in $V_{set}$ and $V_{data}$, the drive margin is widened and $V_{sus}$ is reduced. Thus it is possible to suppress power consumption is a favorable manner.

Table 5 shows the way in which $V_{set}$, $V_{sus}$, and $V_{data}$ vary depending on the provision or non-provision of short-bars in the PDP according to embodiment 16.

TABLE 9

| | short-bar | |
|---|---|---|
| | no | yes |
| Vset [V] | 390 | 370 |
| Vsus [V] | 185 | 175 |
| Vdata [V] | 65 | 55 |

As shown in table 9, it is possible to reduce $V_{set}$, $V_{sus}$, and $V_{data}$, and therefore the drive voltage, when short-bars are provided on the scan electrode near the main discharge gap, in comparison to when short-bars are not provided.

While the various measurements with respect to each of the discharge cells according to embodiment 5 are as given above, the present invention is not limited to these measurements. For example, the same effects can be achieved when 0.5 mm≦P≦1.4 mm, 60 μm≦G≦140 μm, 10 μm≦$L_1$, $L_2$, $L_3$≦60 μm, $L_1$≦$L_4$≦3$L_1$, 50 μm≦$S_1$≦150 μm, 40 μm≦$S_2$≦140 μm, 30 μm≦$S_3$≦130 μm, and 10 μm≦$W_{sb}$≦100 μm.

Also, in embodiment 16, it is preferable to provide short-bars 22*sb* in all of the cells R, G, B, and to arrange the widths of the various short-bars SbR, SbG, and SbB such that SbR≦SbG≦SbB. That is, by increasing the surface area of the R cell and G cell in comparison to the B cell, it is possible reduce (i) the statistical delay period Ts during the address discharge and (ii) the discharge delay differential between each of the cells R, G, B.

Embodiment 17

17-1 Structure of the Display Electrodes

Figure 28:
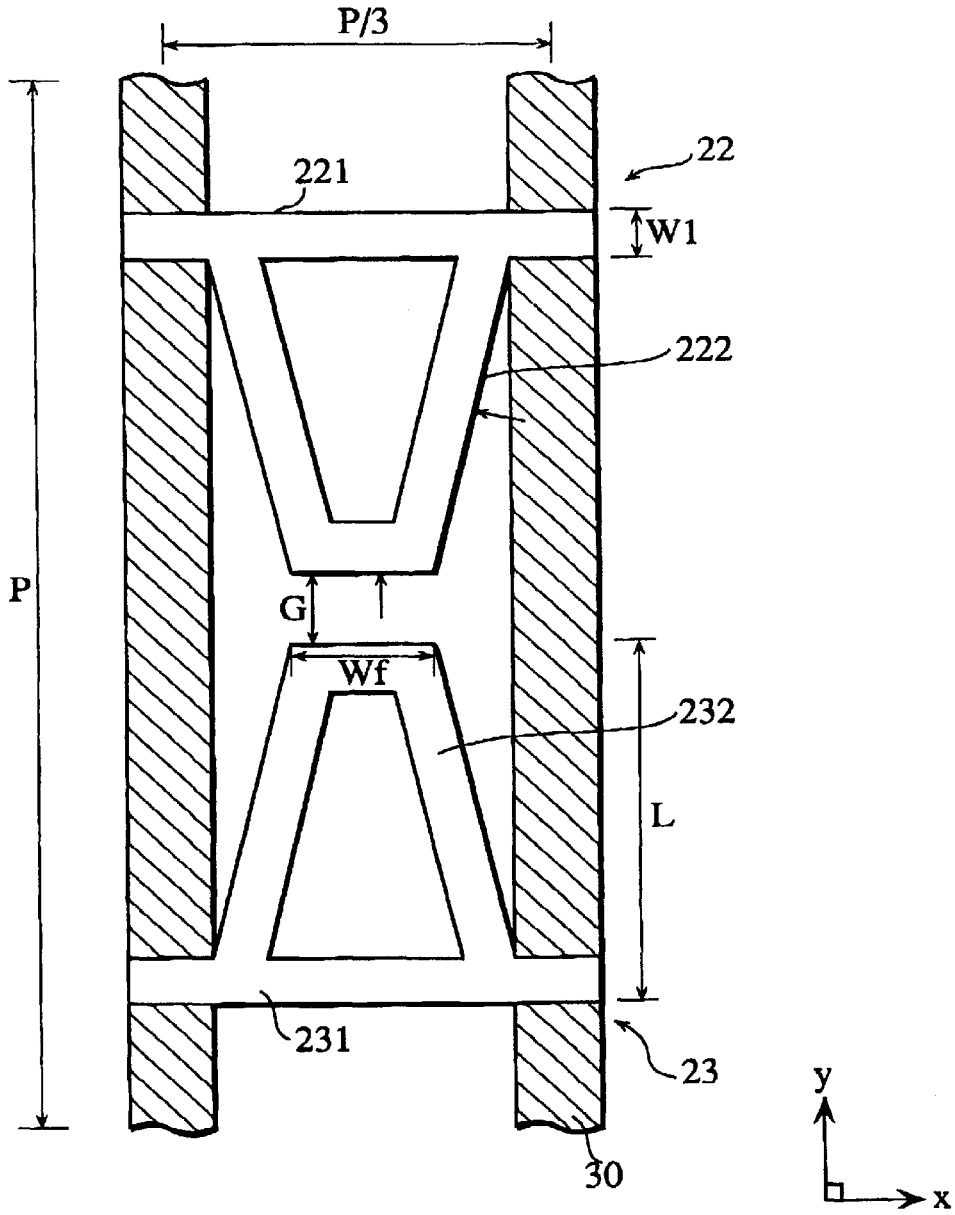
FIG. 28 shows a view from above of the display electrodes according to an embodiment 17.

FIG. 28 is a view from above of the display electrodes according to embodiment 17. The electrode structure in the PDP according to embodiment 17 is very different to that of embodiments 1 to 16. Specifically, display electrode 22 (23) is composed of line part 221 (231) and inner protrusion part 222 (232), which is electrically connected to the edge of part 221 (231) facing main discharge gap G. Inner protrusion parts 222 and 232 are each formed as a trapezium with the central area removed, the top end of each trapezium lying parallel to the other. In the given example, cell pitch P is 1.08 mm, the barrier rib pitch is ⅓ of cell pitch P. electrode length L is 0.37 mm, and $W_f$ is 220 μm. Also, in order to reduce the line resistance of display electrodes 22 and 23, inner protrusion part width $W_2$≦line part width $W_1$.

This structure of the display electrodes allows for a single-peaked discharge current waveform and excellent luminous efficiency when the PDP is driven.

17-2 Effects of Embodiment 17

The above structure allows for substantially the same effects as embodiment 1. In other words, owing to the relatively thin protrusion parts 222 and 232, it is possible to initiate a discharge between parts 222 and 232 with little capacitance, and to subsequently expand the magnitude of the discharge to the gap between line parts 221 and 231. It thus becomes possible to achieve excellent power reductions as a result of being able to suppress the discharge initiating voltage.

In addition, it is possible for the discharge illumination generated by a single drive pulse to be completed in 1 μm because of the discharge current waveform generated by display electrodes 22 and 23 having a single peak. Also, because the discharge delay period is short at approximately 0.2 μs, a high driving speed of a few μs and a high image quality can be achieved.

Figure 29:
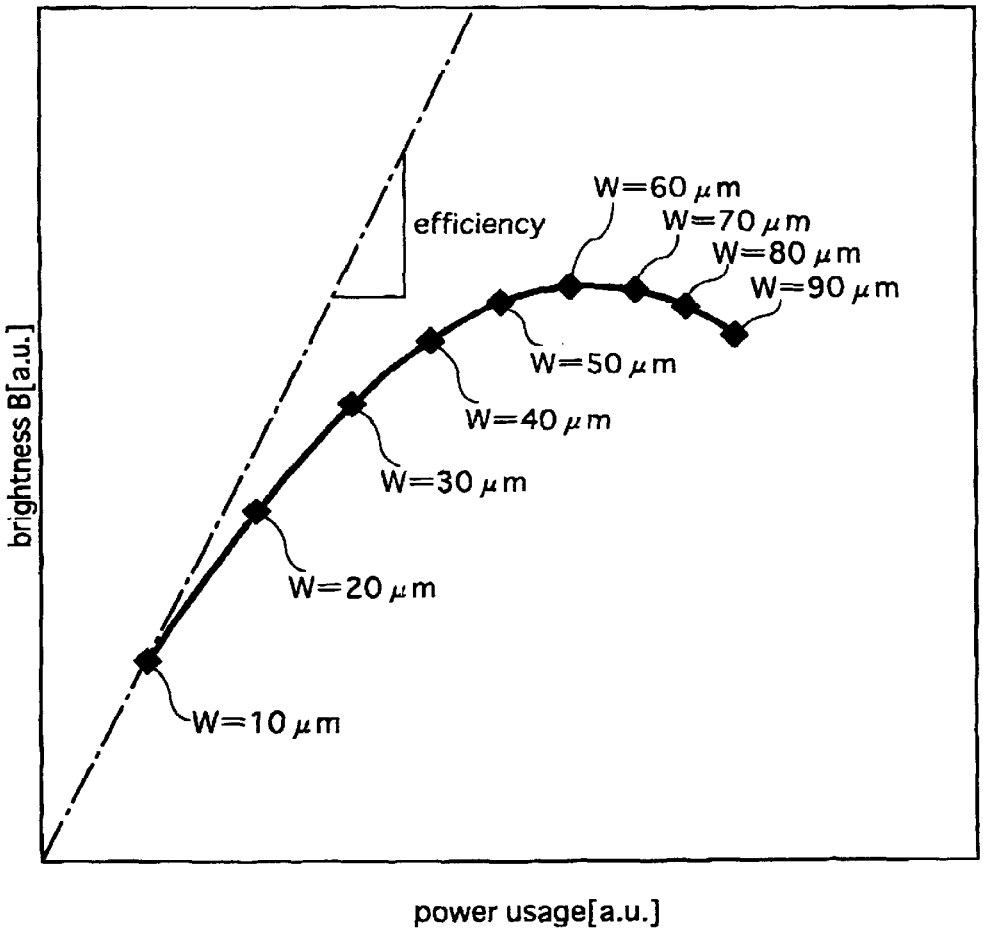
FIG. 29 is a graph showing a relationship between a display electrode surface area and brightness when $W_1=W_2$ in the PDP according to embodiment 17.

FIG. 29 is a graph showing the relationship between the surface area of the display electrodes and brightness when $W_1$=$W_2$ in the PDP according to embodiment 17. As shown in FIG. 29, at electrode widths of 40 μm and below, brightness levels fall as a result of the decrease in discharge current related to the reduced electrode surface area. Brightness levels also begin to fall at electrode widths of 80 μm and greater as a result of the decrease in the cell aperture rate related to the enlarged electrode surface area. Thus, panel brightness is optimized at electrode widths (i.e. the respective widths of the fine parts and the inner protrusion parts) of 40 μm to 80 μm. Luminous efficiency, on the other hand, is shown by the slope of the unevenly-broken straight line in FIG. 29. As shown in FIG. 29, luminous efficiency is optimized at narrower electrode widths. Thus, in the actual manufacture of the PDP, it is preferable for the electrode widths to be such that 40 μm≦$W_1$≦80 μm and 10 μm≦$W_2$≦40 μm.

While the various measurements with respect to each of the discharge cells according to embodiment 17 are as given above, the present invention is not limited to these measurements. For example, the same effects can be achieved when 0.9 mm≦P≦0.4 mm, 0.05 mm≦L<0.4 mm, and 0.08 mm≦$W_f$≦0.4 mm.

Additionally, it is preferable to arrange protrusion parts 222 and 232 so that their perimeter edges in the y direction are positioned close to barrier ribs 30, as this makes it possible to use the wall charge on phosphor layers 31 to 33 near barrier ribs 30 to expand the magnitude of the discharge. This structure can also be applied to embodiments 18 to 24 below.

Embodiment 18

Figure 30:
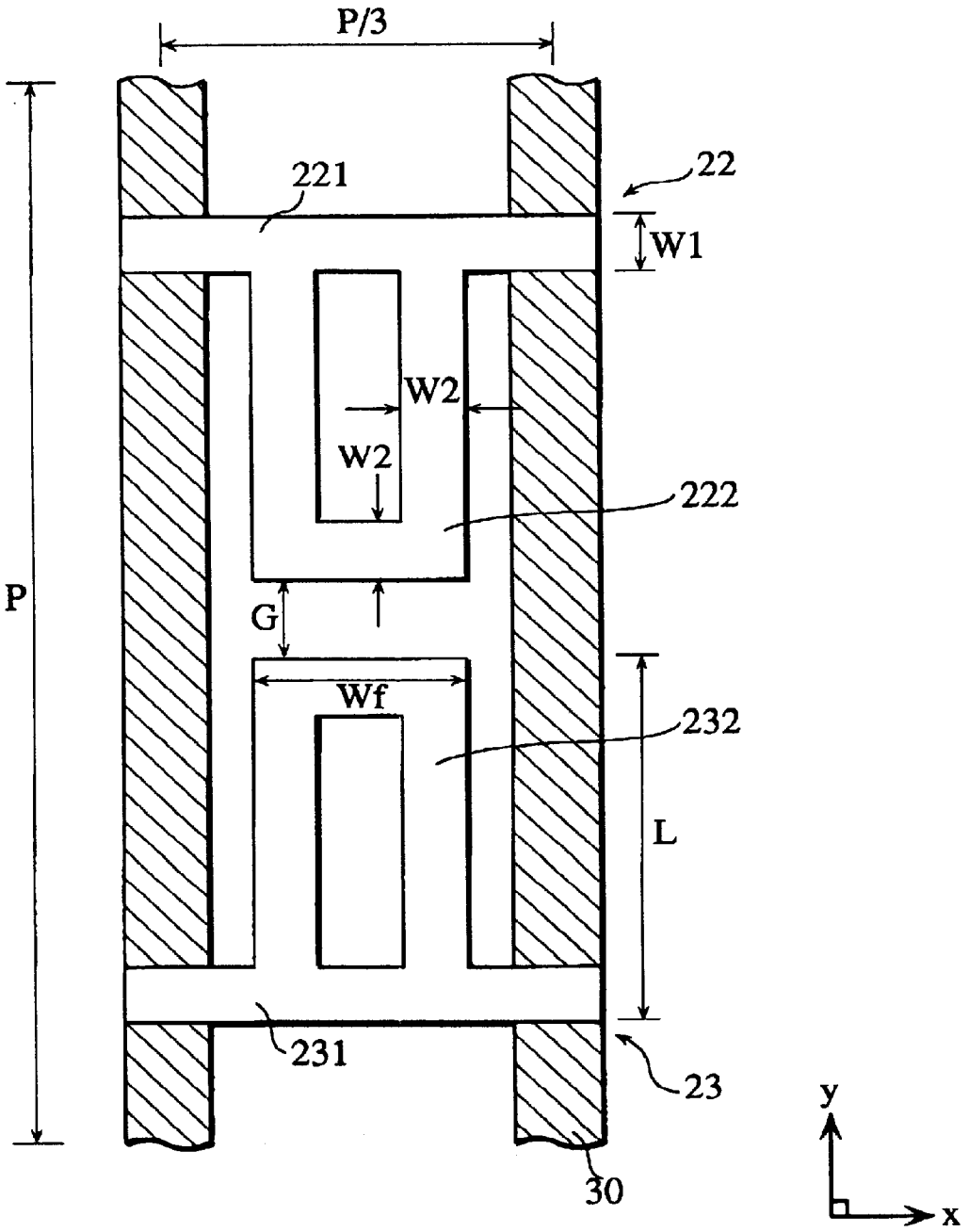
FIG. 30 shows a view from above of the display electrodes according to an embodiment 18.

FIG. 30 is a view from above of the display electrodes according to embodiment 18. Embodiment 18 differs from embodiment 17 in that protrusions 222 and 232 are formed as rectangles. For the same reasons given in embodiment 17, the electrode width according to embodiment 18 is such that $W_2$≦$W_1$.

In addition to substantially the same effects as in embodiment 17, embodiment 18 achieves the following.

Figure 31:
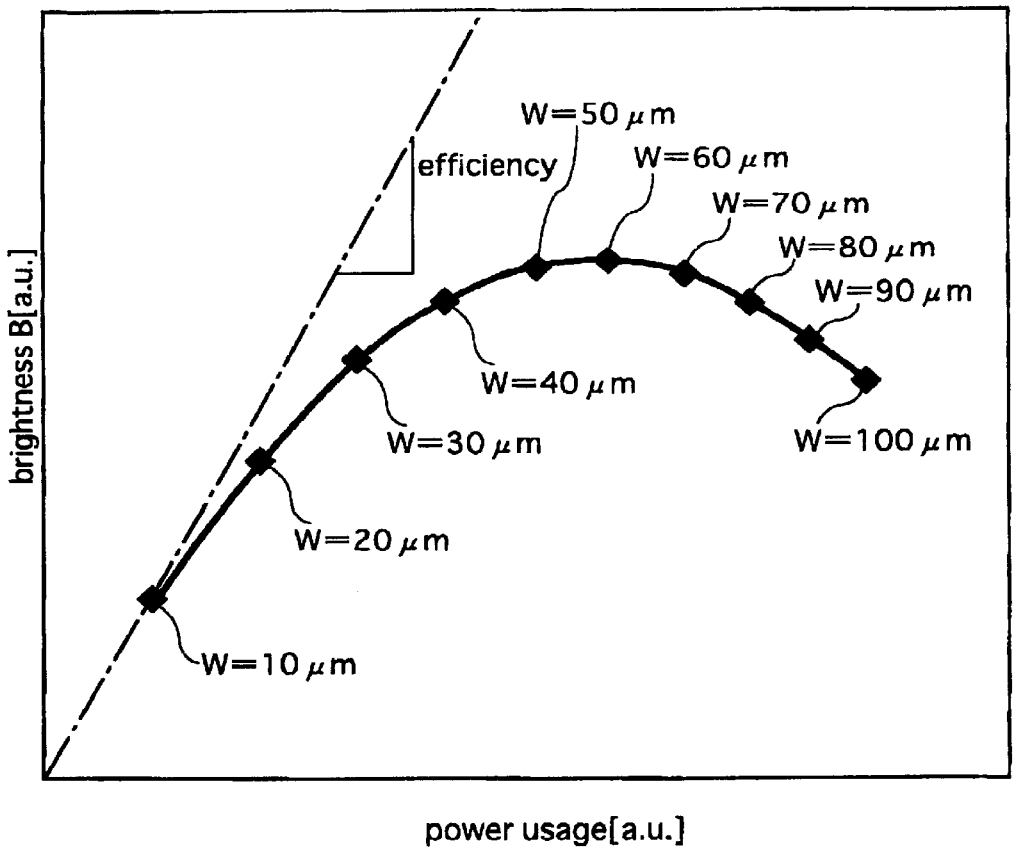
FIG. 31 is a graph showing the relationship between the display electrode surface area and brightness when $W_1=W_2$ in the PDP according to embodiment 18.

FIG. 31 is a graph showing the relationship between the surface area of the display electrodes and brightness when $W_1$=$W_2$ in the PDP according to embodiment 18 As shown in FIG. 31, at electrode widths of 40 μm and below, brightness levels fall as a result of the decrease in discharge current related to the reduced electrode surface area. Brightness levels also begin to fall at electrode widths of 70 μm and above as a result of the decrease in the cell aperture rate related to the enlarged electrode surface area. Thus, panel brightness is optimized at electrode widths of 40 μm to 70 μm with respect to embodiment 18. On the other hand, luminous efficiency, which is shown by the slope of the unevenly-broken straight line in FIG. 31, is optimized at narrower electrode widths. Thus, in the actual manufacture of the PDP, it is preferable for the electrode widths to be such that 40 μm≦$W_1$≦70 μm and 10 μm≦$W_2$≦40 μm.

In the given example cell pitch P is 1.08 mm, the barrier rib pitch is ⅓ of cell pitch P, electrode length L is 0.37 mm, and the total width (x direction) $W_f$ of the inner protrusion parts is 220 μm. The present invention is, however, not limited to these measurements, and the same effects can be achieved, for example, when 0. 9 mm≦P≦1.4 mm, 0. 05 mm≦L<0.4 mm, and 0.08 mm≦$W_f$≦0.4 mm.

Embodiment 19

Figure 32A:
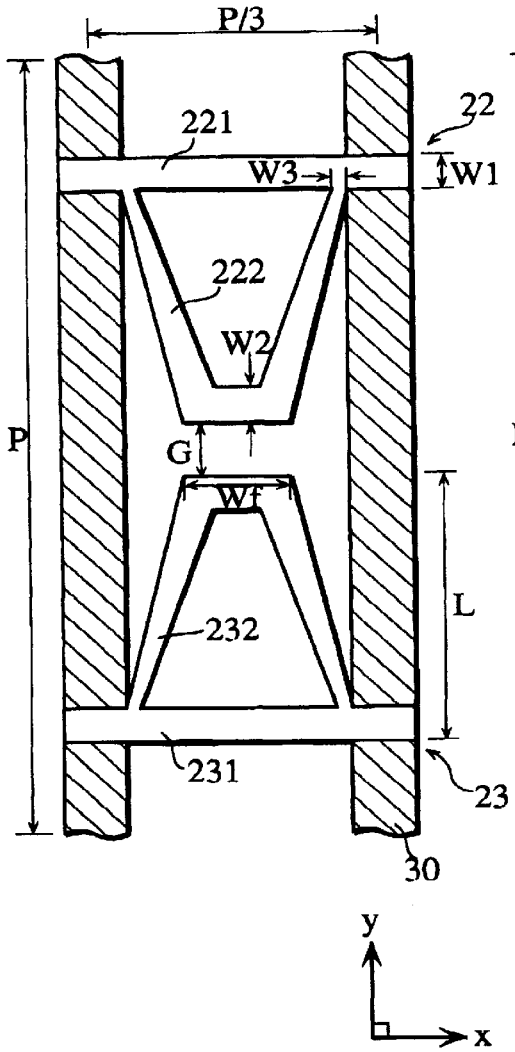
FIG. 32 shows a view from above of the display electrodes according to an embodiment 19.
Figure 32B:
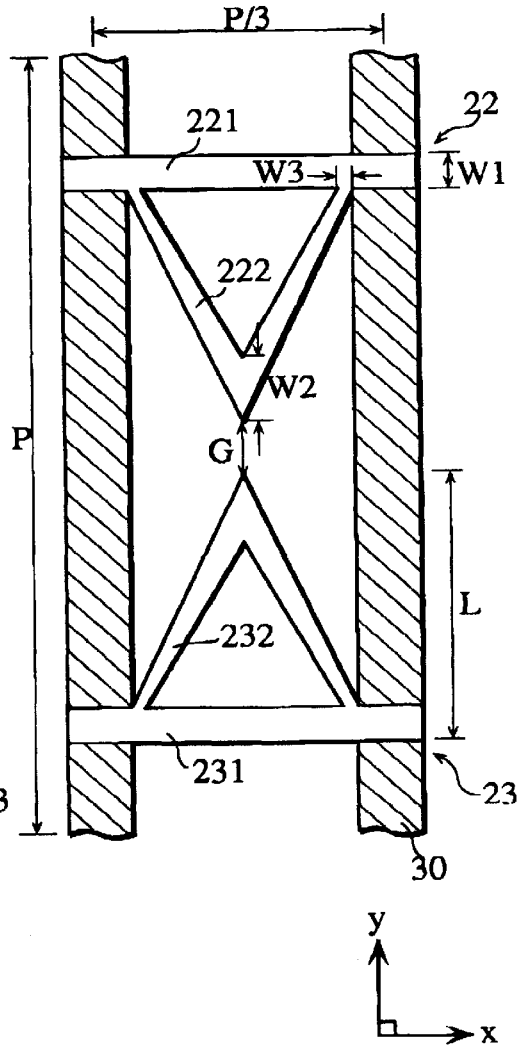

FIGS. 32*a* and 32*b* show a view from above of the display electrodes according to embodiment 19 In FIG. 32*a*, display electrodes 22 and 23 have trapezoid-shaped protrusion parts, and in FIG. 32*b*, display electrodes 22 and 23 have triangular-shaped protrusion parts. In comparison to embodiment 17, the protrusion parts $W_2$ and $W_3$ decreases in width as the distance from main discharge gap G increases.

In addition to substantially the same effects as in embodiment 17, embodiment 19 achieves the following.

Specifically, because of being able to secure sufficient capacitance in the wide section $W_2$ of protrusion part 222 arid 232 when the PDP is driven, it is possible to achieve an excellent discharge magnitude by relying on the tendency of the discharge plasma to expand out along the discharge electrode (i.e. the display electrode in the given example) after the smooth generation of a discharge in the vicinity of main discharge gap G, even when the width $W_3$ is relatively narrow. The discharge plasma is drawn along the narrow section $W_3$ of the protrusion part to the vicinity of barrier ribs 30 which are coated with phosphors, thereby suppressing any reduction in the density of the plasma. As a result, it is possible to maintain the required capacitance below existing levels, and thus reduce the power consumption of the PDP.

Figure 33:
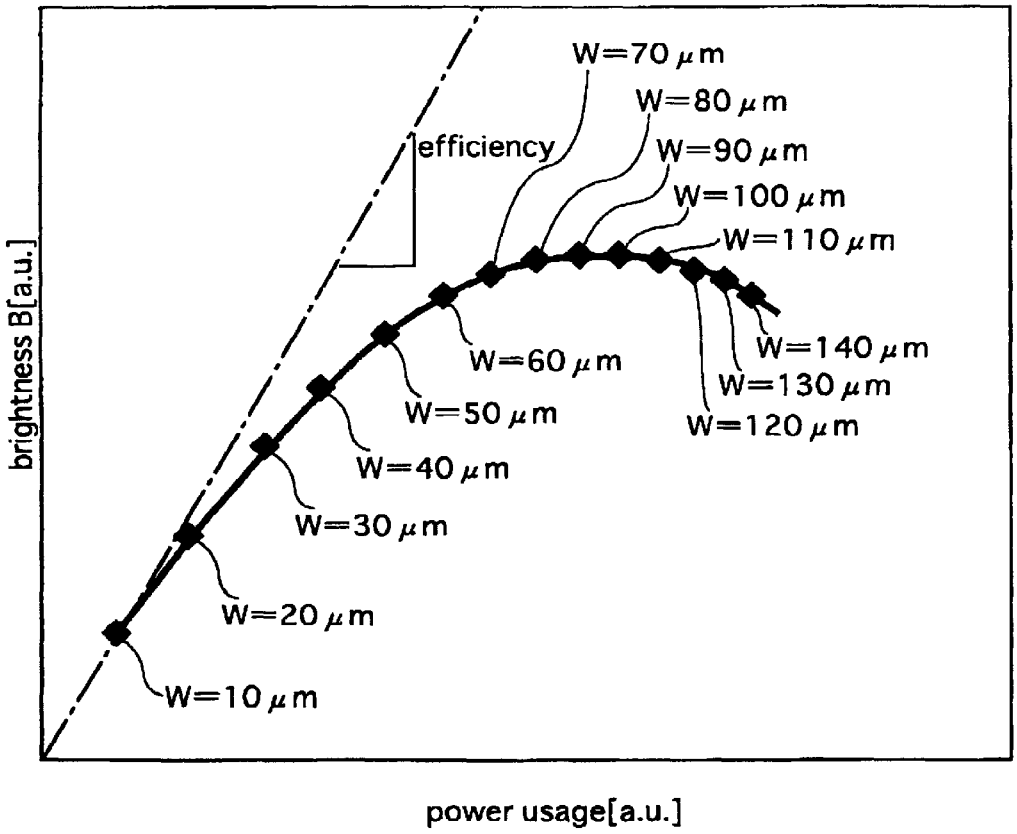
FIG. 33 is a graph showing the relationship between the display electrode surface area and brightness when $W_1=W_2$ in the PDP according to embodiment 19.

FIG. 33 is a graph showing the relationship between the surface area of the display electrodes and brightness when $W_1=W_2$ in the PDP according to embodiment 19. As shown in FIG. 33, at electrode widths of 50 $\mu$m and below, brightness levels fall as a result of the decrease in discharge current related to the reduced electrode surface area. Brightness levels also begin to fall at electrode widths of 120 $\mu$m and greater as a result of the decrease in the cell aperture rate related to the enlarged electrode surface area. Thus, panel brightness is optimized at electrode widths of 50 $\mu$m to 120 $\mu$m with respect to embodiment 19. On the other hand, luminous efficiency, which is shown by the slope of the unevenly-broken straight line in FIG. 33, is optimized at narrower electrode widths. Thus, it is preferable for the electrode widths to be such that $50\ \mu m \leqq W_1 \leqq 120\ \mu m$ and $10\ \mu m \leqq W_2 \leqq 50\ \mu m$. Also, it is preferable for $W_3$ to be such that $10\ \mu m \leqq W_3 \leqq 40\ \mu m$.

Embodiment 20

Figure 34A:
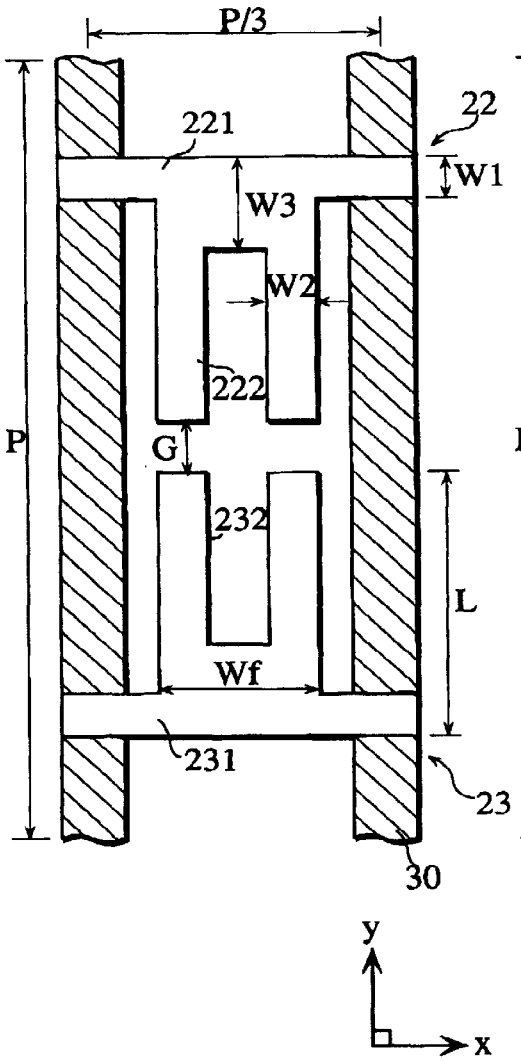
FIG. 34 shows a view from above of the display electrodes according to an embodiment 20.
Figure 34B:
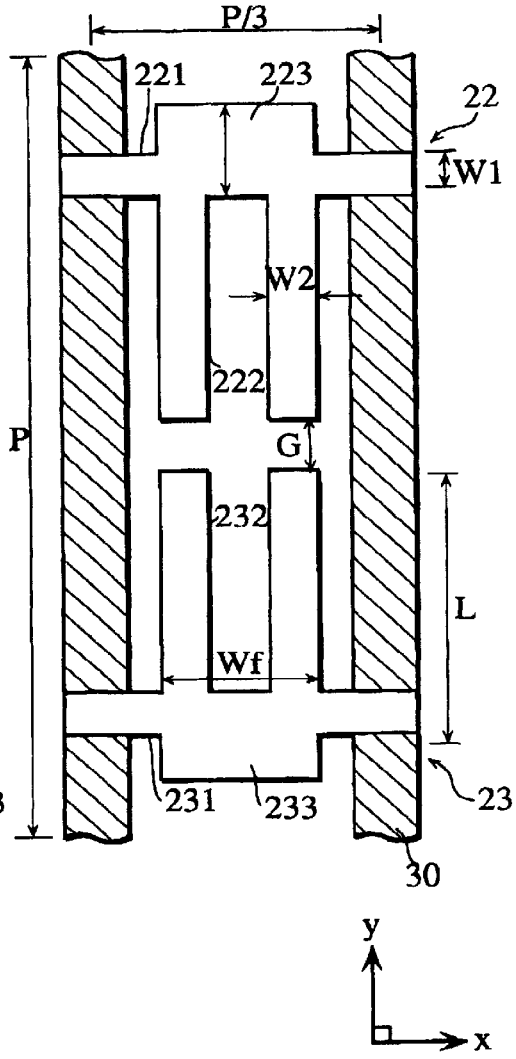

FIGS. 34*a* and 34*b* show a view from above of the display electrodes according to embodiment 20. As shown in FIGS. 34*a* and 34*b*, display electrodes 22 and 23 include line parts 221 and 231 and band-shaped inner protrusion parts 222 and 232, which extend in the y direction. Each display electrode 22 (23) in a cell has two inner protrusion parts 222 (232). In embodiment 20, the electrode widths are such that $W_2 \leqq W_1$, and the effects are substantially the same as in embodiment 17.

The example shown in FIG. 34*a* is characterized by the fact that a width $W_3$ of line part 221 (231) between the two inner protrusion parts 222 (232) has been widened. This has the effect of improving the contrast ratio, because the widened section $W_3$ of line part 221 (231) shelters the set-up illumination when the PDP is driven, while at the same time reducing the electrical resistance of line part 221 (231).

In the example shown in FIG. 34*b*, display electrodes 22 and 23 include outer protrusion parts 223 and 233. This structure allows the magnitude of the discharge to expand to the outside of line parts 221 and 231 when the PDP is driven.

Figure 35:
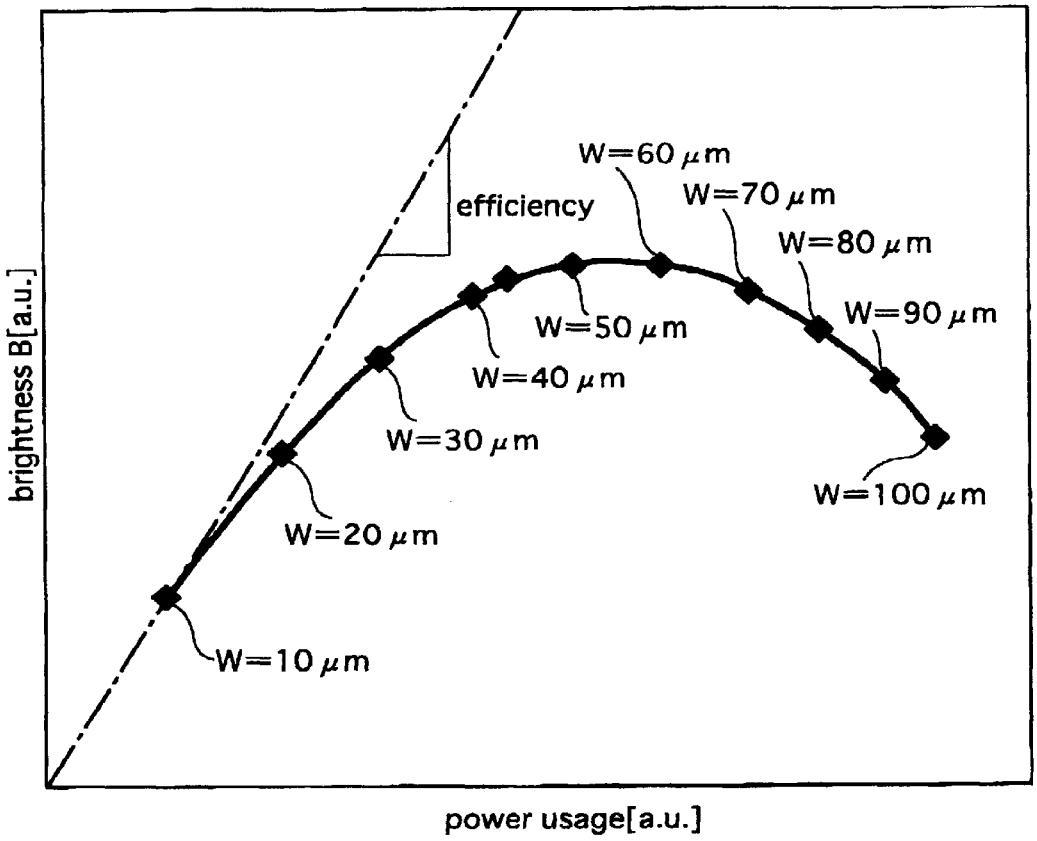
FIG. 35 is a graph showing the relationship between the display electrode surface area and brightness when $W_1=W_2$ in the PDP according to embodiment 20.

FIG. 35 is a graph showing the relationship between the surface area of the display electrodes and brightness when $W_1=W_2$ in the PDP according to embodiment 20. As shown in FIG. 35, at electrode widths of 40 $\mu$m and below, brightness levels fall as a result of the decrease in discharge current related to the reduced electrode surface area. Brightness levels also begin to fall at electrode widths of 70 $\mu$m and greater as a result of the decrease in the cell aperture rate related to the enlarged electrode surface area. Thus, panel brightness is optimized at electrode widths of 40 $\mu$m to 70 $\mu$m with respect to embodiment 20. On the other hand, luminous efficiency, which is shown by the slope of the unevenly-broken straight line in FIG. 35, is optimized at narrower electrode widths. Thus, it is preferable for the electrode widths to be such that $40\ \mu m \leqq W_1 \leqq 70\ \mu m$ and $10\ \mu m \leqq W_2 \leqq 70\ \mu m$.

Figure 36:
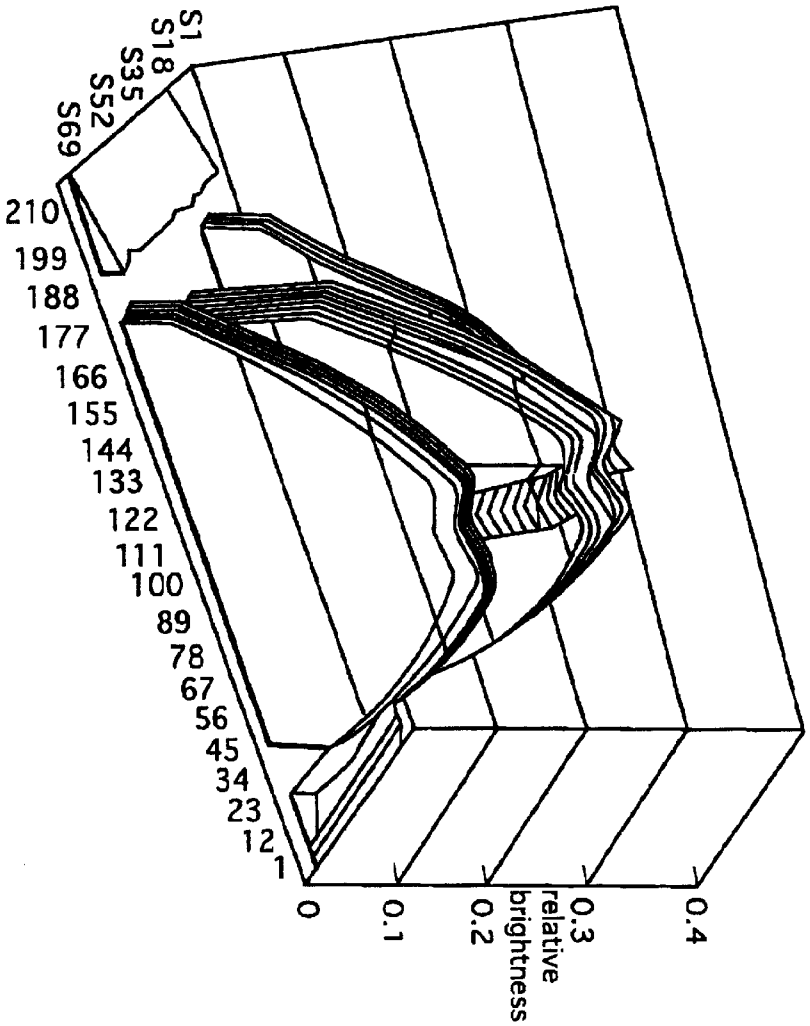
FIG. 36 is a graph showing a result of a test calculation of brightness distribution across cells according to embodiment 20.

FIG. 36 is a graph showing the results of a test calculation of brightness distribution across cells according to embodiment 20. Brightness distribution, defined as the visible light emitting from the aperture of a cell, was calculated as follows Each electrode in a cell was divided into a number of parts, each part being assigned an integral brightness distribution value proportionate to its respective surface area The various distribution values were then summed, giving a brightness distribution with respect to each cell.

As shown in FIG. 36, it is the central part of a cell that has the highest brightness, since this is where the plasma is generated (i.e. the discharge initiating part of the cell close to main discharge gap G) and expands out toward the perimeter of the cell. Thus it is possible for the PDP having band-shaped inner protrusion parts 222 and 232 as per embodiment 20 to achieve excellent panel brightness and luminous efficiency as a result of the cell aperture being secured along the part of the cell in which the plasma is generated and expands.

Table 10 compares the panel brightness and luminous efficiencies of embodiments 17 and 20.

TABLE 10

| | W1 [$\mu$m] | W2 [$\mu$m] | W3 [$\mu$m] | brightness B [cd/m$^2$] | rel. luminous efficiency [$\eta$] |
|---|---|---|---|---|---|
| embodiment 17 | 60 | 40 | — | 450 | 1.0 |
| embodiment 20 | 60 | 40 | 120 | 495 | 1.1 |

As shown in table 10, it is possible to realize a PDP having excellent brightness according to embodiment 20. This effect is gained as a result of the display electrode structure that combines inner protrusion parts 222, 232 and outer protrusion parts 223, 233.

In the given example cell pitch P is 1.08 mm, the barrier rib pitch is ⅓ of cell pitch P, electrode length L is 0.37 mm, and the total width (x direction) $W_f$ of the inner protrusion parts is 220 $\mu$m. The present invention is, however, not limited to these measurements, and the same effects can be achieved, for example, when $0.9\ \mu mm \leqq P \leqq 1.4$ mm, $0.05\ mm \leqq L < 0.4$ mm, and $0.08\ mm \leqq W_f \leqq 0.4$ mm.

Embodiment 21

Figure 37A:
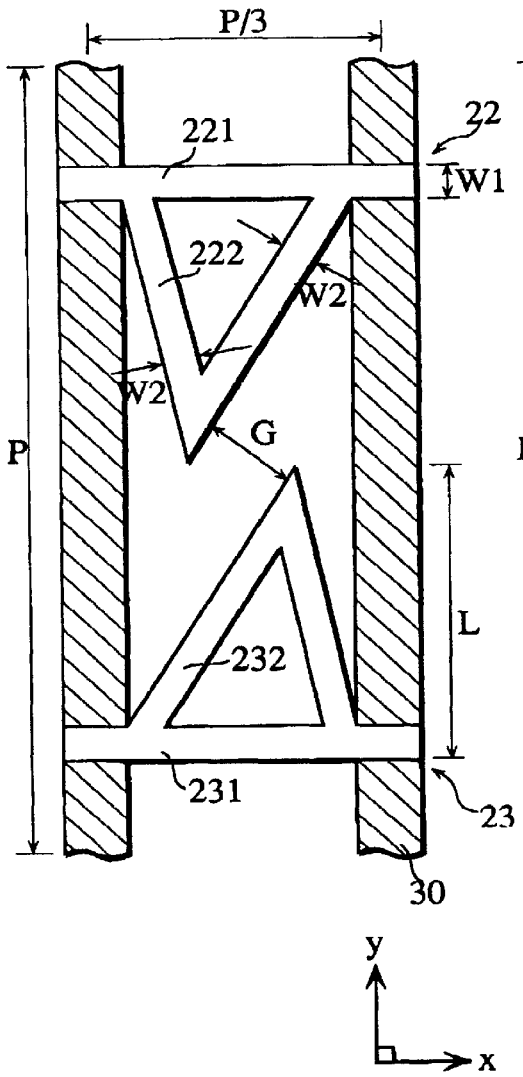
FIG. 37 shows a view from above of the display electrodes according to an embodiment 21.
Figure 37B:
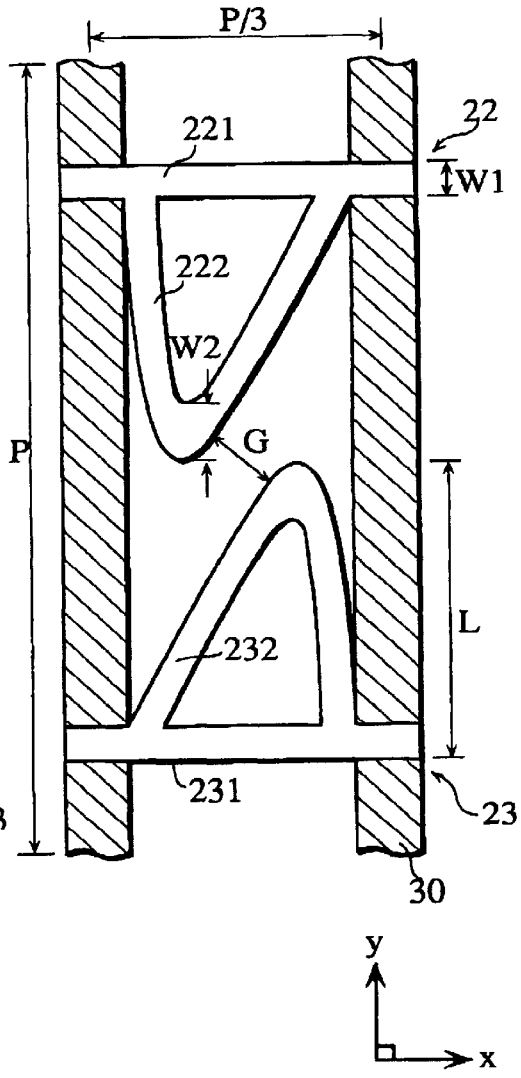

FIGS. 37*a* and 37*b* show a view from above of the display electrodes according to embodiment 21. In comparison to embodiment 17, inner protrusion parts 222 and 232 are formed as in a pointed triangular shape (FIG. 37*a*) or in a rounded triangular shape (FIG. 37*b*). Further, the opposing tips of each of inner protrusion parts 222 and 232 are out of alignment, such that parts 222 and 232 in each cell are point symmetrical to each other with respect to the center of the cell. By arranging the tips of parts 222 and 232 so as to be out of alignment, it is possible to provide comparatively large display electrodes for a given cell size. Panel brightness can thus be improved because the distance traveled by the discharge plasma (i.e. discharge magnitude) is lengthened (i.e. enlarged), resulting in the excitation of a large area of the phosphor surface.

In addition to substantially the same effects as in embodiment 17, embodiment 21 achieves the following.

Figure 38:
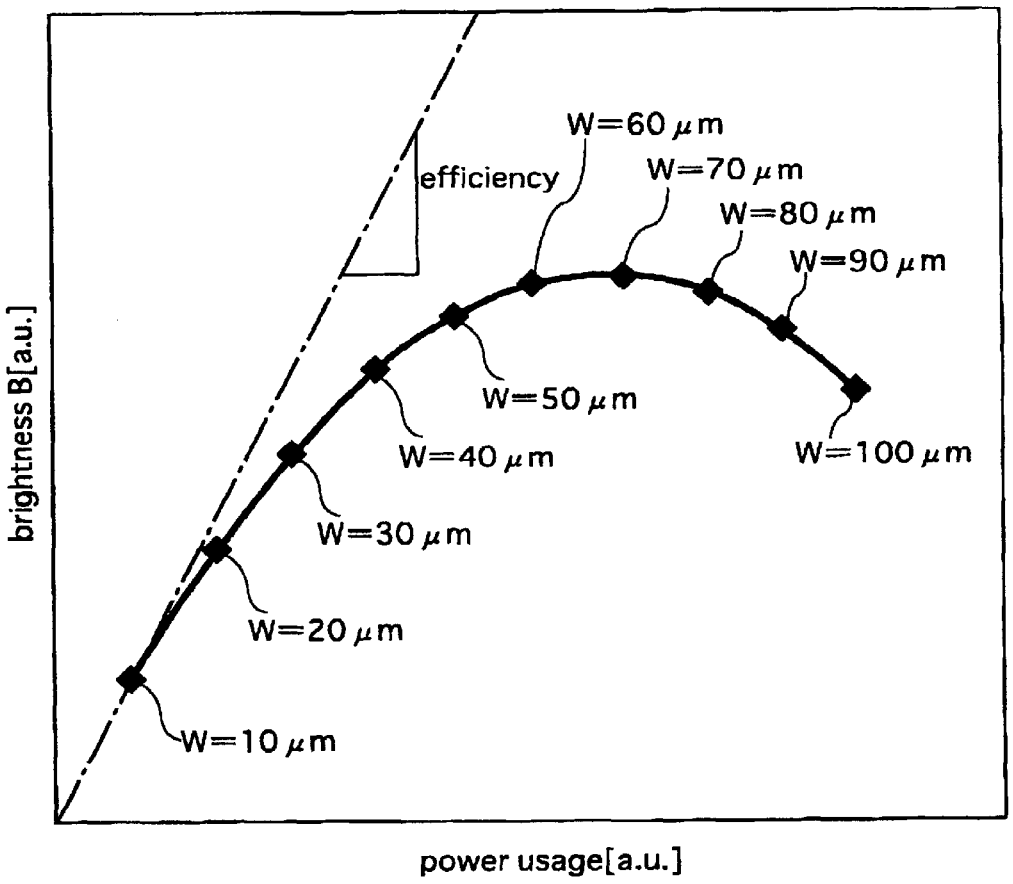
FIG. 38 is a graph showing the relationship between the display electrode surface area and panel brightness when $W_1=W_2$ in the PDP according to embodiment 21.

FIG. 38 is a graph showing the relationship between the surface area of the display electrodes and panel brightness when $W_1=W_2$ in the PDP according to embodiment 21. As shown in FIG. 38, at electrode widths of 50 μm and below, brightness levels fall as a result of the decrease in discharge current related to the reduced electrode surface area. Brightness levels also begin to fall at electrode widths of 80 μm and greater as a result of the decrease in the cell aperture rate related to the enlarged electrode surface area. Thus, panel brightness is optimized at electrode widths of 50 μm to 80 μm with respect to embodiment 21. On the other hand, luminous efficiency, which is shown by the slope of the unevenly-broken straight line in FIG. 38, is optimized at narrower electrode widths. Thus, it is preferable for the electrode widths to be such that 50 μm$\leqq W_1$80 μm and 10 μm $\leqq W_2 \leqq$50 μm.

Table 11 compares the panel brightness and luminous efficiencies of embodiments 17 and 21.

TABLE 11

| | W1 [μm] | W2 [μm] | brightness B [cd/m²] | rel. luminous efficiency [η] |
|---|---|---|---|---|
| embodiment 17 | 60 | 40 | 450 | 1.0 |
| embodiment 21 | 60 | 40 | 480 | 1.1 |

As shown in table 11, according to embodiment 21 it is possible to realize a PDP having excellent brightness and luminous efficiency in comparison to embodiment 17.

In the given example cell pitch P is 1.08 mm, the barrier rib pitch is ⅓ of cell pitch P, electrode length L is 0.37 mm, and the total width (x direction) $W_f$ of the inner protrusion parts is 220 μm. The present invention is, however, not limited to these measurements, and the same effects can be achieved, for example, when 0.9 mm$\leqq$P$\leqq$1.4 mm, 0.05 mm$\leqq$L<0.4 mm, and 0. 08 mm$\leqq W_f \leqq$0.4 mm.

Embodiment 22

Figure 39A:
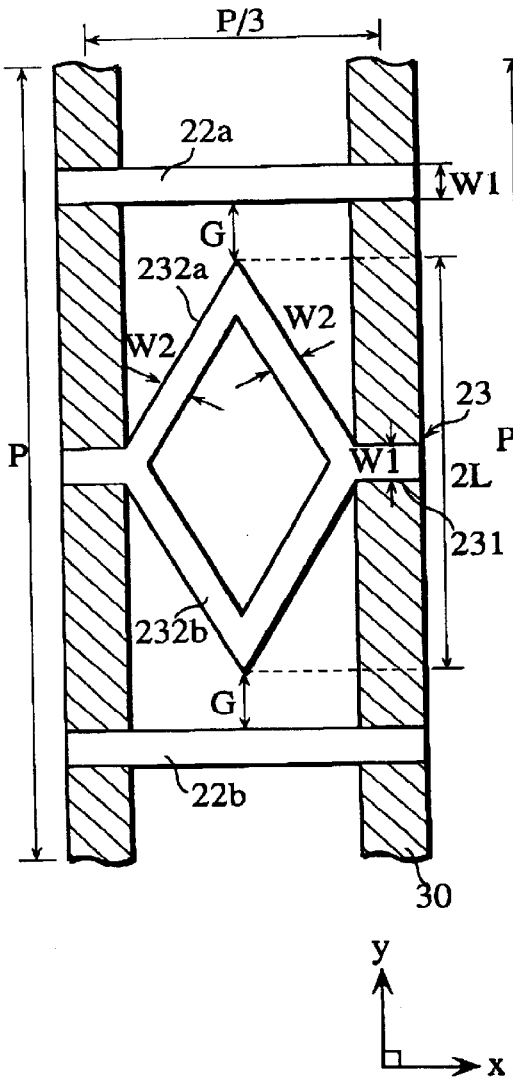
FIG. 39 shows a view from above of the display electrodes according to an embodiment 22.
Figure 39B:
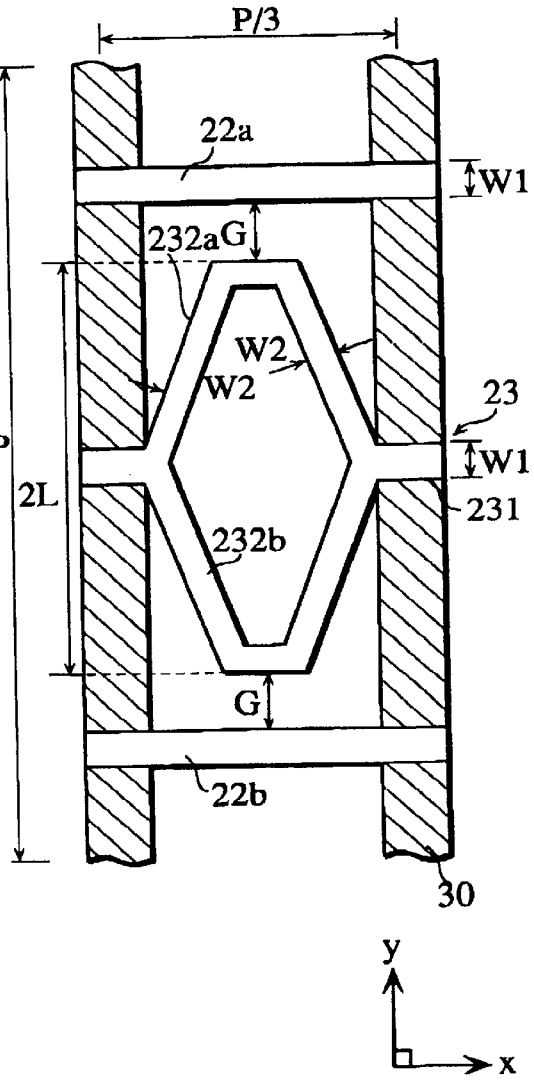

FIGS. 39*a* and 39*b* show a view from above of the display electrodes according to embodiment 22. As shown in FIGS. 39*a* and 39*b*, sustain electrode 23 includes line part 231 and protrusion parts 232*a* and 232*b*, the parts 232*a* and 232*b* being provided above and below line part 231 in a diamond shape (FIG. 39*a*) or in an irregular hexagon shape (FIG. 39*b*). Scan electrode 22 includes line parts 22*a* and 22*b*, which are arranged to face protrusion parts 232*a* and 232*b*, respectively.

By configuring the electrodes according to embodiment 22, it thus becomes possible to achieve two main discharge gaps in each cell. Also, by establishing the width $W_1$ of line parts 22*a*, 22*b*, and 231 to be narrower than the width $W_2$ of protrusion parts 232*a* and 232*b*, it is possible to reduce the capacitance of line parts 22*a*, 22*b*, and 231.

In addition to substantially the same effects as in embodiment 17, embodiment 22 achieves the following.

Table 12 compares data relating to the display electrodes and panel brightness, etc, of embodiments 17 and 22.

TABLE 12

| | W1 [μm] | W2 [μm] | brightness B [cd/m²] | rel. luminous efficiency [η] |
|---|---|---|---|---|
| embodiment 17 | 60 | 40 | 450 | 1.0 |
| embodiment 22 | 60 | 40 | 500 | 1.1 |

As shown in table 11, according to embodiment 22 it is possible to realize a PDP having a higher brightness and luminous efficiency than embodiment 17. The sustain discharge is initiated in the region close to main discharge gap G when the PDP is driven, and as well known, it is this region that has the highest illumination brightness. Thus by providing two main discharge gaps G as per embodiment 22, it is possible to achieve excellent panel brightness.

Although in embodiment 22, the display electrodes are arranged such that sustain electrode 23 is sandwiched between line parts 22*a* and 22*b* of scan electrode 22, it is possible to reverse this structure so that scan electrode 22 is sandwiched between line parts 22*a* and 22*b* of sustain electrode 23.

Embodiment 23

Figure 40A:
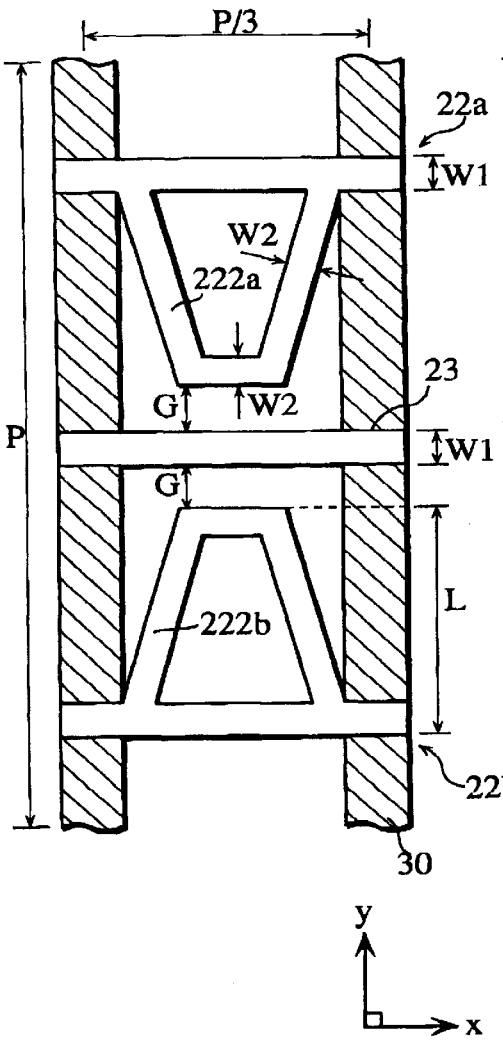
FIG. 40 shows a view from above of the display electrodes according to an embodiment 23.
Figure 40B:
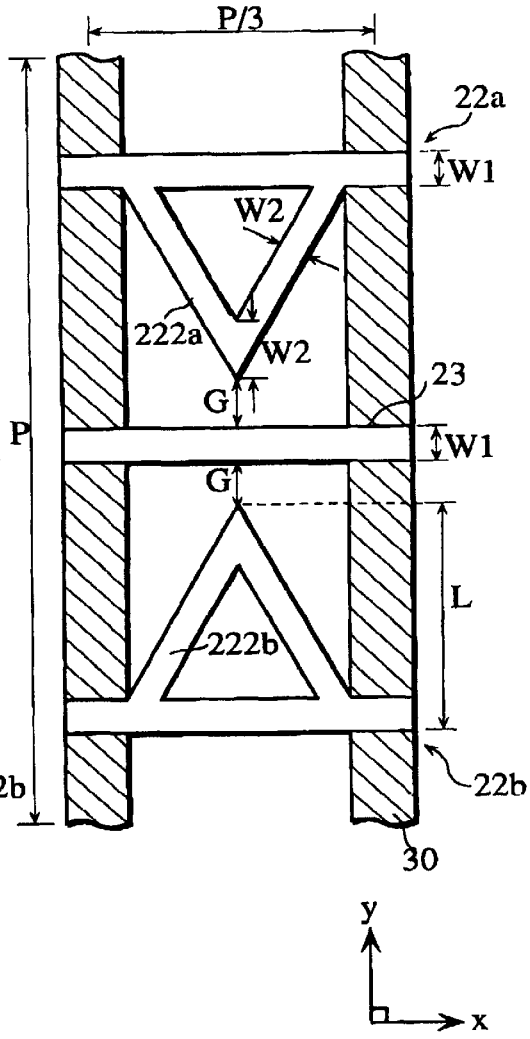

FIGS. 40*a* and 40*b* show a view from above of the display electrodes according to embodiment 23. In comparison to embodiment 22, scan electrode 22 includes line parts 22*a* and 22*b*, and sustain electrode 23 is sandwiched between parts 22*a* and 22*b*. Scan electrode 22 also includes protrusion parts 222*a* and 222*b*, which extend toward sustain electrode 23 from line parts 22*a* and 22*b*, respectively. Protrusion parts 222*a* and 222*b* may be formed in a trapezoid shape (FIG. 40*a*) or in a triangular shape (FIG. 40*b*). By forming the display electrodes in this manner it is possible to secure two main discharge gaps G in each cell.

This structure of the display electrodes is employed for the following reasons.

Specifically, in recent years, the inventors involved in the design of the present invention have being using methods such as space-time analysis estimation to conduct detailed studies into the expansion process of plasma when a discharge is generated in a cell of an AC PDP. Experimentation has shown that, with respect to an electrode structure consisting of a pair of display electrodes 22 and 23 provided on the same surface of a plate, discharge plasma is generated at the anode-side display electrode facing main discharge gap G, and then the glow expands toward the cathode-side display electrode, until finally the discharge has spread throughout the entire cell. The experiments have also shown that an illumination spot is generated on the anode-side display electrode, and that this spot remains substantially unchanged for the duration of the discharge.

Embodiment 23 takes advantage of this characteristic of the discharge. Specifically, in a central part of the cell are provided two main discharge gaps G from which to initiate sustain discharges having excellent brightness. The discharges generated at the two gaps G then gradually expand along protrusion parts 222*a* and 222*b* until they reach line parts 22*a* and 22*b*.

In addition to substantially the same effects as in embodiment 17, embodiment 23 achieves the following.

Table 13 compares the display capacity (i.e. panel brightness, luminous efficiency, etc) in the PDPs according to embodiments 17, 22, and 23.

TABLE 13

| | W1 [μm] | W2 [μm] | brightness B [cd/m²] | rel. luminous efficiency [η] |
|---|---|---|---|---|
| embodiment 17 | 60 | 40 | 450 | 1.0 |
| embodiment 22 | 60 | 40 | 500 | 1.1 |
| embodiment 23 | 60 | 40 | 540 | 1.2 |

As shown in table 13, embodiment 23 is able to achieve excellent panel brightness and luminous efficiency in comparison to embodiments 17 and 22.

As with embodiment 22, it is also possible to reverse the arrangement of scan electrode 22 and sustain electrode 23 while maintaining the same electrode structure.

Embodiment 24

Figure 41A:
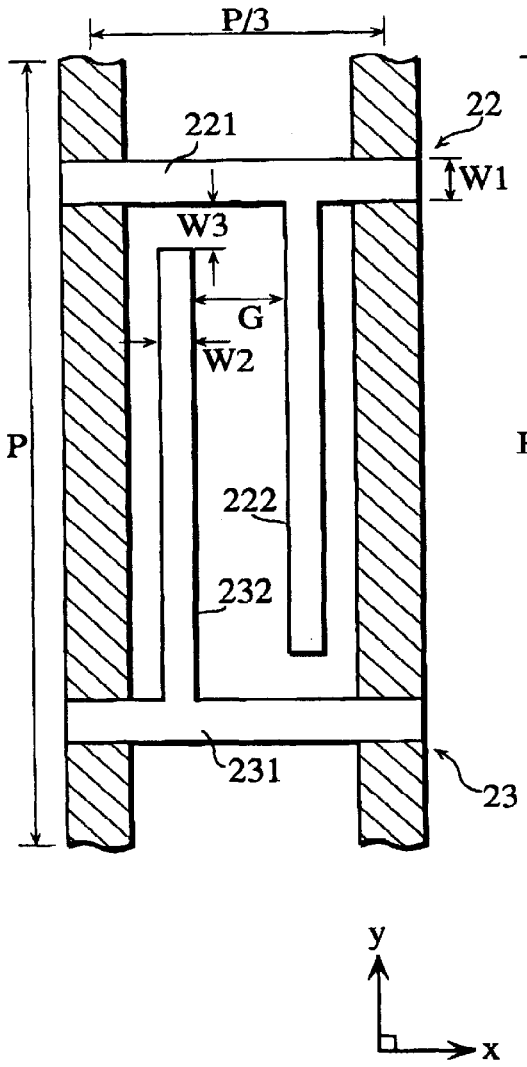
FIG. 41 shows a view from above of the display electrodes according to an embodiment 24.
Figure 41B:
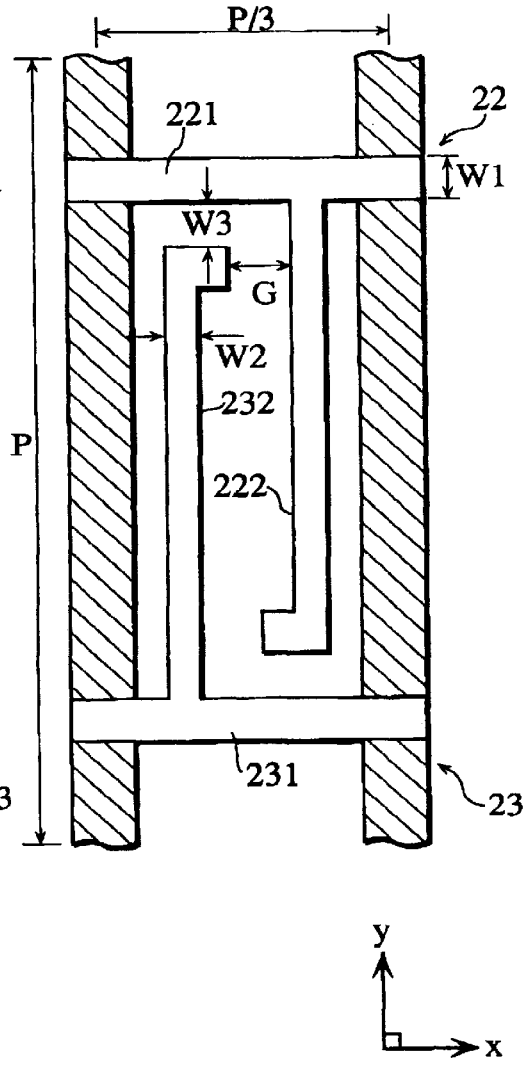
Figure 42:
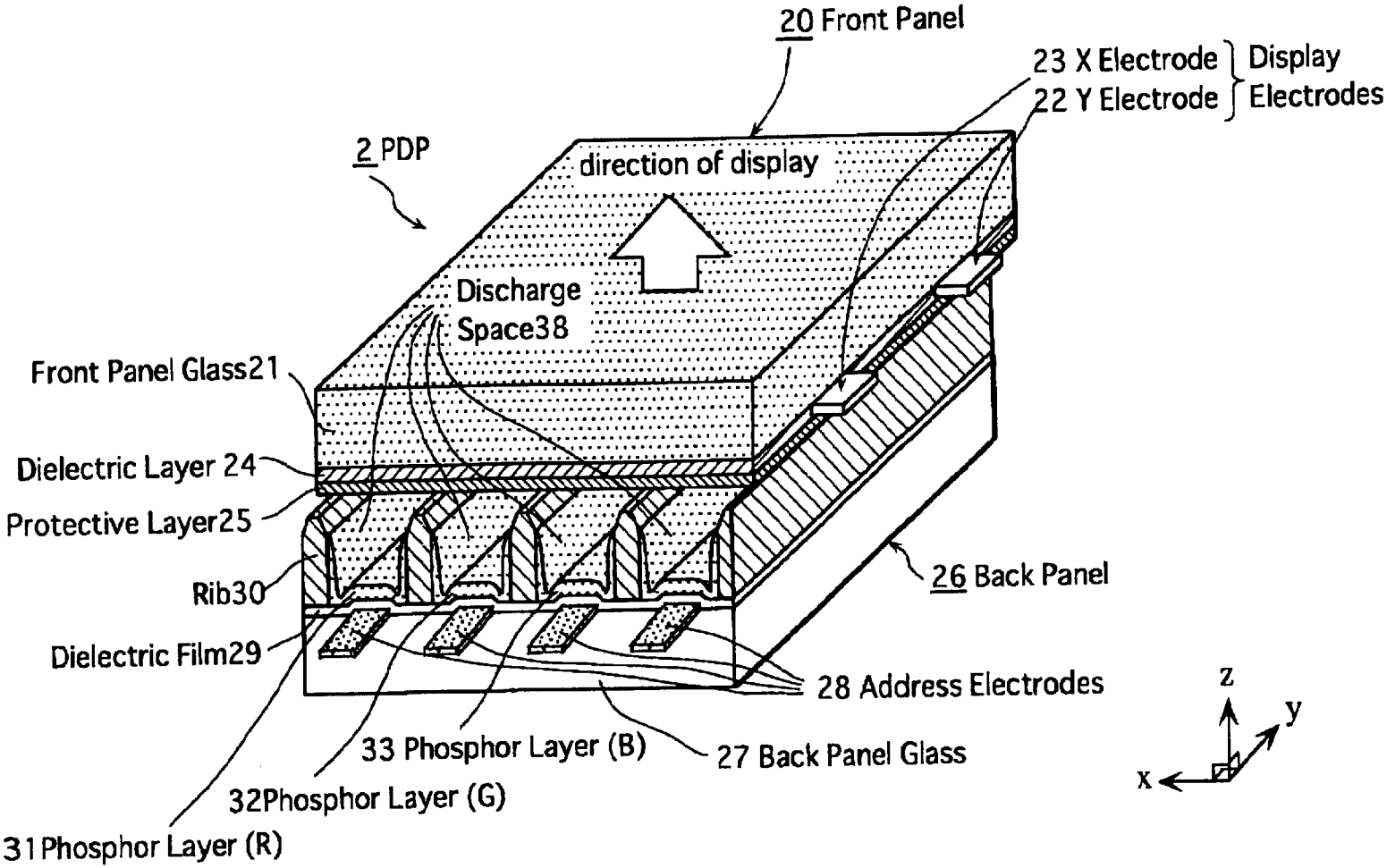
FIG. 42 is a cross-sectional view of a main section of a known surface discharge AC PDP.
Figure 43:
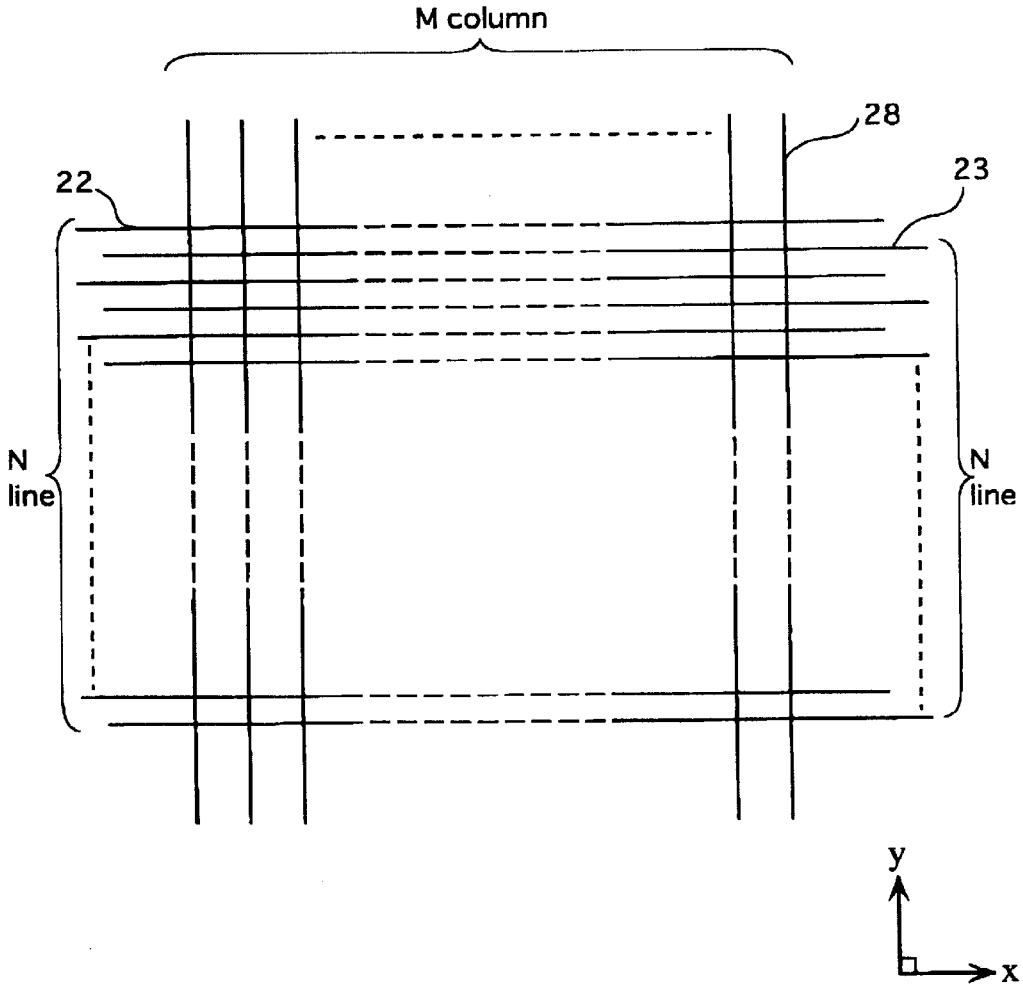
FIG. 43 is a graph showing a matrix composed of plural pairs of display electrodes 22 and 23 (N lines) and a plurality of address electrodes 28 (M columns)
Figure 44:
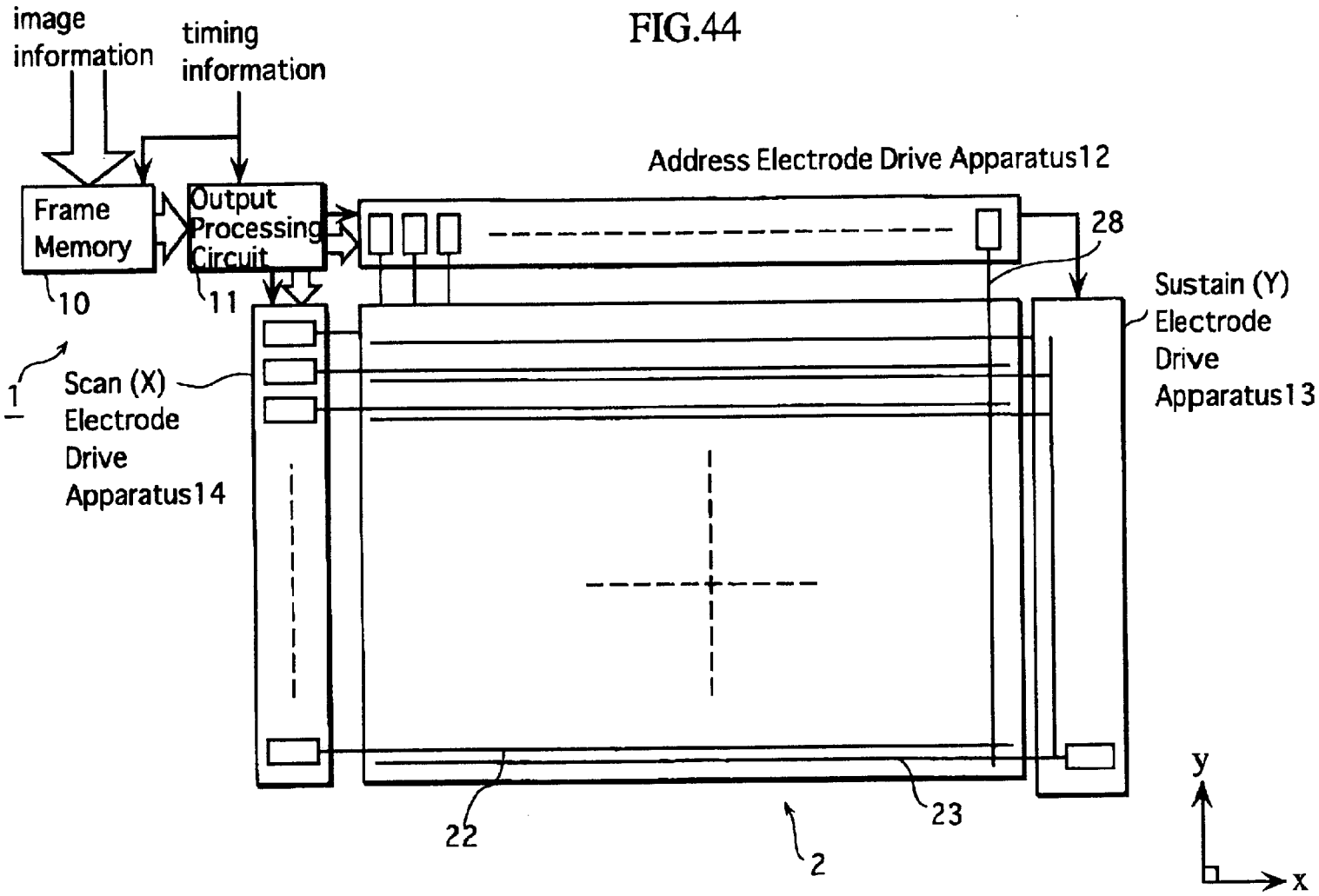
FIG. 44 is a conceptual block diagram of an image display apparatus using the known PDP.
Figure 45:
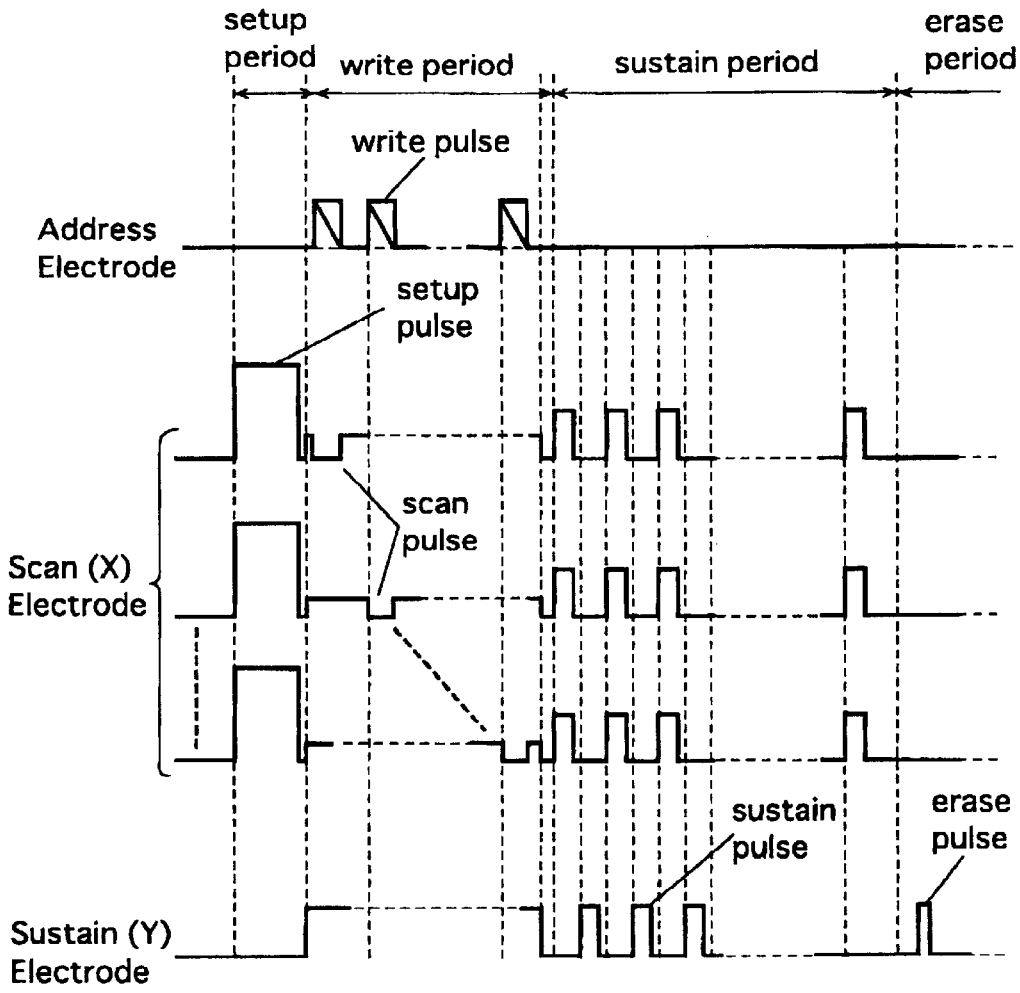
FIG. 45 shows exemplary waveforms applied to each of the electrodes (scanelectrode, sustain electrode, address electrode) in the known PDP.
Figure 46:
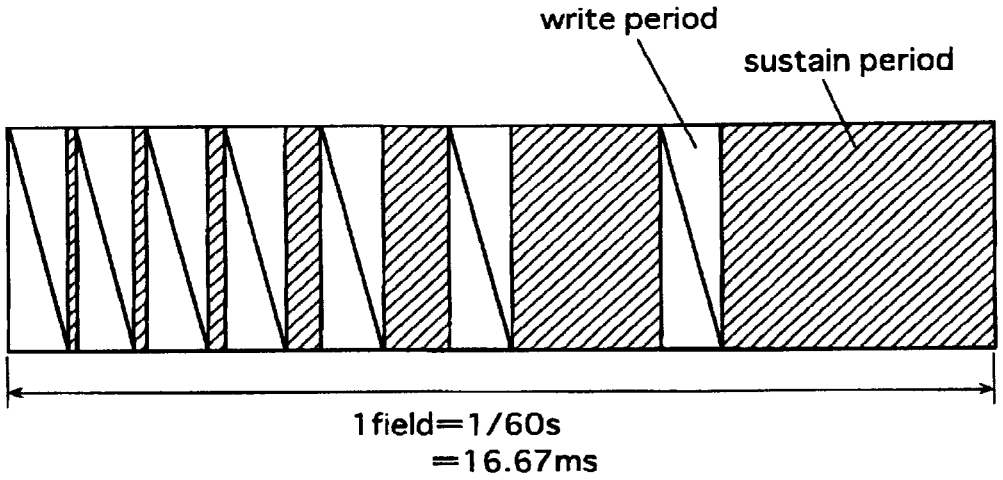
FIG. 46 shows a method for dividing a field into subfields in the known PDP in order to express 256 color gradations.

FIGS. 41*a* and 41*b* show a view from above of the display electrodes according to embodiment 24. According to this embodiment, display electrode 22 (23) includes line part 221 (231) and either band-shaped protrusion parts 222 (232) as in or FIG. 41*a* or hook-shaped protrusion parts 222 (322) as in FIG. 41*b*. Main discharge gap G is defined in FIG. 41*a* as the shortest distance between protrusion parts 222 and 232, and in FIG. 41*b* as the shortest distance between protrusion part 222 (232) and the hooked end of protrusion part 232 (222).

In addition to substantially the same effects as in embodiment 17, embodiment 24 achieves the following.

Specifically, in the prior art, there have been cases in which luminous efficiency has been improved by enlarging main discharge gap G, although this generally requires a high discharge initiating voltage. To suppress this increase in discharge initiating voltage, it is possible to reduce either the pressure of the discharge gas in the cells or the density of Xe in the discharge gas. However, these measures adversely reduce the luminous efficiency by decreasing panel brightness.

In contrast, by securing a main discharge gap G over a large area (i.e. the facing edges of protrusion parts 222 and 232 in the y direction) as per the electrode structure according to embodiments 24a and 24b, it is possible to achieve excellent luminous efficiency, even though gap G may be comparatively narrow.

Table 14 compares the capacity of the PDPs according to embodiments 17 and 24a/b.

TABLE 14

| | W1 [μm] | W2 [μm] | W3 [μm] | brightness B [cd/m$^2$] | rel. luminous efficiency [η] |
|---|---|---|---|---|---|
| embodiment 17 | 60 | 40 | — | 450 | 1.0 |
| embodiment 24a | 60 | 40 | 80 | 490 | 1.2 |
| embodiment 24b | 60 | 40 | 80 | 500 | 1.2 |

As shown in table 14, embodiments 24a and 24b are able to achieve excellent panel brightness and luminous efficiency. This is a result of being able to secure sufficient capacitance in the elongated (in the y direction) protrusion parts 222 and 232, thereby making it possible to achieve excellent discharge magnitude and luminous efficiency.

INDUSTRIAL APPLICABILITY

The present invention is applicable in televisions, particularly those capable of high definition image reproduction, an example of which is high-vision television.

What is claimed is:

1. A gas discharge panel having (i) a plurality of cells arranged in a matrix between a pair of opposing substrates, the cells being filled with a discharge gas, and (ii) plural pairs of display electrodes arranged on a surface of one of the substrates so as to extend through the plurality of cells, each pair of display electrodes being composed of a sustain electrode and a scan electrode that define a main discharge gap therebetween, wherein each sustain electrode and scan electrode includes a plurality of line parts that extend in a row direction of the matrix, and the main discharge gap and a line part gap between adjacent line parts are set such that a discharge current waveform of the display electrodes has a single peak when the gas discharge panel is driven.

2. The gas discharge panel according to claim 1, wherein each sustain electrode and scan electrode includes at least three line parts.

3. The gas discharge panel according to claim 1, wherein in each cell, a pitch of the line part gaps decreases as the distance from the main discharge gap increases.

4. The gas discharge panel according to claim 3, wherein the pitch of the line part gaps decreases geometrically or arithmetically.

5. The gas discharge panel according to claim 2, wherein a length of each cell in a column direction of the matrix is in a range of 480 μm to 1400 μm inclusive, and a relation $G-60\,\mu m \leqq S \leqq G+20\,\mu m$ is satisfied with respect to each cell, where G is a width of the main discharge gap, and S is an average width of the line part gaps.

6. The gas discharge panel according to claim 1, wherein in each cell, the line parts positioned furthest from the main discharge gap are wider than (i) the other line parts or (ii) an average width of all the line parts.

7. The gas discharge panel according to claim 6, wherein in each cell, the line parts increase in width as the distance from the main discharge gap increases.

8. The gas discharge panel according to claim 6, wherein in each cell, a relation $L_{ave} \leqq L_n \leqq \{0.35P-(L_1+L_2+\ldots L_{n-1})\}$ is satisfied with respect to one of the sustain electrode and the scan electrode having n number of line parts, where P is a cell length in the column direction of the matrix, $L_n$ is the width of the line parts positioned furthest from the main discharge gap, and $L_{ave}$ is an average width of the line parts.

9. The gas discharge panel according to claim 1, wherein in each cell, a resistance value R of the line parts positioned furthest from the main discharge gap is in a range of $0.1\ \Omega \leqq R \leqq 80\ \Omega$.

10. The gas discharge panel according to claim 1, wherein in each cell, first line parts positioned closest to the main discharge gap are narrower than the other line parts.

11. The gas discharge panel according to claim 1, wherein in each cell, first line parts positioned closest to the main discharge gap and second line parts positioned adjacent to the first line parts are narrower than (i) the other line parts or (ii) an average width of all the line parts.

12. The gas discharge panel according to claim 11, wherein the relations $0.5L_{ave} \leqq L_1$ and $L_2 \leqq L_{ave}$ are satisfied with respect to each cell, where $L_1$ is the width of the first line parts, $L_2$ is the width of the second line parts, and $L_{ave}$ is an average width of the line parts.

13. The gas discharge panel according to claim 1, wherein in each cell, at least one of the sustain electrode and the scan electrode includes one or more connection parts that electrically connect adjacent line parts.

14. The gas discharge panel according to claim 13, wherein the connection parts are included in the scan electrode.

15. The gas discharge panel according to claim 1, wherein the plurality of cells is defined by a plurality of first barrier ribs that extend in a column direction of the matrix and a plurality of second barrier ribs that extend in a row direction of the matrix.

16. The gas discharge panel according to claim 15, wherein a width of the second barrier ribs is in a range of 30 μm to 300 μm inclusive.

17. The gas discharge panel according to claim 15, wherein a height of the second barrier ribs is in a range of 50 μm to 120 μm inclusive.

18. The gas discharge panel according to claim 1, wherein a half-width Thw of a single-peaked illumination waveform corresponding to the single-peaked discharge current waveform is in a range of 50 ns≦Thw≦700 μs.

19. A gas discharge panel having (i) a plurality of cells arranged in a matrix between a pair of opposing substrates, the cells being filled with a discharge gas, (ii) phosphor layers corresponding to the colors red, green, and blue formed in the cells and extending in a column direction of the matrix, and (iii) plural pairs of display electrodes arranged on a surface of one of the substrates so as to extend through the plurality of cells, each pair of display electrodes being composed of a sustain electrode and a scan electrode that define a main discharge gap therebetween, wherein each sustain electrode and scan electrode includes a plurality of line parts that extend in a row direction of the matrix, at least one of the sustain electrode and the scan electrode in cells corresponding to at least one of the red, green, and blue phosphor layers includes one or more connection parts that electrically connect adjacent line parts, and the main discharge gap and a line part gap between adjacent line parts are set such that a discharge current waveform of the display electrodes has a single peak when the gas discharge panel is driven.

20. The gas discharge panel according to claim 19, wherein the connection parts are provided in cells corresponding to each of the red, green and blue phosphor layers, and a relation SbB≦SbR≦SbG is satisfied with respect to each cell, where SbR, SbG, and SbB are the surface areas of the connection parts in cells corresponding to the red, green, and blue phosphor layers, respectively.

21. A gas discharge panel having (i) a plurality of cells arranged in a matrix between a pair of opposing substrates, the cells being filled with a discharge gas, and (ii) plural pairs of display electrodes arranged on a surface of one of the substrates so as to extend through the plurality of cells, each pair of display electrodes being composed of a sustain electrode and a scan electrode that define a main discharge gap therebetween, wherein at least one of the sustain electrode and the scan electrode in each pair includes (i) a line part that extends in a lengthwise direction of the display electrodes, and (ii) a line-shaped or loop-shaped inner protrusion part that is electrically connected to an edge of the line part and which faces toward the other discharge electrode in the pair with the main discharge gap defined therebetween, and the main discharge gap is set such that an illumination wavelength of a discharge generated in the main discharge gap has a single peak when the gas discharge panel is driven.

22. The gas discharge panel according to claim 21, wherein the inner protrusion part is loop-shaped and has a perimeter which is one of triangular, squared, and rounded.

23. The gas discharge panel according to claim 21, wherein at least one of the display electrodes in each pair includes an outer protrusion part that is provided on an outer edge of the line part, the outer edge being the edge facing away from the main discharge gap.

24. The gas discharge panel according to claim 21, wherein in each cell, both display electrodes include a line part and an inner protrusion part, and the display electrodes are point-symmetrical to each other in shape with respect to a central point in each respective cell.

25. The gas discharge panel according to claim 24, wherein tips of the inner protrusion parts provided on each of the display electrodes in a pair are out of alignment in a column direction of the matrix.

26. The gas discharge panel according to claim 21, wherein with respect to each display electrode, a capacitance of the inner protrusion part is less than a capacitance of the line part when the gas discharge panel is driven.

27. The gas discharge panel according to claim 21, wherein one of the sustain electrode and the scan electrode in a pair includes two line parts, and positioned between the two line parts is a third line part that is included in the other electrode in the pair, and two main discharge gaps are defined between the three line parts included in each pair of display electrodes.

* * * * *